US006824131B2

(12) United States Patent
Togashi

(10) Patent No.: US 6,824,131 B2
(45) Date of Patent: Nov. 30, 2004

(54) METHOD AND APPARATUS FOR IMAGE FORMING AND EFFECTIVELY PERFORMING SHEET FEEDING USING A SHEET FEED ROLLER AND A TILT MEMBER

(75) Inventor: Toshifumi Togashi, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/924,832

(22) Filed: Aug. 8, 2001

(65) Prior Publication Data

US 2002/0036377 A1 Mar. 28, 2002

(30) Foreign Application Priority Data

| | | |
|---|---|---|
| Aug. 8, 2000 | (JP) | 2000-239871 |
| Sep. 29, 2000 | (JP) | 2000-299245 |
| Dec. 29, 2000 | (JP) | 2000-405063 |
| Mar. 19, 2001 | (JP) | 2001-079040 |
| May 11, 2001 | (JP) | 2001-142313 |

(51) Int. Cl.[7] ..... B65H 3/52
(52) U.S. Cl. ..... 271/121; 271/124; 271/127
(58) Field of Search ..... 271/121, 124, 271/126, 127

(56) References Cited

U.S. PATENT DOCUMENTS

| | | | | |
|---|---|---|---|---|
| 4,535,981 A | * | 8/1985 | Watanabe et al. | 271/121 |
| 4,572,498 A | * | 2/1986 | Shiozawa | 271/34 |
| 4,588,181 A | * | 5/1986 | Sakata et al. | 271/121 |
| 4,674,737 A | | 6/1987 | Murayoshi | |
| 4,815,724 A | * | 3/1989 | Sumida et al. | 271/121 |
| 5,052,677 A | * | 10/1991 | Shibata | 271/164 |
| 5,058,877 A | * | 10/1991 | Fujiwara et al. | 271/124 |
| 5,104,113 A | * | 4/1992 | Kameyama et al. | 271/124 |
| 5,163,668 A | * | 11/1992 | Winship et al. | 271/121 |
| 5,253,854 A | * | 10/1993 | Tanoue et al. | 271/10.12 |
| 5,277,417 A | * | 1/1994 | Moritake et al. | 271/121 |
| 5,326,091 A | * | 7/1994 | Giacometto et al. | 271/10.01 |
| 5,386,983 A | * | 2/1995 | Ando | 271/118 |
| 5,413,325 A | * | 5/1995 | Dubois et al. | 271/121 |
| 5,573,338 A | * | 11/1996 | Morikawa et al. | 400/611 |
| 5,584,475 A | * | 12/1996 | Asada et al. | 271/121 |
| 5,775,688 A | | 7/1998 | Kato et al. | |
| 5,975,518 A | | 11/1999 | Wakana et al. | |
| 5,996,989 A | * | 12/1999 | Cahill et al. | 271/121 |

(List continued on next page.)

FOREIGN PATENT DOCUMENTS

| | | |
|---|---|---|
| GB | 2195614 | 4/1988 |
| GB | 2230000 | 10/1990 |
| JP | 61291325 | 12/1986 |
| JP | 62295836 | 12/1987 |
| JP | 891612 | 4/1996 |

*Primary Examiner*—Donald P. Walsh
*Assistant Examiner*—Daniel K Schlak
(74) *Attorney, Agent, or Firm*—Cooper & Dunham LLP

(57) ABSTRACT

A sheet feeder separates a stack of sheet materials one by one for securely feeding individual sheet materials without multiple sheet feeding or failure in feeding a sheet material. The leading edge of a sheet material stacked on a bottom board of a cassette is brought into contact with a sheet feed roller. Near the location at which the leading edge of the sheet material comes in contact with the sheet feed roller, a tilt member is pressed onto the sheet feed roller by the action of a compression spring. A contact area of the tilt member with the sheet feed roller is reduced to prevent the sheet feed roller from rotating together with the sheet material. The topmost sheet material is fed by the rotation of the sheet feed roller in the counter-clockwise direction and supplied beyond the tilt member by friction with the sheet feed roller, whereas the next sheet material is blocked by the tilt member due to less friction between the sheet materials, thereby preventing multiple sheet feeding.

64 Claims, 45 Drawing Sheets

U.S. PATENT DOCUMENTS 5,997,198 A * 12/1999 Murayama et al. ..... 400/624
6,050,564 A * 4/2000 Tamehira ..... 271/114
6,070,867 A * 6/2000 Tsurumi et al. ..... 271/114
6,145,831 A * 11/2000 Inoue et al. ..... 271/121
6,173,951 B1 * 1/2001 Inoue et al. ..... 271/121
6,260,839 B1 * 7/2001 Araki et al. ..... 271/10.11
6,318,716 B1 * 11/2001 Okuda ..... 271/121
6,331,002 B1 * 12/2001 Yoshino et al. ..... 271/117
6,367,795 B1 * 4/2002 Matsuda et al. ..... 271/126
6,371,477 B1 * 4/2002 Lin ..... 271/121
6,398,209 B1 * 6/2002 Sato ..... 271/124
6,540,221 B2 * 4/2003 Nakashima et al. ..... 271/121
6,554,272 B2 * 4/2003 Otake et al. ..... 271/121
6,565,078 B1 * 5/2003 Foglino et al. ..... 271/124
6,575,452 B2 * 6/2003 Hsiao et al. ..... 271/121
6,585,250 B1 * 7/2003 Hsiao ..... 271/121
2003/0085508 A1 * 5/2003 Fukuchi ..... 271/121
2003/0155702 A1 * 8/2003 Togashi et al. ..... 271/121
2004/0065993 A1 * 4/2004 Kamijoh ..... 271/121

* cited by examiner

METHOD AND APPARATUS FOR IMAGE FORMING AND EFFECTIVELY PERFORMING SHEET FEEDING USING A SHEET FEED ROLLER AND A TILT MEMBER

BACKGROUND

1. Field of the Invention

This patent specification relates to a method and apparatus for image forming, and more particularly to a method and apparatus for image forming and effectively performing a sheet transfer.

2. Description of Related Art

Conventionally, sheet feeders for separating stacked sheet materials one by one to feed them from the topmost one are classified into a corner tab separation type which presses both ends in the width direction on the leading edge of a sheet material in a feeding direction with tab members for separation; a separation pad type which urges a friction member to separate a sheet material; a bank separation type which runs sheet materials into a fixed gate member having a slope for separating the sheet materials one by one; and so on.

Among these types of sheet feeders, the known separation pad type sheet feeder, or the bank separation type sheet feeder discussed, for example, in Laid-open Japanese Patent Application No. 8-91612 are preferred since they require a low number of parts, but can be applied to a variety of different sheet materials (for example, post cards, envelopes, OHP (over head projector) sheets and so on) of different sizes including thick and thin materials in the same configuration at a low cost.

However, a conventional sheet feeder of the separation pad type generates noise due to friction slip, when a sheet material is being conveyed, sandwiched between a sheet feed roller and a friction member, particularly in a low cost, low speed machine operating 10 PPM (an image forming speed of 10 sheets per minute) or less. To prevent such noise, it is necessary to form the sheet feed roller in a semilunar shape. This leads to a requirement of a pair of cylindrical collars each having a diameter slightly smaller than that of the sheet feed roller additionally disposed coaxially with the sheet feed roller on both sides thereof for preventing a sheet stack stacking member from lifting up. Consequently, the number of parts is increased to result in a higher cost.

Recently, as recycled paper is increasingly used, sheet materials such as post cards and envelopes often having burred leading edges in a conveying direction, possibly produced in a cutting operation, cause an extra conveying load, so that the separation pad type sheet feeder can fail to feed sheet materials.

Further, back sides of once used sheet materials are also increasingly used, in which case stacked sheet materials differ in friction coefficient from one another so that two or more sheet materials may be fed at one time. A once used sheet material may be curled during fixation depending on a particular environment. Thus, a sheet material separator may be burdened with a greater load due to a curled leading edge of a sheet material depending on a direction in which the sheet material is curled, and may fail to separate the sheet materials for conveying them one by one.

It should be noted that the separation pad type sheet feeder presses a plane portion of a pad onto a sheet feed roller, so that the angle of a separation pad to a direction in which a sheet material fed from a stack is conveyed (corresponding to a displacement angle of a sheet material stacking member such as a bottom board) must be limited within a predetermined range. To conform to this limitation, the sheet feed roller is also limited in diameter, and the degree of freedom in layout is also restricted, thereby giving rise to a problem that the sheet feeder cannot be reduced in size.

On the other hand, the bank separation type sheet feeder discussed in Laid-open Japanese Patent Application No. 8-91612 includes a tilt member in contact with a sheet feed roller, which has a flat upper edge and a wide nip region with the sheet feed roller, so that variations in the member or the like can make it difficult to arrange the tilt face at a predetermined tilt angle.

When the topmost sheet material is being conveyed in an image forming unit, the sheet feed roller generally is not driven by the mechanism that rotates it to feed a sheet from the stack. However, while a previous sheet material is nipped between the sheet feed roller and a gate member, the sheet feed roller is rotated due to the friction force with the sheet material, and as the trailing edge of the previous sheet material passes the nip region, the leading edge of the next sheet material is sent to the tilt member by the associated rotation of the sheet feed roller.

In this event, if a friction coefficient between sheet materials is high or varies greatly, and the friction coefficient between the previous sheet material and the next sheet material is lower than the friction coefficient between the next sheet material and the sheet material subsequent to the next sheet material, the next sheet material can go beyond the tilt member to result in multiple sheet feeding.

Generally, in a sheet feeder which removably supports, through an opening of the feeder body, a cassette having a sheet material stacking member which has one end supported for pivotal movement and a free end urged upward, a tilt member and a sheet material separator in pressing contact with a sheet feed roller are positioned deep in the feeder body. Therefore, if a user attempts to draw out the cassette which contains few sheet materials, the sheet material stacking member may be caught in the feeder body, to keep the user from drawing out the cassette.

To overcome such a problem, as illustrated in FIG. 54, a conventionally known sheet feeder has a pair of protruding arms 1*c* (only one of which is shown in FIG. 54) integrally arranged on both sides of a bottom board 1, which is a sheet material stacking member having one end supported by a shaft 1*a* for pivotal movement within a cassette 11 and a free end urged upward at all times by a compression spring 3, and guide rails 10*c* formed on a feeder body 10 corresponding to the arms 1*c*, such that as the cassette 11 is drawn in a direction indicated by an arrow Y, the arms 1*c* come in contact with the guide rails 10*c* and lower the bottom board 1 against an urging force of the compression spring 3 as illustrated in FIG. 55, and the bottom board 1 is held at the lowered position by a known stopper means when the cassette 11 is drawn out.

However, although such a sheet feeder can prevent the bottom board 1 from being caught when the cassette 11 is drawn out, the tilt member is pressed onto the sheet feed roller 4 by the compression spring 5 after a sheet material has been fed before the cassette 11 is drawn out, so that the leading edge of the next sheet material 2*n* may remain nipped by the sheet feed roller 4 after the previous sheet has been fed (see FIG. 55).

If the cassette 11 is drawn out to supply sheet materials and again set in the sheet feeder, a remaining sheet material

2*n* within the feeder body 10 is crushed by the set cassette 11 to block the separator comprised of the tilt member 6, resulting in an inability of the sheet feeder to feed sheet materials.

To solve this problem, a conventional sheet feeder includes means associated with a movement of a drawn cassette to release the pressure of the tilt member. Another conventional sheet feeder provides a cassette with a separate arm for raking out the leading edge of a nipped sheet material. A further conventional sheet feeder senses a movement of a drawn cassette to rotate the sheet feed roller in a direction reverse to a sheet feeding direction to remove the leading edge of a sheet material from a nip region.

Among these conventional techniques, the first and third sheet feeders require an increased number of parts and increased steps for assembly to introduce a lower production efficiency. The second sheet feeder, on the other hand, can cause sheet material to tear and remain near the nip region, depending on the material, since the arm attempts to rake out the sheet material, as it is, nipped by a pressure applied by the tilt member and a pressure applied by the leading edge of the bottom board.

Furthermore, a sheet feeder which has an inclined bottom board for stacking sheet materials, positioned on the back surface or the like of an image forming apparatus, may cause skewing of sheet material that has one side fixed by a sheet material convey guide for structural reasons. A solution for this problem has been desired.

An image forming apparatus, simple in configuration, generally relies on a common motor for driving a sheet feeder and for driving an image forming section, so that a reduction in a load on the driving motor has been desired.

In addition, if a large number of sheet materials, the leading edges of which are uneven, are set in this type of sheet feeder, a conveyed sheet could be caught by the sheet feed roller and its leading edge damaged thereby. If the user is not aware of such a caught sheet and leaves it there, a paper jam is likely to occur when a sheet material is fed.

SUMMARY

This patent specification describes a novel sheet feeder that separates sheet materials stacked on a pivotable sheet material stacking member one by one from the topmost sheet material so as to feed each of the sheet materials. In one example, a novel sheet feeder includes a sheet feed roller and a tilt member. The sheet feed roller is configured to come in pressing contact with the topmost sheet material for feeding the sheet material to a separator. The tilt member is configured to come in pressing contact with the sheet feed roller and includes a tilt face. In this configuration, the sheet feed roller has a front end running against the tilt face and a contact face in contact with the sheet feed roller, in the shape of an edge along an axial direction of the sheet feed roller.

In the foregoing sheet feeder, the tilt member may be in pressing contact with the sheet feed roller for pivotal movement with respect to the sheet feed roller, and may include translating means for advancing and retracting the tilt member in parallel to the sheet feed roller. The translating means is preferably comprised of a rib formed on one of the tilt member or a feeder body, and a guide rail formed on the other.

In the sheet feeder described above, the tilt member preferably has a contact face, the length of which is smaller than an axial length of the sheet feed roller, and more preferably is formed of a synthetic resin and includes a metal plate for covering at least the contact face with the sheet feed roller. The metal plate is preferably elastic. The elastic metal plate may be mounted from the tilt face so as to surround the tilt member on both upper and lower sides.

The distance in a sheet material convey direction between a location of the sheet feed roller at which the tilt member is in pressing contact with the sheet feed roller and a location of the sheet feed roller at which a sheet stacked on the sheet material stacking member comes in contact with the sheet feed roller preferably is in a range of 2 mm to 6 mm, and the angle of the tilt face of the tilt member to the sheet material convey direction preferably is set in a range of 50° to 70°.

The sheet feeder may further include a thin elastic member disposed at a location downstream of a contact area of the sheet feed roller with the tilt member such that the thin elastic member crosses a tangential direction of the contact area. The thin elastic member may include two members disposed on both sides of the sheet feed roller, or may be disposed substantially at the center of the sheet feed roller.

The sheet feeder may further include a thin elastic member crossing the tangential direction of the contact area at a location downstream of the contact area of the sheet feed roller with the tilt member, wherein the thin elastic member includes a bent in the shape of hook bent toward the sheet feed roller at a rear end. The thin elastic member may include two members disposed on both sides of the sheet feed roller, or may be disposed substantially at the center of the sheet feed roller. The thin elastic member is disposed to cross the tangential direction at an angle ranging from 20° to 60°.

The sheet feeder may further include a friction member which crosses a tangential direction of a contact area of the sheet feed roller in contact with the tilt member at a location downstream of the contact area. The friction member may include two members disposed on both sides of the sheet feed roller, or may be disposed substantially at the center of the sheet feed roller.

The sheet feeder may further include a pressure lever having a free end configured to come in contact with and move away from the sheet material stacking member, a sensing lever mounted coaxially with the pressure lever for pivotal movement associated with insertion/removal of a cassette having the sheet stacking member, and an elastic member disposed between the sensing lever and the pressure lever.

The pressure lever may be pivotally moved in association with the sensing lever when an angle of the pressure lever to the sensing lever is greater than a predetermined angle. In addition, the sensing lever may include a pair of arms at a free end thereof, wherein the arms extend from both sides of the tilt member, and the sensing lever pivotally moves to cause the arms to pass both sides of the contact area of the tilt member.

The sensing lever preferably includes spring pressure changing means for adjusting an urging force of a compression spring for pressing the tilt member onto the sheet feed roller.

The sheet feeder may further include a spring bearer disposed slidably in an axial direction of the compression spring on the opposite side of the compression spring with respect to the tilt member, wherein the spring pressure changing means engages with and disengages from the spring bearer associated with pivotal movement of the sensing lever, and the spring pressure changing means drives the spring bearer toward the tilt member when the spring pressure changing means engages with the spring bearer.

The sheet feeder may further include first cams disposed coaxially with the sheet feed roller for separating the sheet material stacking member from the sheet feed roller when the first cams come in contact with both side ends of a front face of the sheet material stacking member. The sheet material stacking member may include pressor ribs on both side ends at the front face thereof, such that the first cams come in contact with the pressor ribs.

The sheet feeder may further include second cams disposed coaxial with the sheet feed roller for separating the tilt member from the sheet feed roller when the second cams come in contact with both side ends of the tilt member. The tilt member may include ribs at both side ends, such that the second cams come in contact with the ribs.

The sheet feeder may further include a tilt member holder plate between the second cams and the tilt member. The tilt member holder plate has an opening formed for avoiding a site at which the sheet feed roller comes in contact with the tilt member, and a leading end spaced apart from the sheet material stacking member.

The present patent specification further discloses a novel image forming apparatus. In one example, a novel image forming apparatus includes a sheet feeder and an image forming mechanism. The sheet feeder separates sheet materials stacked on a pivotable sheet material stacking member one by one from the topmost sheet material so as to feed each of the sheet materials. The sheet feeder includes a sheet feed roller and a tilt member. The sheet feed roller is configured to come in pressing contact with the topmost sheet material for feeding the sheet material to a separator. The tilt member is configured to come in press contact with the sheet feed roller and includes a tilt face. The sheet feed roller has a front end running against the tilt face. The tilt member has a contact face in contact with the sheet feed roller in the shape of an edge along an axial direction of the sheet feed roller. The image forming mechanism is configured to form an image on a sheet material fed out from the sheet feeder.

The present patent specification further discloses a novel method of sheet feeding. In one example, a novel method of sheet feeding includes the steps of causing and making. The causing step causes a sheet feed roller to come in pressing contact with the topmost sheet material stacked on a pivotable sheet material stacking member so as to feed the sheet material to a separator. The making step makes a tilt member come in pressing contact with the sheet feed roller. The tilt member includes a tilt face. The sheet feed roller has a front end running against the tilt face. The tilt member has a contact face in contact with the sheet feed roller in the shape of an edge along an axial direction of the sheet feed roller.

The present patent specification further discloses a novel method of image forming. In one example, a novel method of image forming includes the steps of causing, making, and forming. The causing step causes a sheet feed roller to come in pressing contact with the topmost sheet material stacked on a pivotable sheet material stacking member so as to feed the sheet material to a separator. The making step makes a tilt member come in pressing contact with the sheet feed roller. The tilt member includes a tilt face. The sheet feed roller has a front end running against the tilt face. The tilt member has a contact face in contact with the sheet feed roller in the shape of an edge along an axial direction of the sheet feed roller. The forming step forms an image on the sheet material fed out from the sheet feeder.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
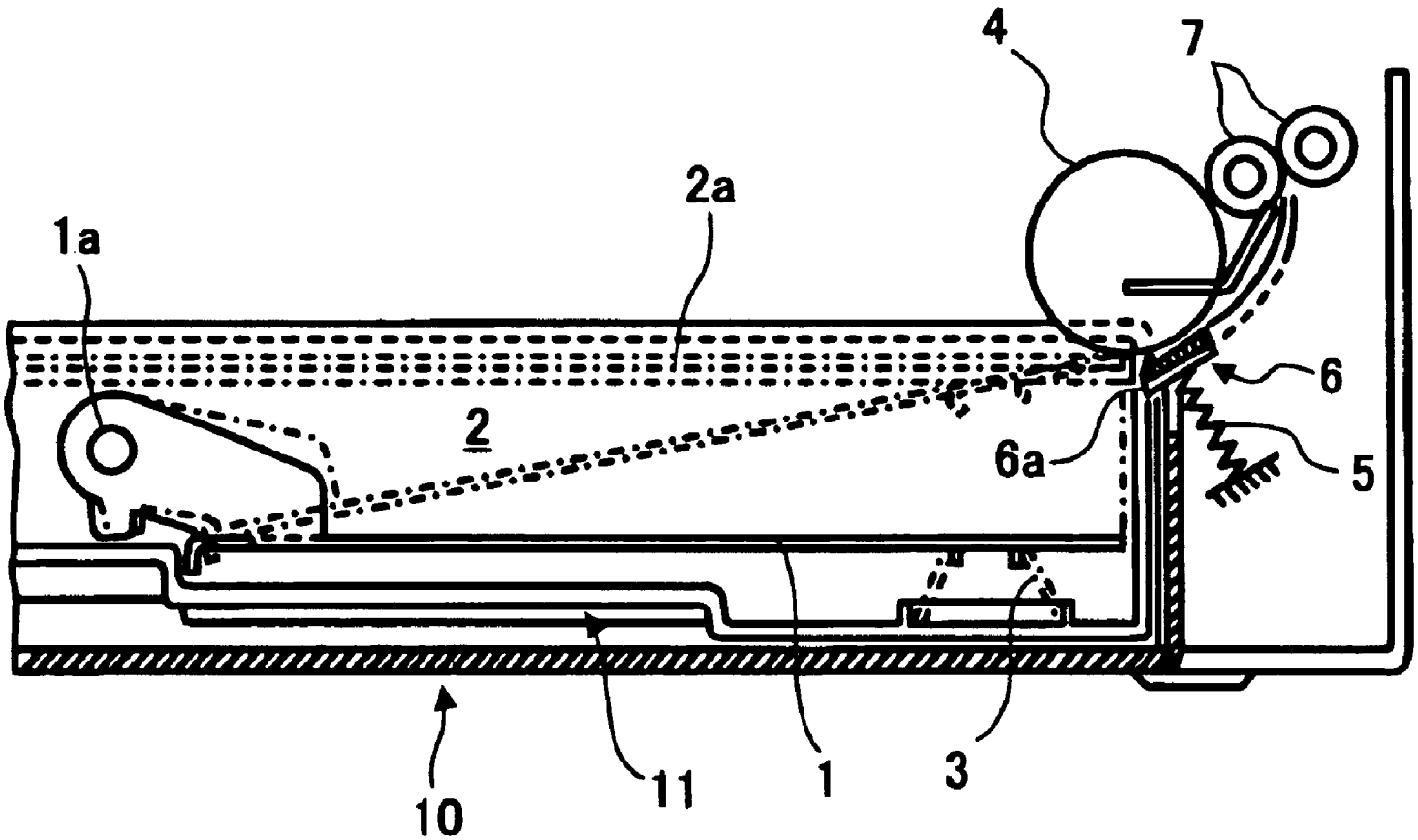
FIG. 1 is a vertical sectional view illustrating a first embodiment.

In describing preferred embodiments illustrated in the drawings, specific terminology is employed for the sake of clarity. However, the present invention is not intended to be limited to the specific terminology so selected and it is to be understood that each specific element includes all technical equivalents which operate in a similar manner.

Figure 2:
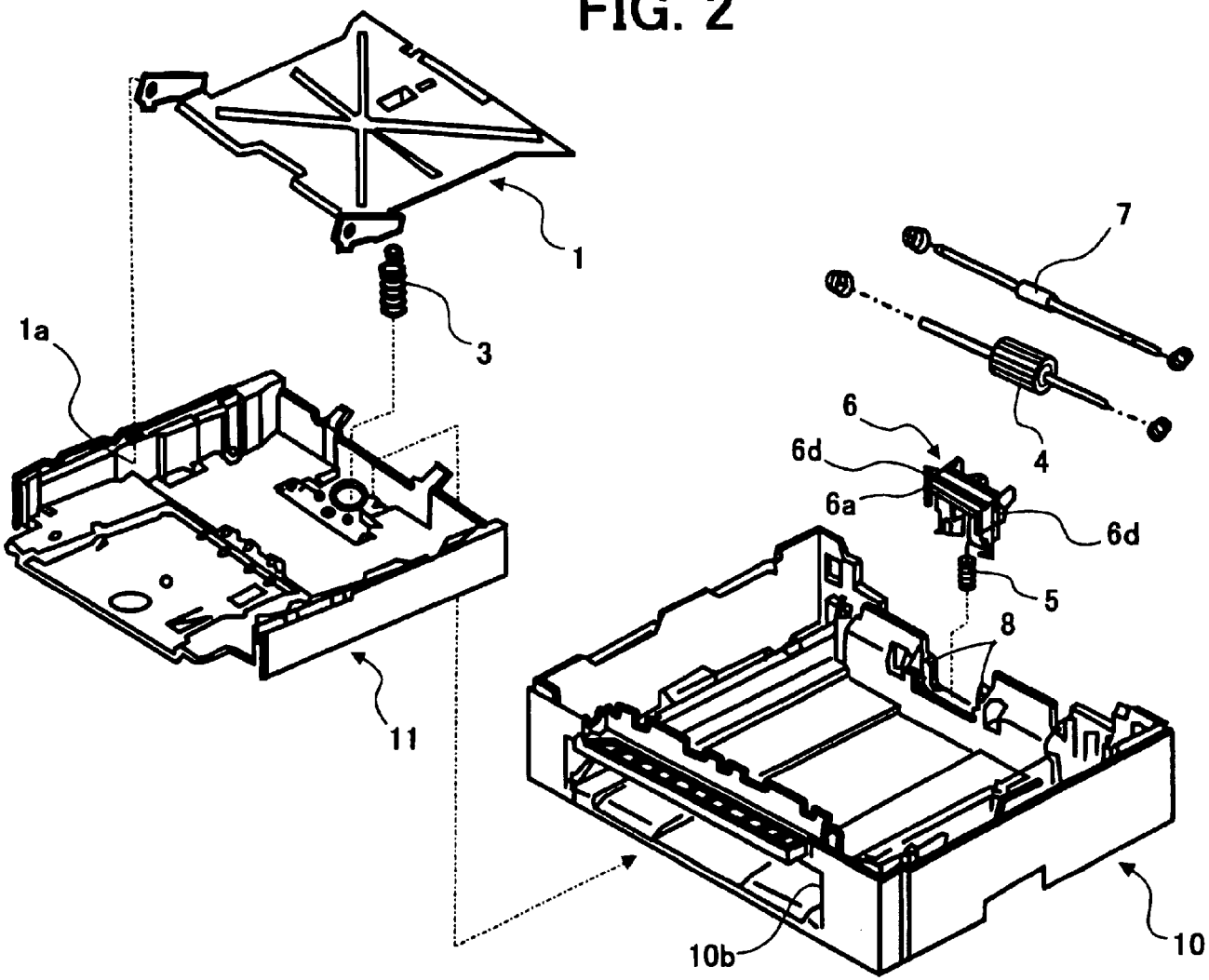
FIG. 2 is an exploded perspective view illustrating a configuration of the first embodiment.
Figure 3:
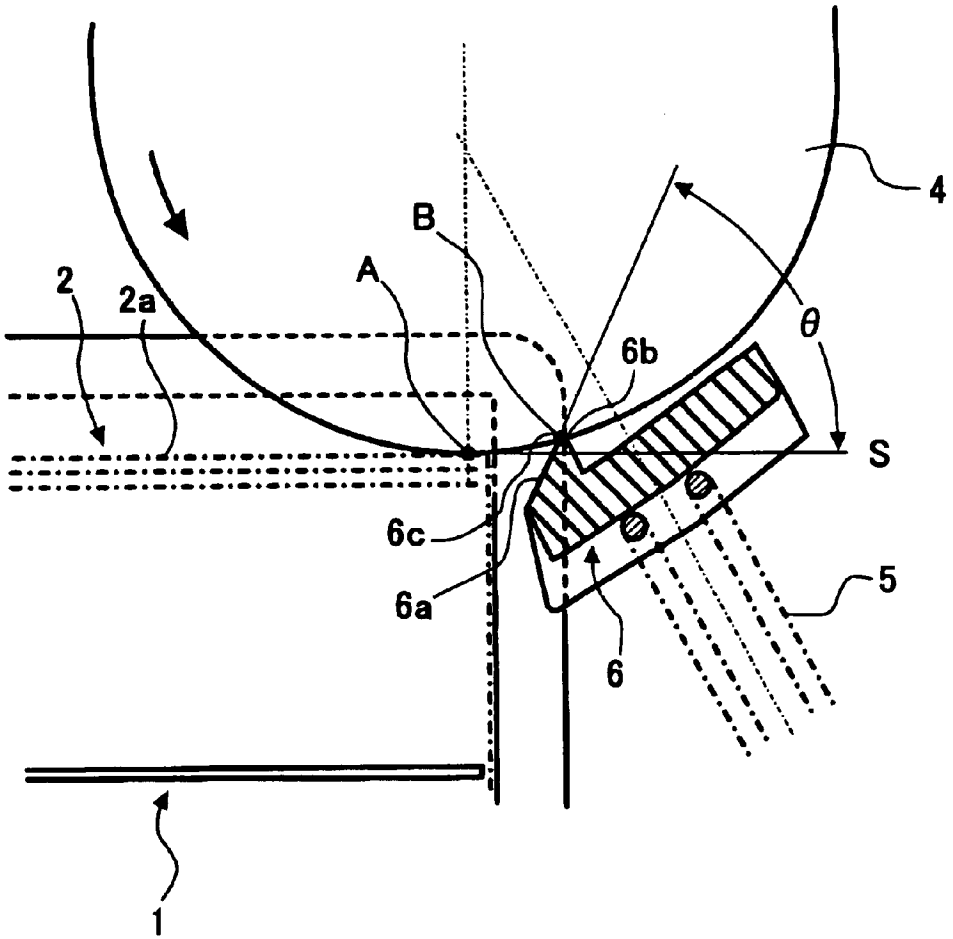
FIG. 3 is an explanatory diagram illustrating a portion of FIG. 1 in an enlarged view.

Referring now to the drawings, wherein like reference numerals designate identical or corresponding parts throughout the several views, and more particularly to FIGS. 1–3 thereof, a sheet feeder is explained. FIG. 1 is a vertical sectional view illustrating a sheet feeder according to a first embodiment, FIG. 2 is an exploded perspective view illustrating a general configuration of the sheet feeder, and FIG. 3 is an explanatory diagram illustrating a portion of FIG. 1 in enlarged view.

To begin with, a general configuration of the sheet feeder will be described with reference to FIGS. 1 and 2. A feeder body 10 in the shape of a shallow housing having low walls around four sides supports a cassette 11 removably mounted therein through an opening 10*b* on a side surface. The cassette 11 contains a bottom board 1, which is a sheet material stacking member that can carry a plurality of sheet materials 2 illustrated in FIG. 1. Board 1 has one edge pivotally supported by a shaft or pivot, and a free edge urged at all times upward in FIG. 1 by a compression spring 3 arranged between the bottom board 1 and the cassette 11.

The feeder body 10 comprises a sheet feed roller 4 that can come in pressing contact with the leading edge of the topmost sheet material 2*a* of the sheet materials 2 stacked on the bottom board 1, with an urging force provided by the compression spring 3 in the counter-clockwise direction in FIG. 1. A contact face 6*b* of a tilt member 6 having a tilt face 6*a* is pressed against the sheet feed roller 4 with an urging force provided by the compression spring 5. These components comprise a separator for the sheet materials.

As illustrated in FIG. 2, the tilt member 6 has a pair of ribs 6*d* protruding from the left and right side faces thereof, which are slidably guided by guide rails 8 on the feeder body 10 so that they are movable in a direction parallel to a direction in which they come in contact with the sheet feed roller 4. At a location downstream of the tilt member 6, a pair of convey rollers 7 (one of which is illustrated in FIG. 2) are rotatably supported for conveying a sheet material 2 fed out by the sheet feed roller 4 toward an image forming section of an image forming apparatus (not shown).

Alternatively, the translating means for the tilt member 6 may be comprised of guide rails on the tilt member 6 and ribs on the feeder body 10.

Now, referring to FIG. 3, detailed description will be made on a relationship among the sheet materials 2 stacked on the bottom board 1, sheet feed roller 4, and tilt member 6. A tilt face 6*a* of the tilt member 6 is defined to form a predetermined angle θ to a direction in which the sheet feed roller 4 feeds out the topmost sheet material 2*a* of the plurality of sheet material 2 stacked on the bottom board 1. The contact face 6*b* continuous to the tilt face 6*a*, in contact with the sheet feed roller 4, is formed in the shape of an edge extending along the axial direction of the sheet feed roller 4. The edge has an extremely small width. The edge may be continuous or divided into a plurality of parts.

Then, the distance between a contact site A on the topmost sheet material 2*a* on the bottom board 1 and a site B at which the contact face 6*a* comes in pressing contact with the sheet feed roller 4 is made as short as possible along the direction in which the sheet material is fed out. As a sheet feed start signal is generated from a controller, not shown, the sheet feed roller 4 can be kept rotated until the topmost sheet material 2*a* has been fed out.

By reducing the distance between the sites A, B in this way, various sheet materials that can differ in bending modules, have a reduced curved range at the leading edge thereof, with the result that their bending moduli are close to each other, thereby making it possible to suppress variations in a component of force generated by the tilt face 6*a* of the tilt member 6, and to separate sheet materials such as thin sheets of paper having small bending moduli, as well as thick sheets of paper, post cards, envelops and so on having large moduli. Consequently, a variety of different sheet materials can be available.

Next, the action of the sheet feeder according to the first embodiment will be described with reference to FIGS. 4 through 7 as appropriate.

Figure 4:
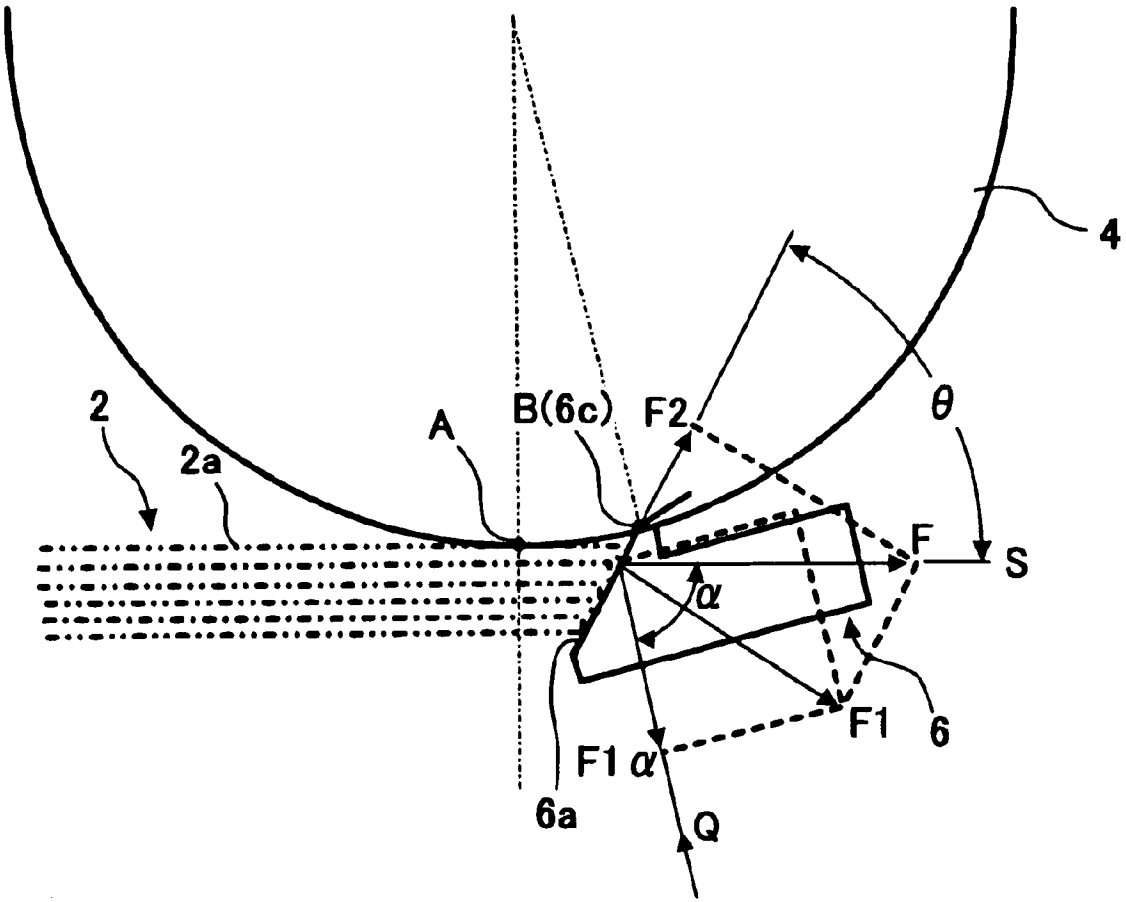
FIG. 4 is an explanatory diagram showing a relationship among forces applied to the topmost sheet in the first embodiment.

FIG. 4 shows a relationship between forces applied to the topmost sheet material 2*a*. As a force is applied by the sheet feed roller 4 to the plurality of stacked sheet materials 2*a* toward a separator, the leading edge of the topmost sheet material 2*a* applies a force F on the tilt face 6*a* of the tilt member 6. The tilt face 6*a* is set to be at an angle θ to a direction S in which the topmost sheet material 2*a* is fed out. A component of force F1 is generated in a direction perpendicular to the tilt face 6*a,* while a component of force F2 in a direction along the tilt face 6*a*.

A separating pressure Q of a compression spring 5 for pressing the tilt member 6 onto the sheet feed roller 4 is set at a predetermined angle α to the direction in which the sheet material 2 is fed out. The separating pressure Q is set smaller than the component F1α of the component of force F1, so that the topmost sheet material 2*a* goes beyond the tilt face 6*a* of the tilt member 6 and is fed toward the convey roller pair 7 illustrated in FIG. 7.

Figure 5:
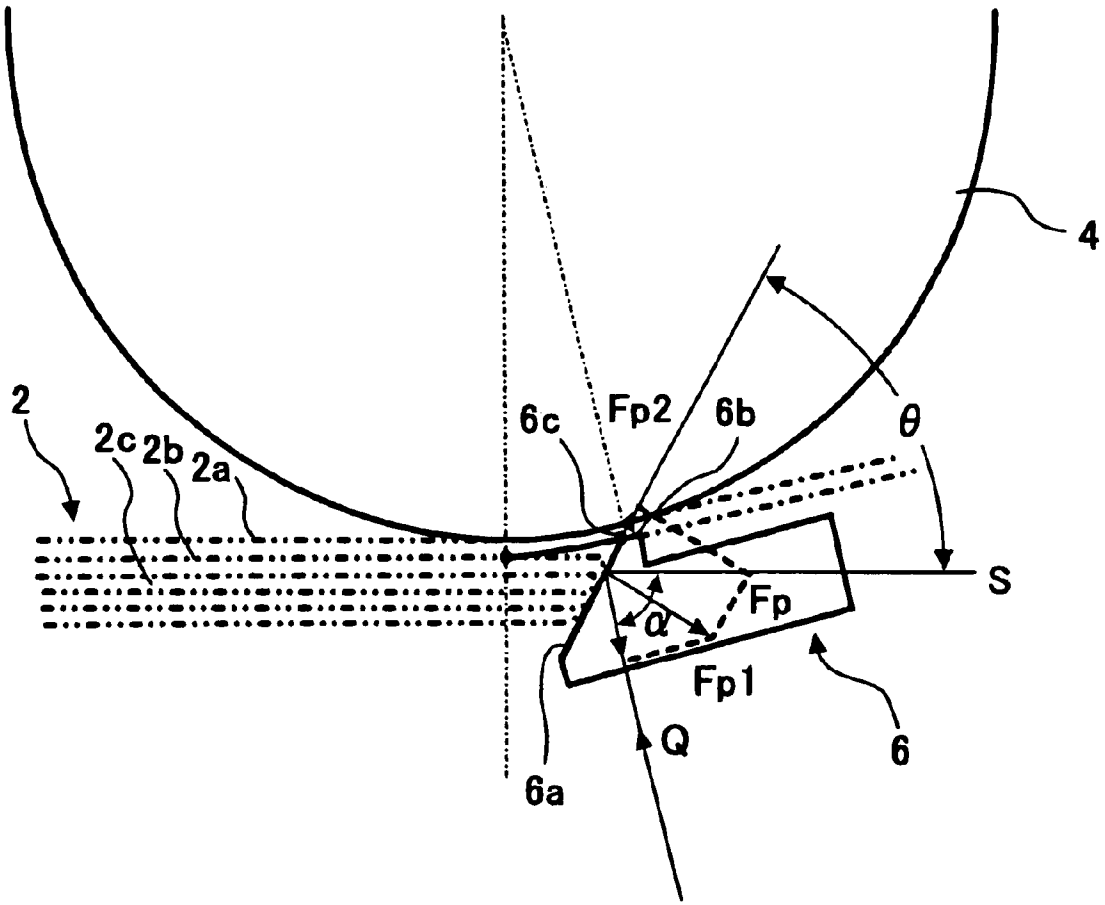
FIG. 5 is an explanatory diagram showing a relationship among forces applied to the next sheet in the first embodiment.

FIG. 5 shows a relationship between forces applied to the next sheet material 2*b,* wherein the next sheet material 2*b* is applied with a force Fp by a friction load between this sheet material 2*b* and a subsequent sheet material 2*c*. The force Fp generates a component of force Fp1 in the direction perpendicular to the tilt face 6*a* of the tilt member 6, and a component of force Fp2 along the tilt face 6*a*. However, since a friction coefficient between the sheet materials is generally approximately one half of a friction coefficient between the sheet feed roller and the sheet material, the force Fp is also approximately one half of the force F shown in FIG. 4, so that the sheet 2*b* is not applied with a sufficient force that causes the sheet 2*b* to go beyond the tilt face 6*a,* and therefore is blocked by the tilt member 6 and separated from the topmost sheet 2*a*.

Figure 6:
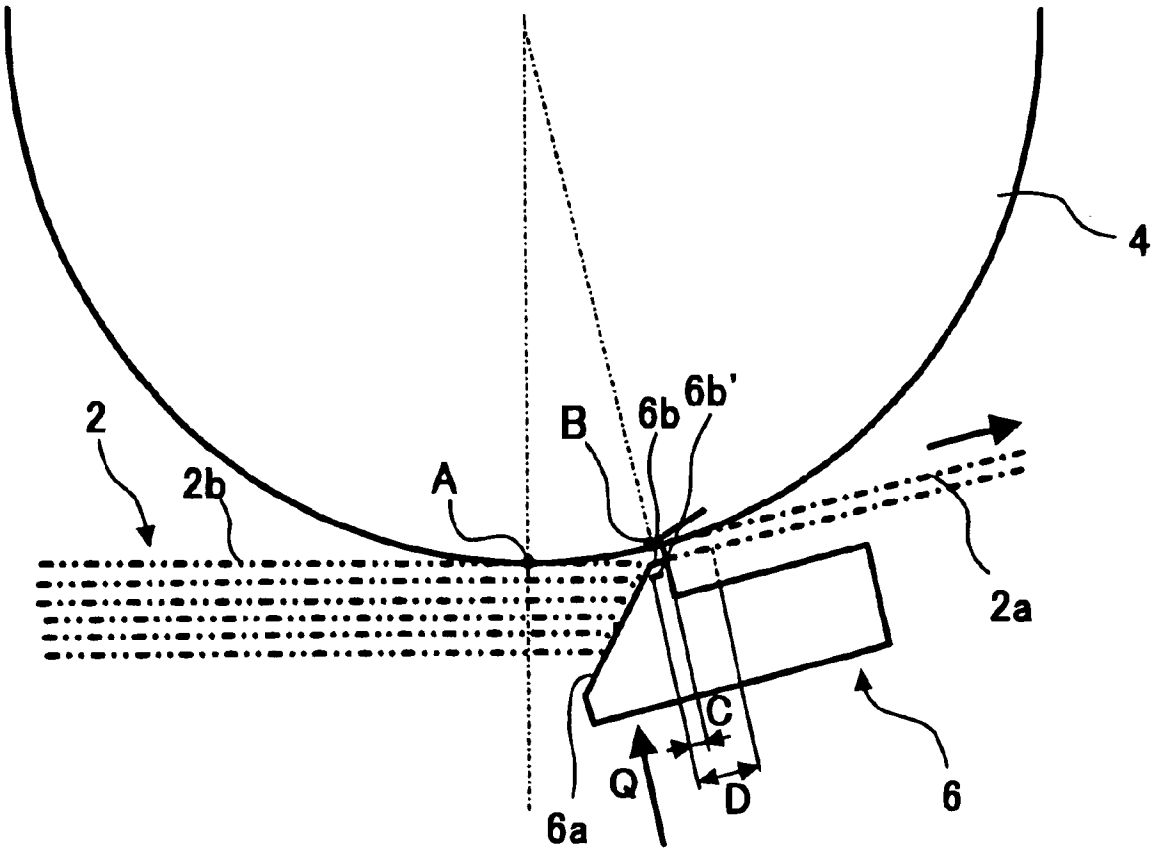
FIG. 6 is an explanatory diagram showing how a tilt member it worn.
Figure 7:
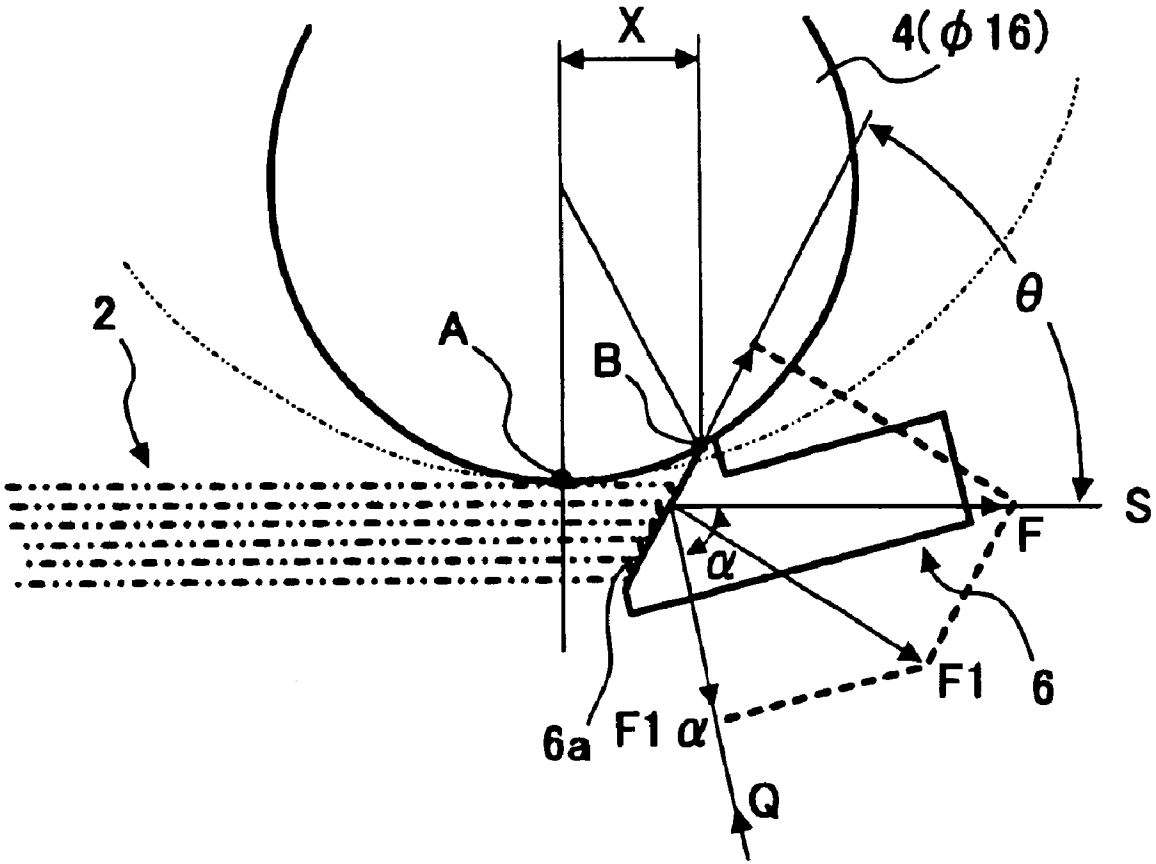
FIG. 7 is an explanatory diagram showing a relationship between a sheet feed roller and the tilt member in the first embodiment.

Even if the contact face 6*b* of the tilt member 6 with the sheet feed roller 4 is worn by abrasion with sheet materials into a worn contact face 6*b*' indicated by a broken line in FIG. 6, the tilt member 6 only moves in parallel in the direction of the separating force of the compression spring 5, so that the separating condition can be maintained without causing a change in the predetermined tilt angle θ (FIG. 3).

By reducing the contact face 6*b* of the tilt member 6 in contact with the sheet feed roller 4, the width by which the topmost sheet material 2*a* is nipped is reduced from a conventional nipped width D to a nipped width C. Since this reduction in the nipped width results in a smaller force which is applied by the trailing edge of the topmost sheet material 2*a* to the next sheet material 2*b* to feed out the same, it is possible to prevent multiple sheet materials 2 from being fed simultaneously.

Figure 8:
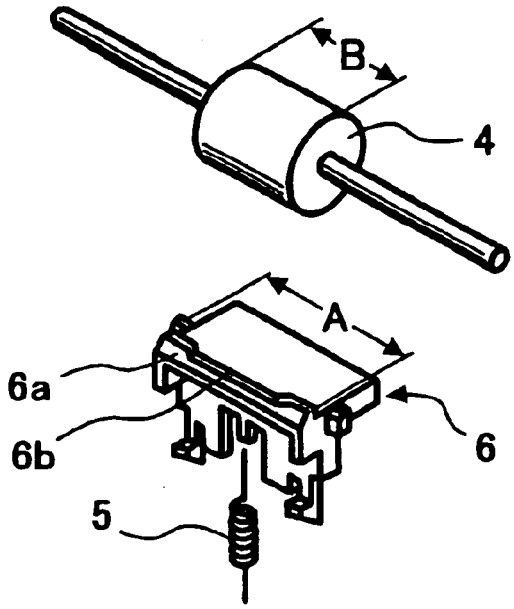
FIG. 8 is an exploded perspective view showing a relationship in length between the sheet feed roller and the tilt member.
Figure 9:
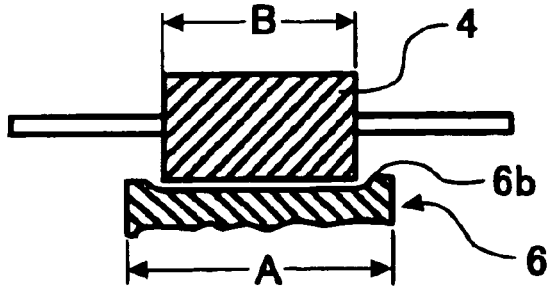
FIG. 9 is a vertical sectional view of components shown in FIG. 8.

In the sheet feeder configured as described above, since the tilt member 6 has a complicated shape, it is preferable that the tilt member 6 is integrally molded of a synthetic resin. In this event, as illustrated in FIGS. 8 and 9, if the length A of the contact face 6*b* of the tilt member 6 is larger than the length B of the sheet feed roller 4 in the axial direction, only a central portion of the contact face 6*b,* pressed by the sheet feed roller 4 through the sheet material, is worn and eventually recessed. This is because the central portion of the contact face 6*b* is in sliding contact with the sheet material, and applied with a separating force when the sheet material is conveyed.

Such deformation of the tilt member 6 can cause a sheet material to be fed along the deformed contact face 6*b* when introduced between the sheet feed roller 4 and the tilt member 6. This would result in an extremely large load caused by the conveyed sheet material, and inability to curve a more rigid sheet material, thereby leading to a failure in feeding the sheet material.

Figure 10:
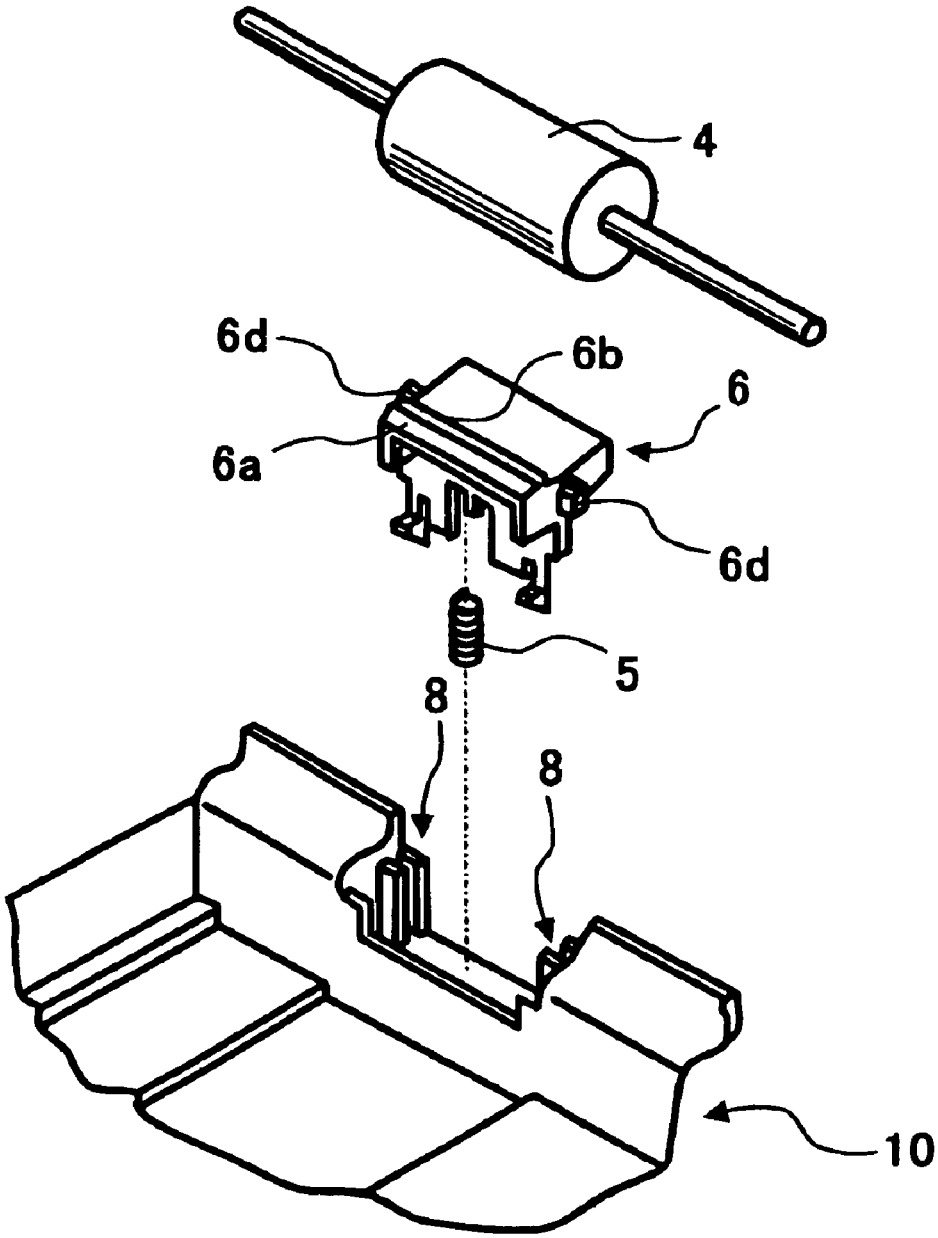
FIG. 10 is an exploded perspective view illustrating a main portion of a sheet feeder according to a second embodiment.

FIG. 10 is an exploded perspective view illustrating a main portion of a sheet feeder according to a second embodiment which solves the foregoing problem.

In second embodiment, the length of the contact face 6*b* of the tilt member 6 is made smaller than the length of the sheet feed roller 4 in the axial direction, so that the entire length of the contact face 6*b* can come in contact with the sheet feed roller 4 at all times. The rest of the configuration is similar to the aforementioned first embodiment.

According to this configuration, since the contact face 6*b* of the tilt member 6 is pressed onto the sheet feed roller 4 through a sheet material over its entire length, the contact face 6*b* is free from the formation of a partial recess, so that the contact face 6*b* will be linearly uniformly worn. Then, since the tilt member 6 translates toward the sheet feed roller 4, the tilt face 6*a* of the tilt member 6 can hold a predetermined angle to the direction in which sheet materials are fed even if the contact face 6*b* is worn.

Figure 11:
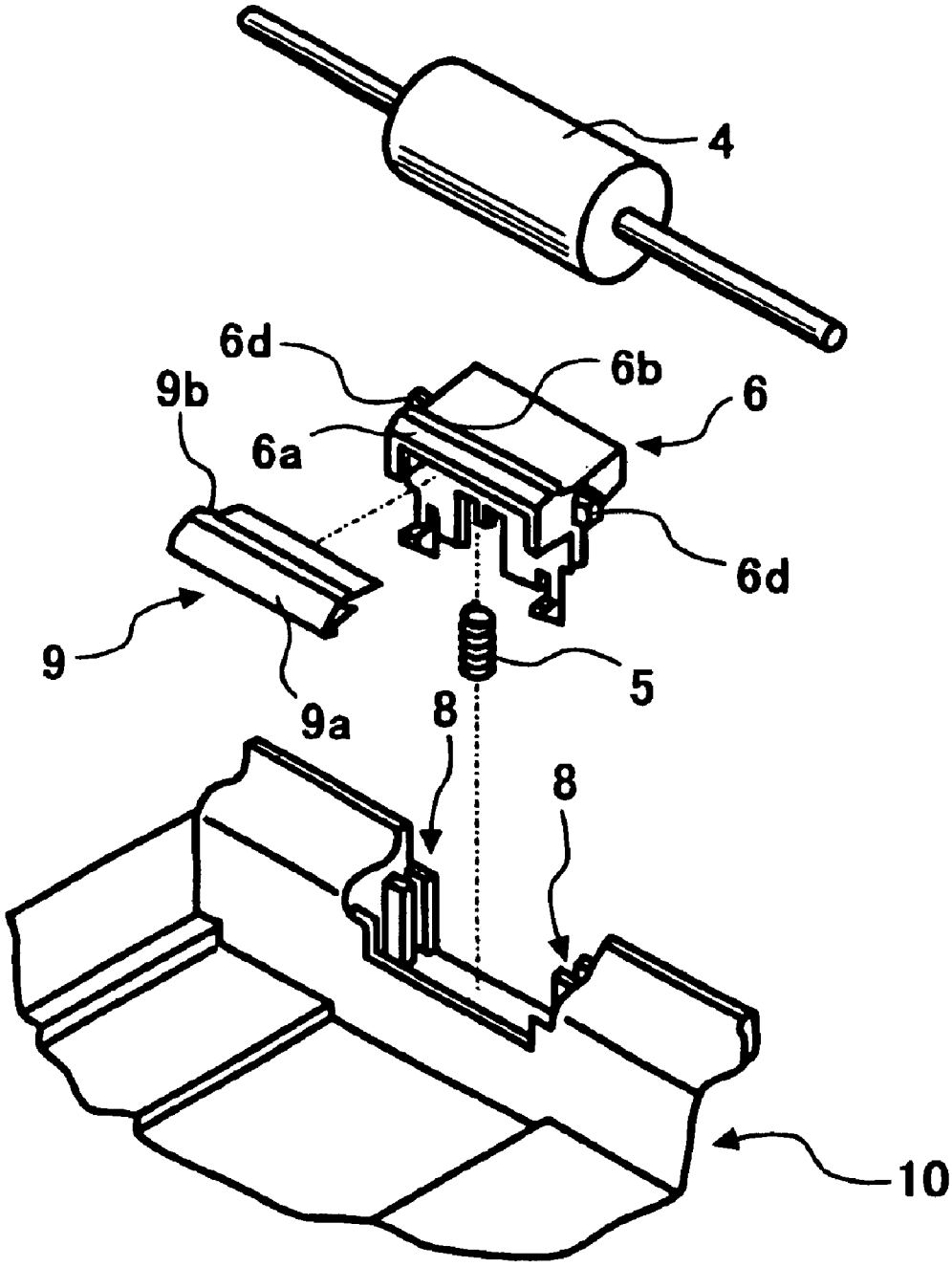
FIG. 11 is an exploded perspective view illustrating a main portion of a sheet feeder according to a third embodiment.
Figure 12:
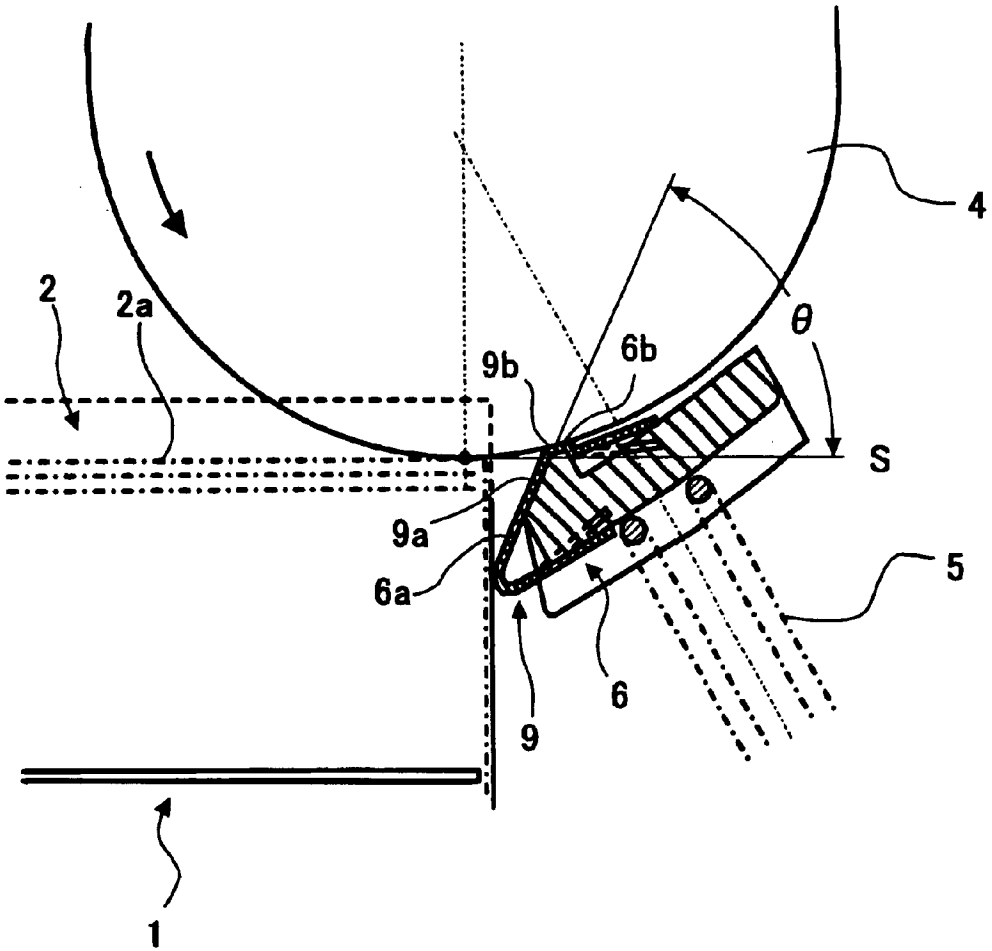
FIG. 12 is a cross-sectional view illustrating how an elastic metal plate is mounted to a tilt member in the third embodiment.

FIG. 11 is an exploded perspective view illustrating a main portion of a sheet feeder according to a third embodiment which also solves the aforementioned problem, and FIG. 12 is an enlarged vertical sectional view of the portion illustrated in FIG. 11.

In the third embodiment, a thin elastic metal plate 9 is inserted from the tilt face 6*a* of the tilt member 6. The elastic metal plate 9 is formed, by bending, with a tilt face 9*a* engaged with the tilt face 6*a* of the tilt member 6, and a contact face 9*b* engaged with the contact face 6*b,* respectively. The elastic metal plate 9 is extended from a state indicated by a virtual line in FIG. 12 against its elastic force, then contracted, and fixed.

In the third embodiment, since the tilt face 6*a* and contact face 6*b* of the tilt member 6 are covered with the elastic metal plate 9 which is in close contact thereto, it is possible to largely reduce abrasion of the tilt member 6 due to a friction with sheet material while holding the predetermined angle θ between the sheet material convey direction and the tilt face 6*a*. It should be noted that while in the foregoing embodiment the elastic metal pate 9 covers the tilt face 6*a* as well, for convenience in assembly, this is not essential.

Also, in the third embodiment, since the tilt member 6 is protected from abrasion, the length of the contact face 6*b* can be freely set irrespective of the length of the sheet feed roller 4 in the axial direction.

From the results of repetitive experiments with particular implementations, it has been found that in the foregoing embodiments, conditions for satisfactorily separating the sheet materials 2 include the distance X in the sheet material conveying direction between a press contact site A of the sheet material and a press contact site B of the tilt member 6, which should preferably be set in a range of 2 to 6 mm, and the angle θ of the tilt face 6*a* of the tilt member 6 to the sheet material feeding direction S, which should preferably be set in a range of 50° to 70°. In this way, it has been confirmed that the sheet materials are satisfactorily separated at all times as long as the sheet feed roller 4 has a normally used diameter, for example, in a range of 16 to 36 mm.

Further, in the foregoing embodiments, the metal plate for covering the contact face 6*b* of the tilt member 6 is not limited to an elastic metal plate, but may be an inelastic metal plate, in which case a metal plate 9' (see FIG. 13) which has a portion for covering the contact face 6*b* may be removably fixed by screwing from the lower face of the tilt member 6.

As described above, since abrasion is virtually negligible between the sheet feed roller 4 and the tilt member 6 having the contact face 6*b* covered with the elastic metal plate 9 or the metal plate 9', the tilt member 6 need not translate. Alternatively, as illustrated in a fourth embodiment in FIG. 13, the tilt member 6 may be pivoted by shafts 6*e* and shaft holes 10*a* of the feeder body 10. A separating compression spring for urging the tilt member 6 with a suitable force toward the sheet feed roller 4 may be a torsion spring 15.

Figure 13:
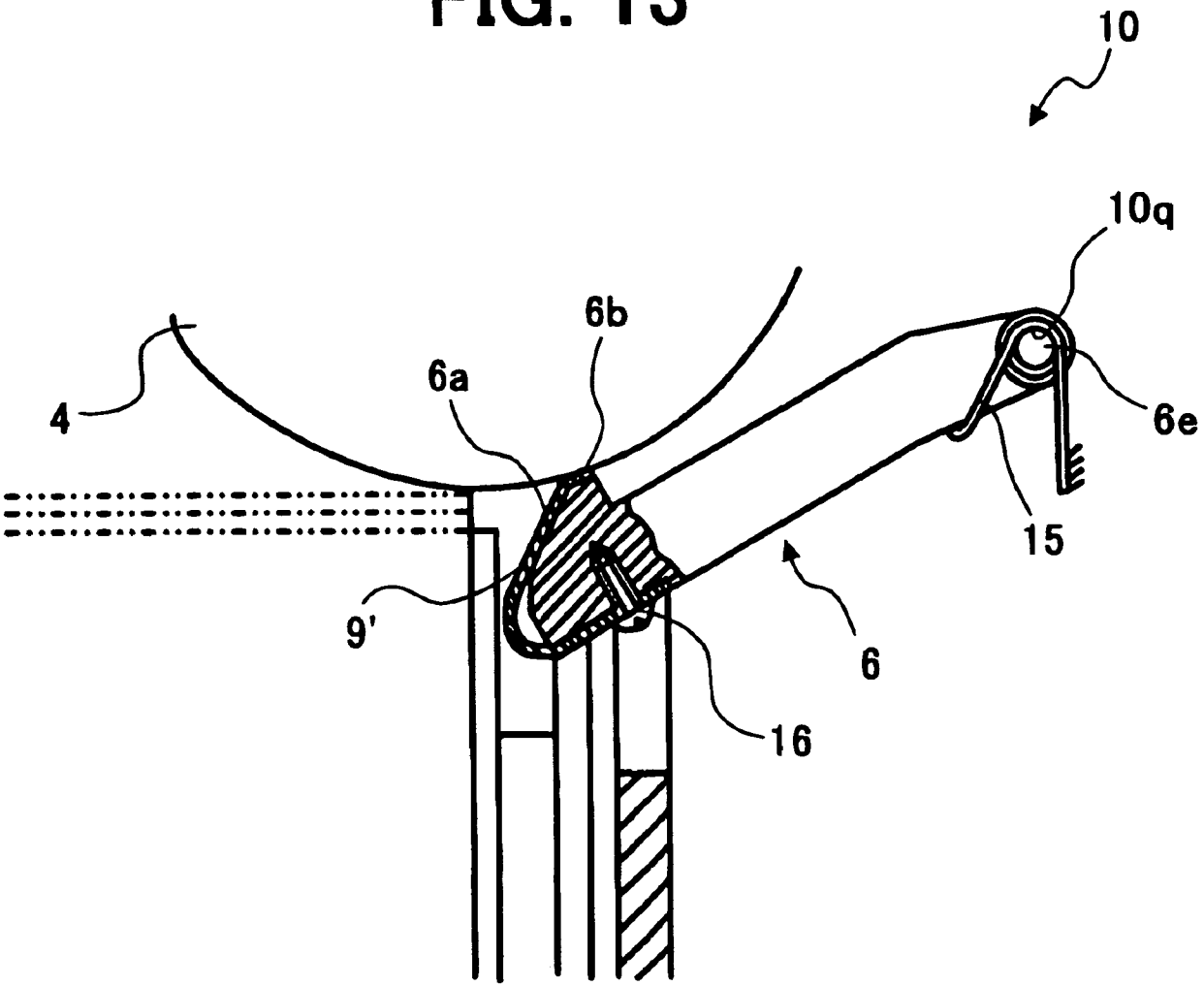
FIG. 13 is a vertical sectional view illustrating a main portion of a sheet feeder according to a fourth embodiment.

The third and fourth embodiments illustrated in FIGS. 11 through 13 have a metal plate for covering the tilt member made of a synthetic resin which is relatively susceptible to abrasion, but the tilt member itself may be formed of a hard synthetic resin reinforced, for example, by carbon fiber or glass fiber, with the contact face plated with a thick metal.

In the foregoing first through fourth embodiments, the tilt member is specified in shape and structure to prevent multiple sheet feeding and failure in feeding a sheet material. If two sheet materials go beyond the contact between the sheet feed roller and the tilt member, no loading member is provided downstream for stopping the second sheet material, so that the two sheets are likely to be fed into the image forming section.

Figure 14:
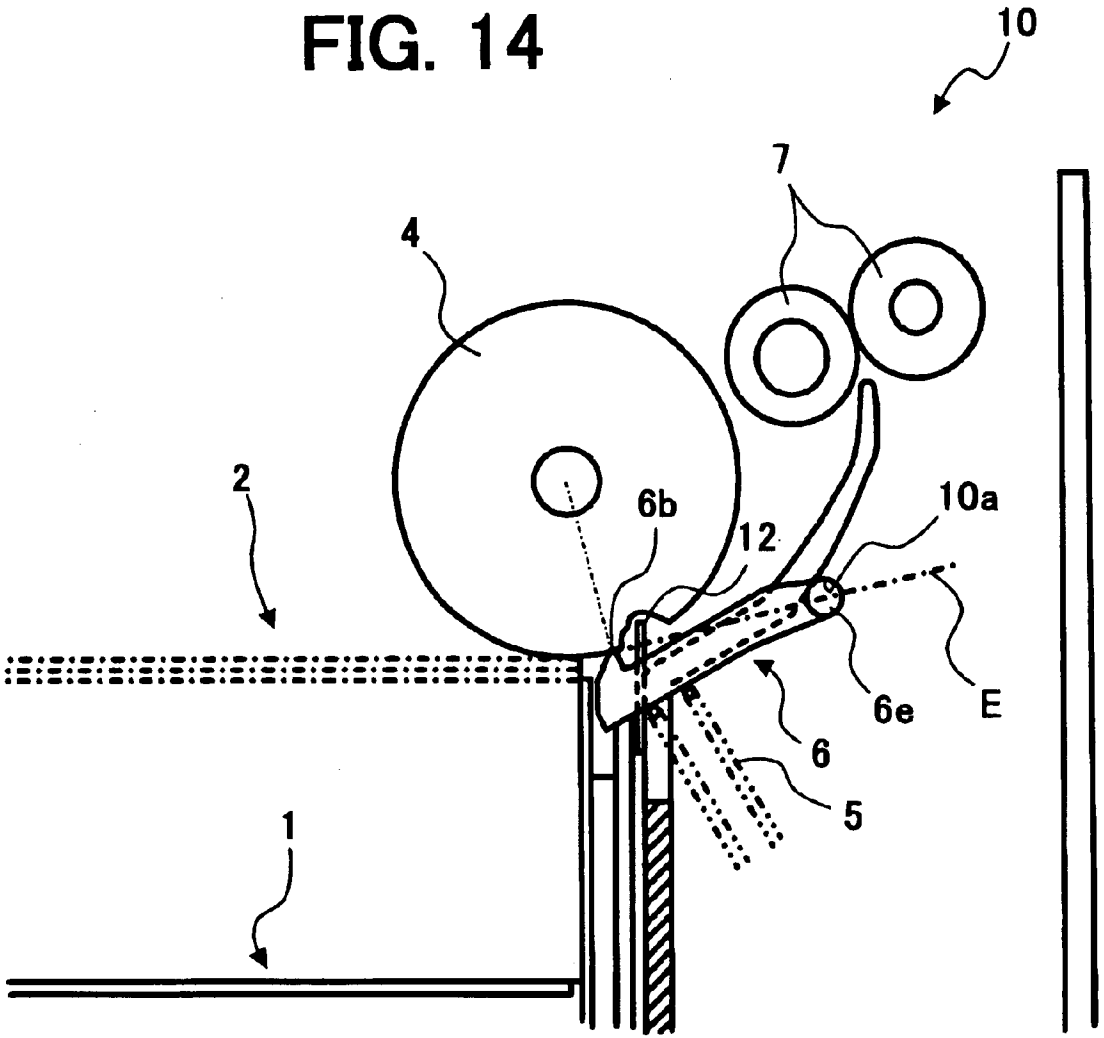
FIG. 14 is a vertical sectional view illustrating a main portion of a sheet feeder according to a fifth embodiment.
Figure 15:
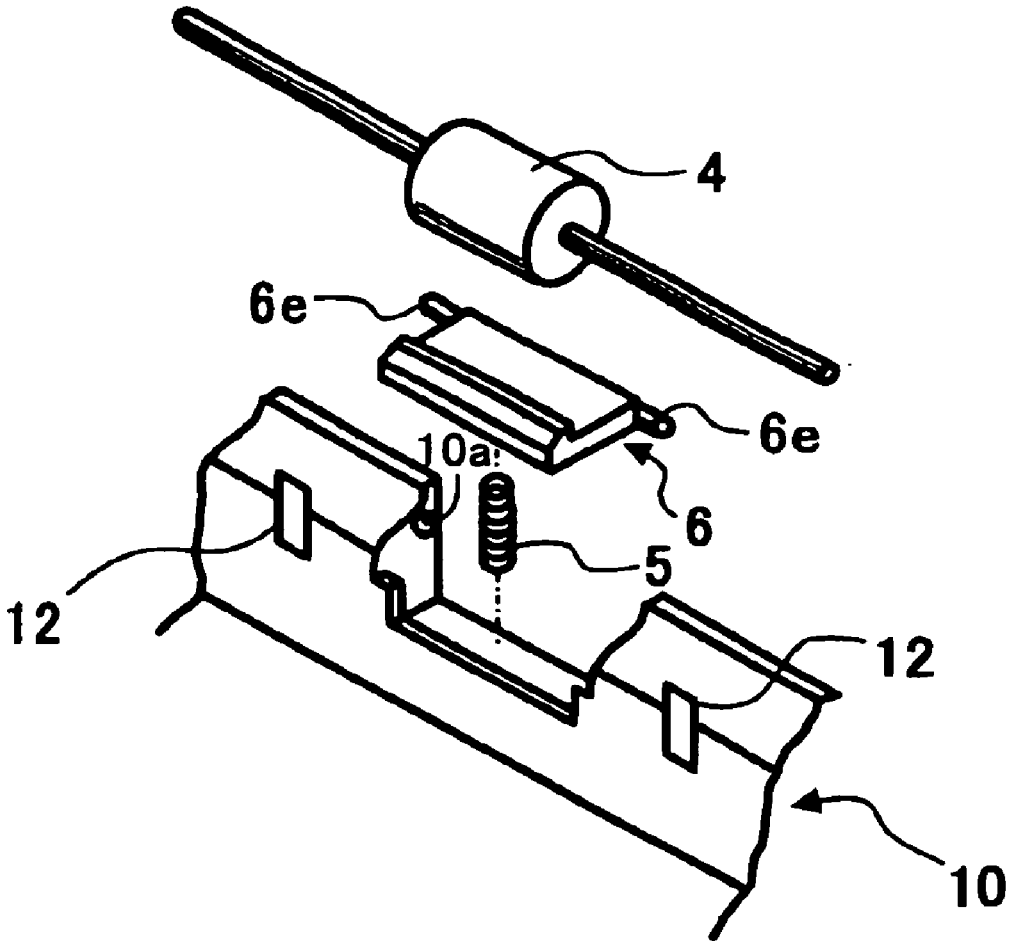
FIG. 15 is an exploded perspective view of the portion illustrated in FIG. 14.

FIG. 14 is a vertical sectional view illustrating a main portion of a sheet feeder according to a fifth embodiment which solves the foregoing problem, and FIG. 15 is an exploded perspective view of the portion illustrated in FIG. 14. It should be noted that in the subsequent embodiments, though not expressly illustrated for simplifying the illustration of the structure, the tilt member 6 is covered with the elastic metal plate 9 or the metal plate 9', or the tilt member 6 itself is made of an abrasion resisting material, and the tilt member 6 is pivotally supported by the shafts 6*e*. However, it goes without saying that the tilt member 6 may be structured to translate.

Referring specifically to FIGS. 14 and 15, the tilt member 6 is pivotally supported by a pair of shafts 6*e* and shaft holes 10*a* of the feeder body 10 (only one each is shown in FIGS. 14, 15), and the shafts 6*e* are positioned on a tangential line E of the sheet feed roller 4 on the contact face 6*b*. Also, a pair of thin elastic members (hereinafter called the "mylar") 12 have their bases secured on the inner face of a back wall of the feeder body 10, and their leading ends crossed with the tangential line E of the sheet fed roller 4. While the thin elastic members are preferably formed of a synthetic resin, they may be formed of metal plates.

With the foregoing structure, when two sheet materials are conveyed beyond the contact face 6*b* of the tilt member 6, the second sheet material is blocked at two locations at which the leading ends of the mylars 12 are positioned, by a load of the second sheet material applied to the leading ends of the mylars to press and bow the same, so that the first sheet material alone is fed, thereby preventing multiple sheet feeding.

Figure 16:
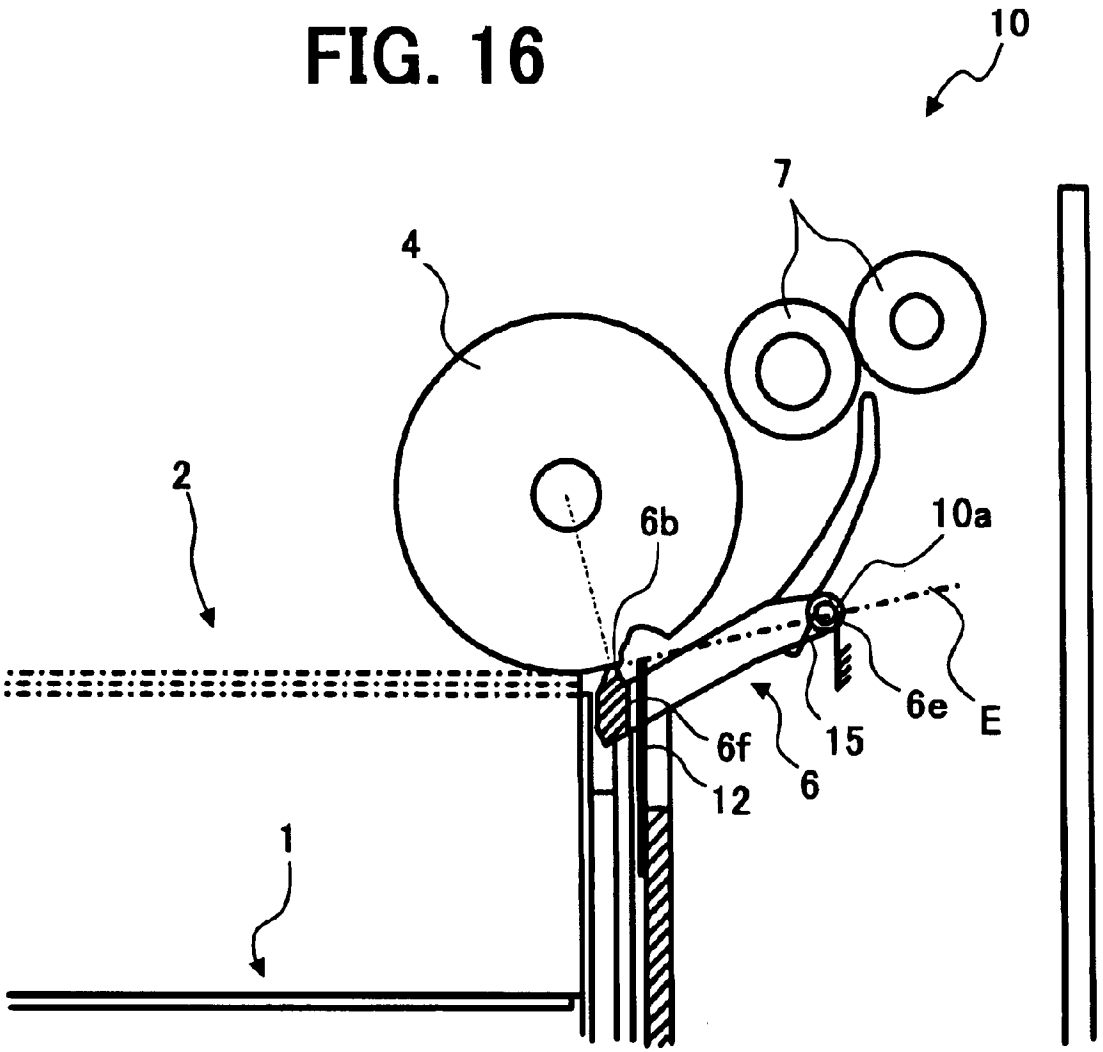
FIG. 16 is a vertical sectional view illustrating a main portion of a sheet feeder according to a sixth embodiment of the present invention.
Figure 17:
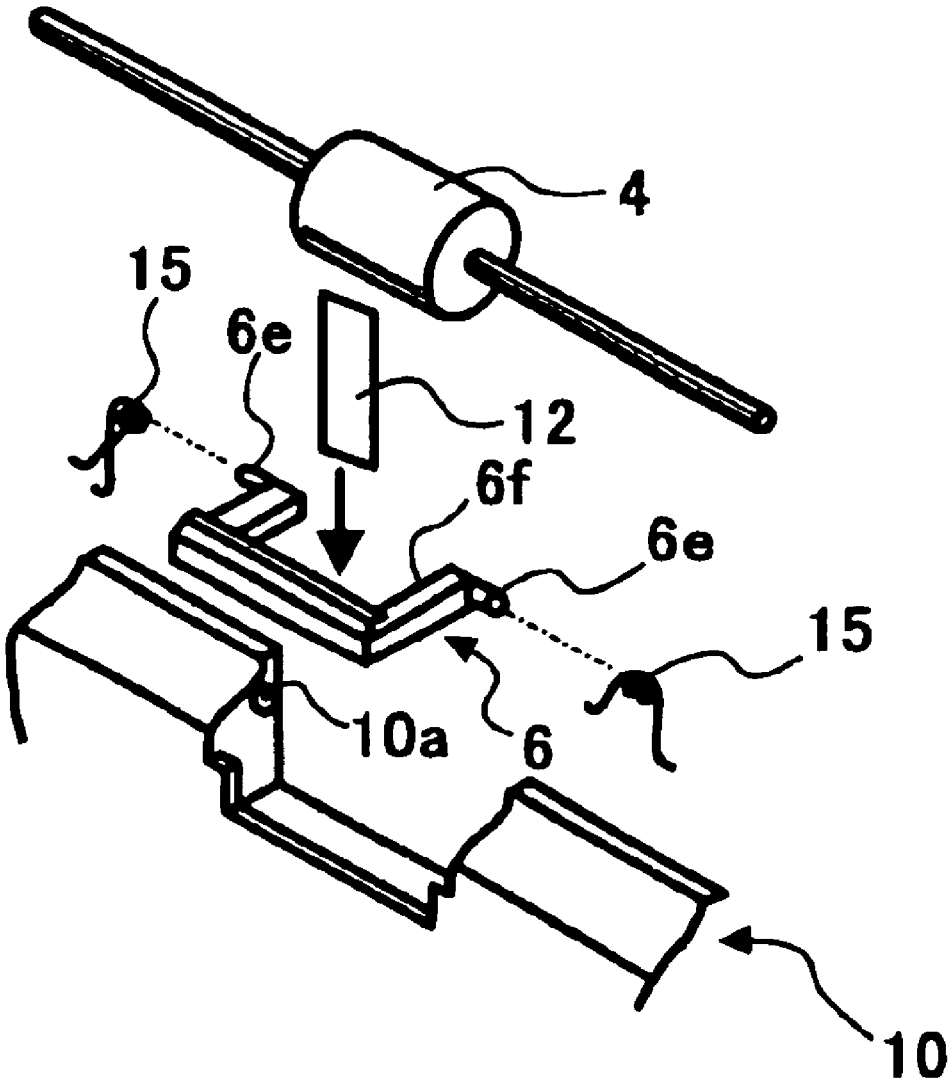
FIG. 17 is an exploded perspective view of the portion illustrated in FIG. 16.

In the foregoing embodiment, the second sheet material is blocked by the load of the second sheet material applied to the leading ends of the mylars 12 to bow the same against their elasticity, so that the load for pressing the leading ends of the mylars 12 to bow the mylars 12 is doubled to ensure the multiple sheet feed preventing effect. If the pair of mylars 12 are positioned one after the other, or have different elasticities, the second sheet material will be awaiting in a skew state. At the time the next sheet material is fed, the skew second sheet material could be conveyed as it is. FIG. 16 is a vertical sectional view illustrating a main portion of a sheet feeder according to a sixth embodiment which takes into account this aspect, and FIG. 17 is an exploded perspective view of the portion illustrated in FIG. 16.

Specifically, the mylars 12 have their bases secured at substantially the center on the inner wall of the back face of the feeder body 10 in the axial direction of the sheet feed roller 4, and their leading ends projecting upward through opening 6*f* formed through the tilt member 6 substantially at the center thereof. The leading ends of the mylars 12 are crossed with the tangential line E. Due to the provision of the opening 6*f*, torsion springs 15 on the shafts 6*e* are used in place of coil springs as separating compression springs for bringing the leading end of the tilt member 6 in pressing contact with the sheet feed roller 4.

With the foregoing structure, even if two sheet materials pass between the sheet feed roller 4 and the contact face 6*b* of the tilt member 6, the two sheet materials come in contact with the mylars 12 and are blocked thereby, so that they are prevented from being fed simultaneously. In this event, since the mylars 12 block the leading edge of the second sheet material substantially at the center thereof, the second sheet material can be substantially prevented from skewing.

Figure 18:
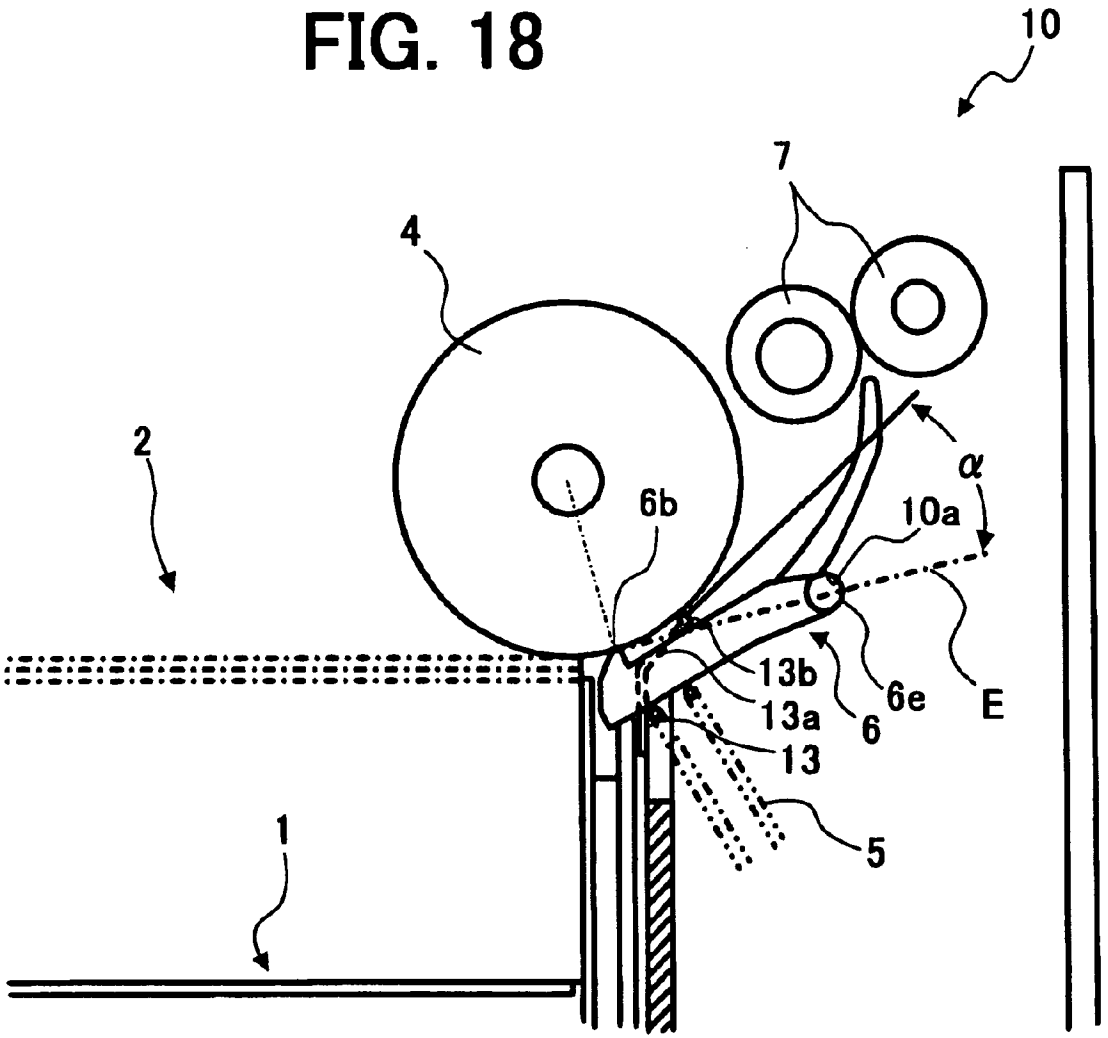
FIG. 18 is a vertical sectional view illustrating a main portion of a sheet feeder according to a seventh embodiment.
Figure 19:
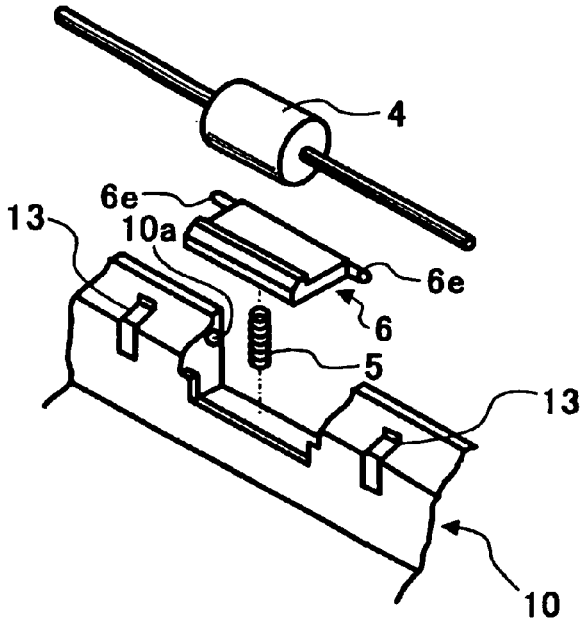
FIG. 19 is an exploded perspective view of the portion illustrated in FIG. 18.

Next, FIGS. 18 and 19 illustrate a seventh embodiment which modifies the shape of a pair of mylars disposed downstream of the contact face 6*b* of the tilt member 6. In the seventh embodiment, a pair of mylars 13, having their bases secured on the inner face of the back wall of the feeder body 10, each include a bent at an obtuse angle in a middle portion, and a bent at an almost right angle in the leading end toward the sheet feed roller 4 to form a first bent piece 13*a* and a second small bent piece 13*b*. The first bent pieces 13*a* are crossed with the tangential line E at an angle α and placed on both sides of the sheet feed roller 4. The result of an experiment has revealed that the preferred proper angle α is in a range of 20° to 60° with respect to the tangential line E, depending on the flexural rigidity of the mylars 13. The remaining structure is similar to that in FIGS. 14 and 15.

With the foregoing structure, when two sheet materials pass between the sheet feed roller 4 and the tilt member 6, their leading edges come against the second bent pieces 13*b* of the mylars 13 to generate a convey load which separates the two sheet materials.

In this event, with thin sheet materials, the topmost or first sheet material escapes from the second bent piece 13*b* of the mylar 13, and is conveyed. With rigid thick sheet materials, the first sheet material bows the first bent piece 13*a* and is conveyed, while the second sheet material is blocked by the second bent piece 13*b*.

Figure 20:
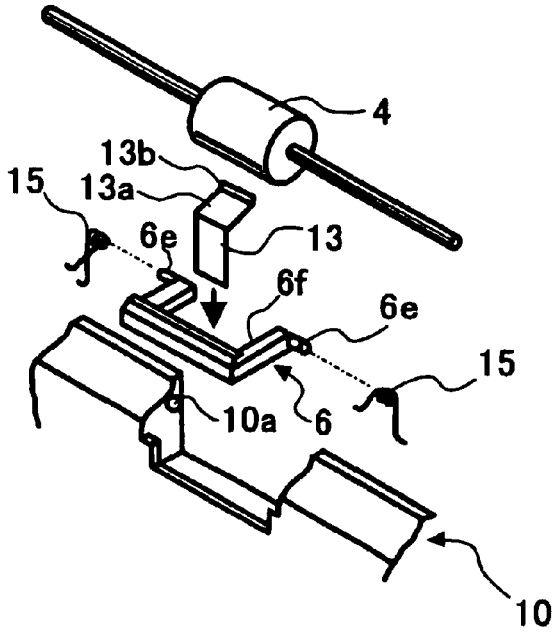
FIG. 20 is an exploded perspective view illustrating a main portion of a sheet feeder according to an eighth embodiment.

FIG. 20 is an exploded perspective view illustrating a main portion of a sheet feeder according to an eighth embodiment which comprises the mylars 13 substantially at the center of the sheet feed roller 4, and an opening 6*f* for placing the mylars 13 in a central portion of the tilt member 6 corresponding to the positions of the mylars 13. Likewise, since the tilt member 6 is formed with the opening 6*f* at its central portion, torsion springs 15 are used in place of coil springs as separating compression springs for urging the shafts 6*e*. The remaining structure is similar to that in FIGS. 18 and 19.

According to the eighth embodiment, similar to the embodiment illustrated in the aforementioned FIGS. 16 and 17, it is possible to prevent the second sheet material blocked by the mylars 13 from waiting in a skew state and being conveyed as skewed in the next sheet feeding. It should be noted that since the mylars 13 can firmly block the second sheet material with the second bent piece 13*b* at the leading end thereof, only one mylar 13 may be sufficient for the action mentioned above.

Figure 21:
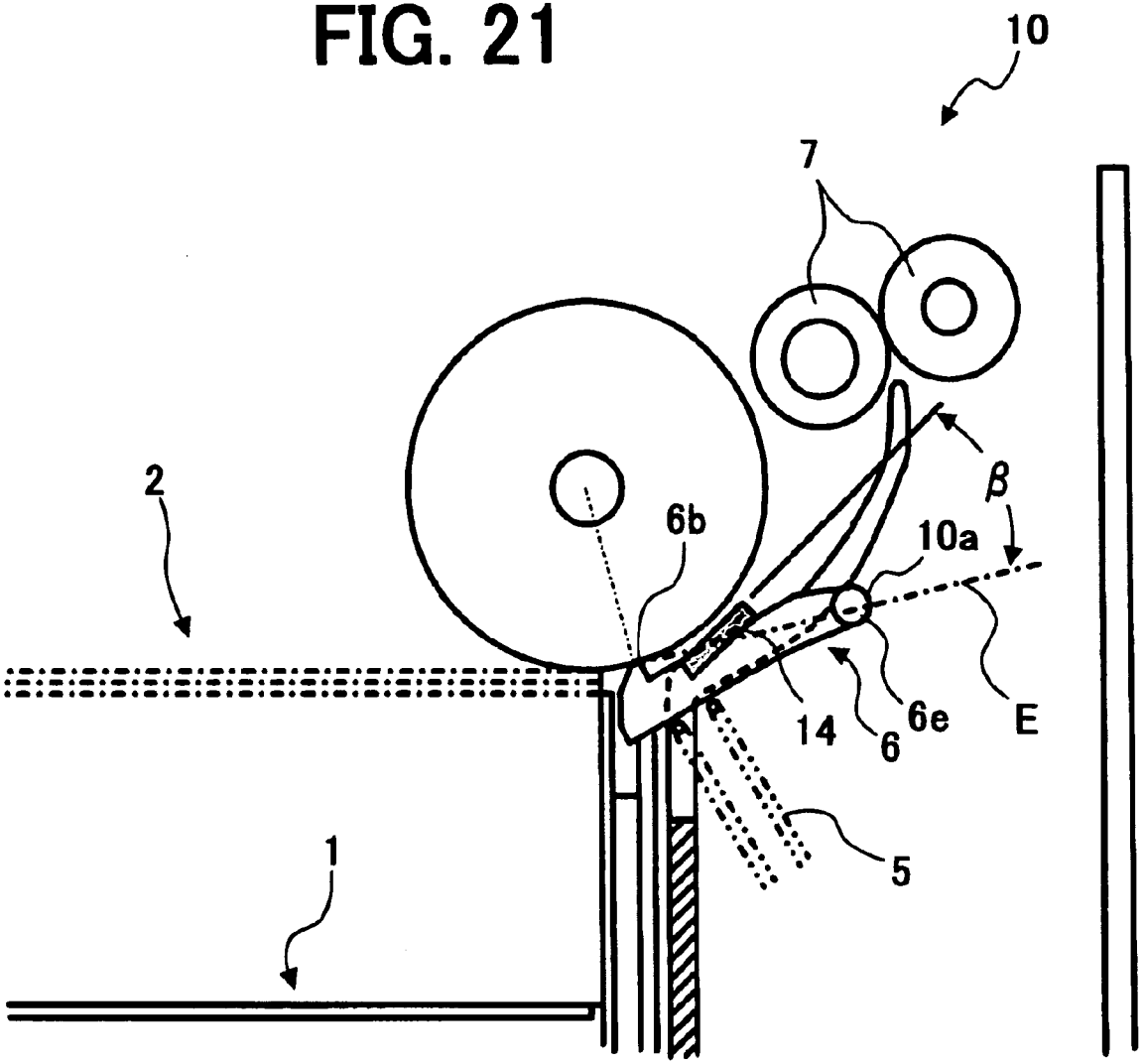
FIG. 21 is a vertical sectional view illustrating a main portion of a sheet feeder according to a ninth embodiment.
Figure 22:
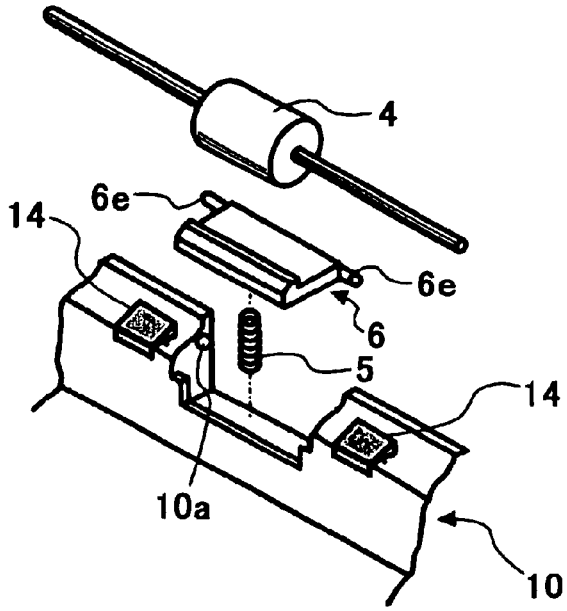
FIG. 22 is an exploded perspective view of the portion illustrated in FIG. 21.

FIGS. 21 and 22 illustrate a main portion of a sheet feeder according to a ninth embodiment which employs friction members in place of the mylars.

In the ninth embodiment, a pair of friction members 14 are disposed on a sheet material guide face of the feeder body 10 at locations downstream of the contact face 6*b* such that they cross the tangential line E at an angle β. The angle β preferably may be in a range of 20° to 30°. The remaining structure is similar to those of the fifth and seventh embodiments illustrated in FIGS. 14, 18, respectively.

According to the foregoing structure, when two sheet materials are conveyed beyond the contact face 6*b* of the tilt member 6, the leading edges of the two conveyed sheet materials run against the friction members 14 to generate a convey load which separates the second sheet material from the first sheet material. Since the ninth embodiment does not employ mylars, sound otherwise generated when the mylars are flipped can be eliminated after sheet materials are conveyed.

Figure 23:
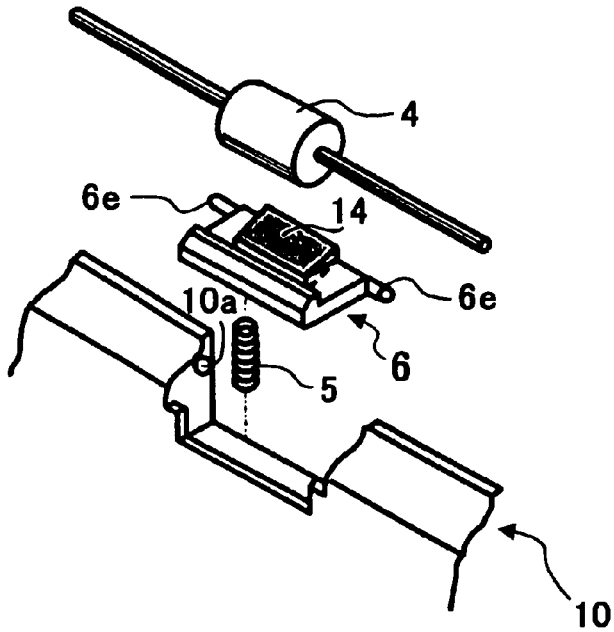
FIG. 23 is an exploded perspective view illustrating a main portion of a sheet feeder according to a tenth embodiment.

FIG. 23 illustrates a main portion of a sheet feeder according to a tenth embodiment which includes the friction members 14 downstream of the contact face 6*b* of the tilt member 6. The remaining structure is similar to that illustrated in FIGS. 21 and 22.

According to the tenth embodiment, when the pair of friction members 14 are disposed one after the other in the sheet material convey direction, or when the leading edges of two sheet materials come against the friction members 14 at different positions one after the other, the second one of the simultaneously fed sheet materials, waiting as skewed with respect to the convey direction can be avoided from being conveyed as skewed.

The friction members may be used in combination with the mylars, in which case two sheet materials which cannot be separated by the friction members or the mylars can be separated by the others, thereby making it possible to further reduce the likelihood that two sheets are conveyed together.

Figure 54:
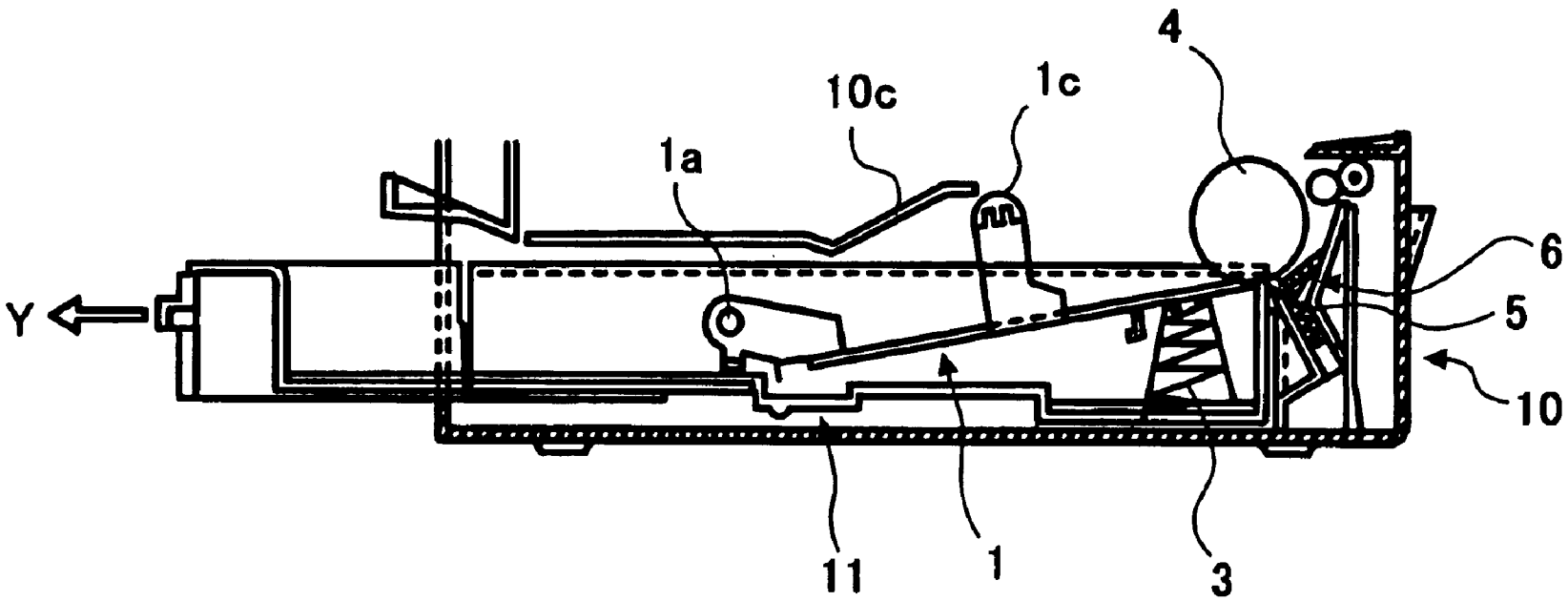
FIG. 54 PRIOR ART
FIG. 54 is a vertical sectional view illustrating an example of conventional sheet feeder.
Figure 55:
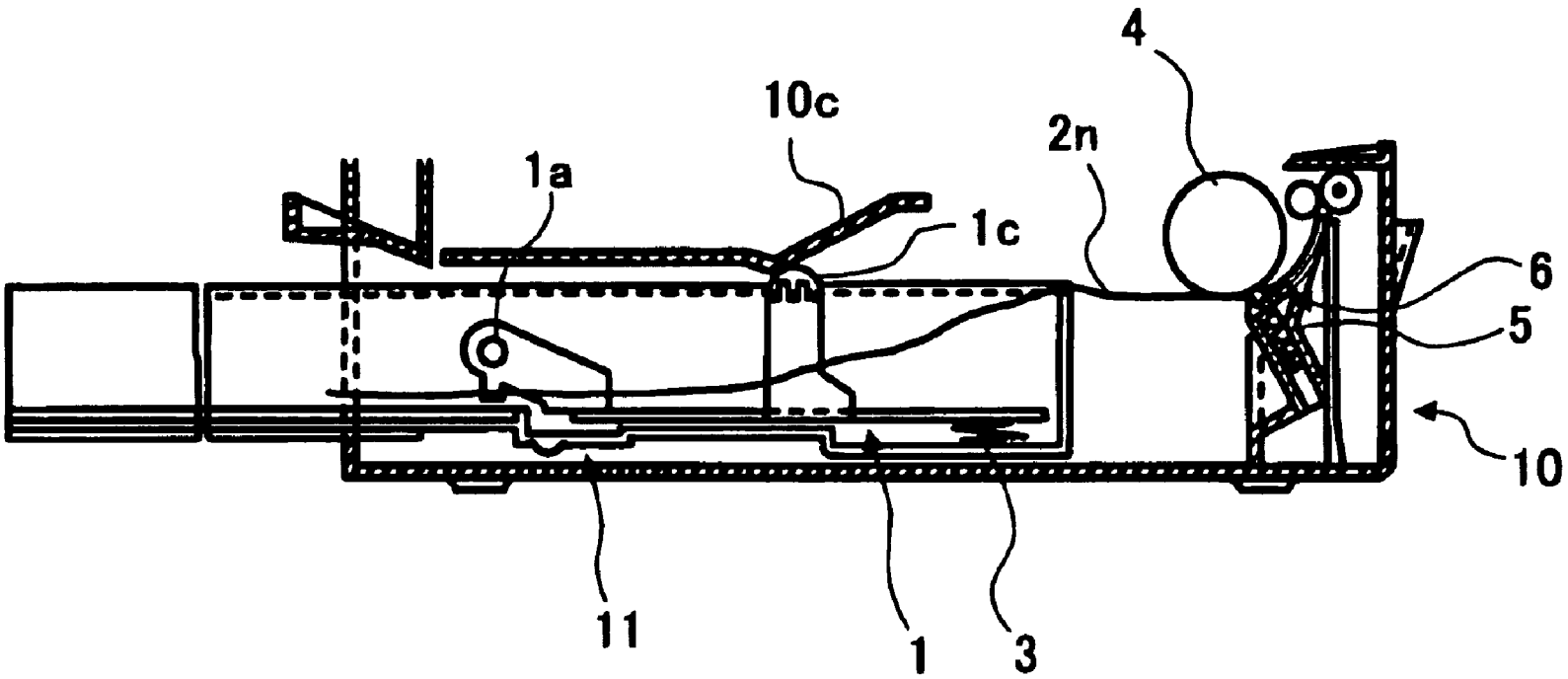
FIG. 55 PRIOR ART
FIG. 55 is an explanatory diagram illustrating how a cassette is drawn from a feeder body.

In the sheet feeder which has the sheet material separator disposed deep in the feeder body with respect to the direction in which the cassette is inserted into the sheet feeder, as in the foregoing first through tenth embodiments, if the user attempts to draw out the cassette for supplementing sheet materials therein, the bottom board may be caught by the feed body due to a sheet feeding pressure applied upward to the bottom board by the compression spring and can thus interfere with drawing out the cassette. To prevent this problem, the sheet feeder can be provided with guide rails for pushing down the bottom board as the cassette is removed, or means for releasing the sheet feeding pressure, as illustrated in FIGS. 54 and 55, resulting in an increase in the number of parts and the size of the feeder.

In such a sheet feeder, the bottom board is generally made of a metal plate, and the compression spring is also made of a metal, so that an electrical ground must be provided. Generally, for this purpose, a metal plate added to the bottom of the cassette is exposed external to the cassette for connection with grounding the feeder body. However, the metal plate for grounding may be deformed or contaminated to cause an insufficient grounding action.

Figure 27:
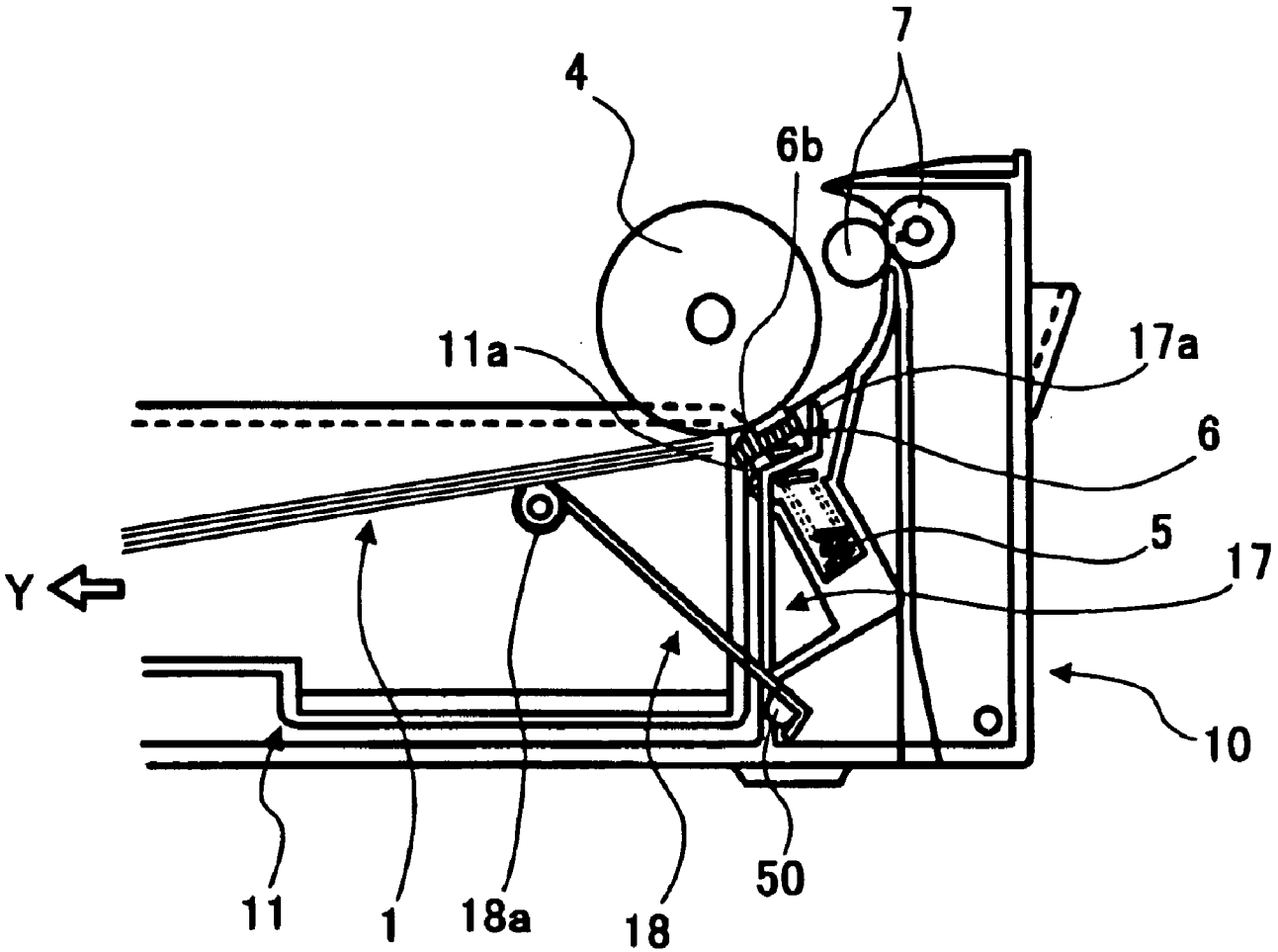
FIG. 27 is an explanatory diagram illustrating a first operation state when a cassette is removed from the feeder body in the eleventh embodiment.
Figure 28:
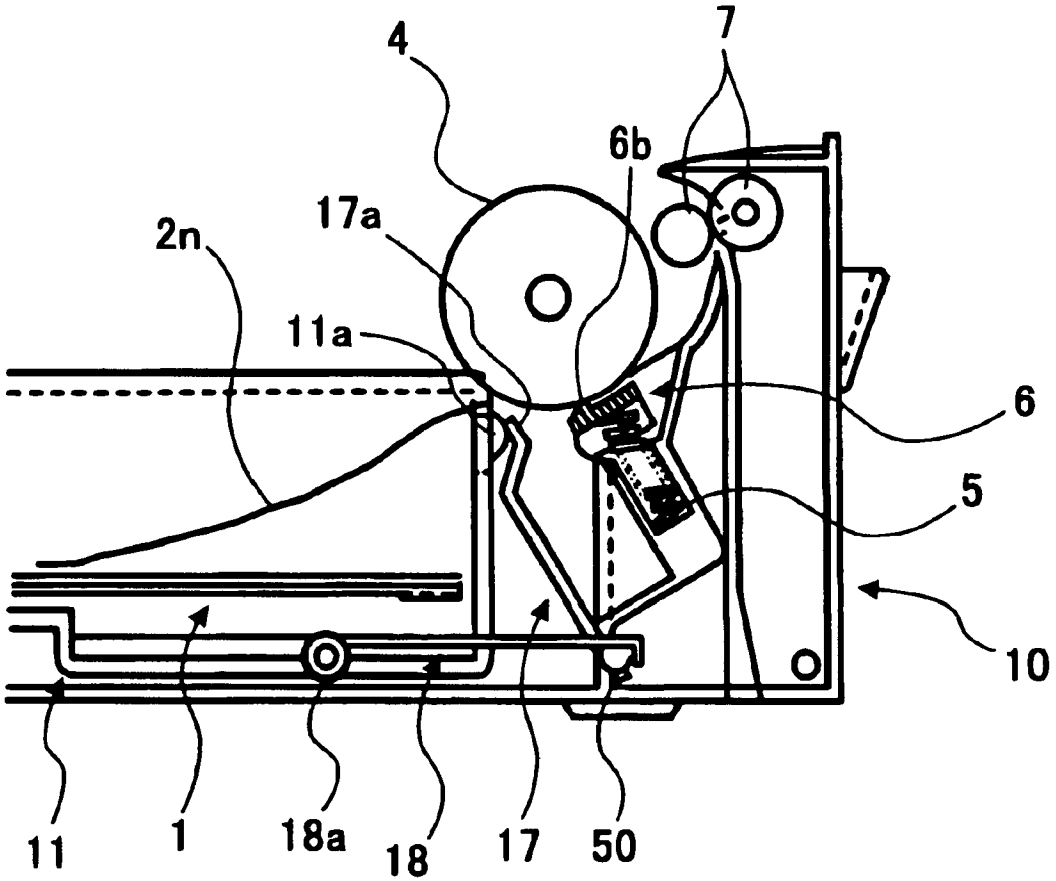
FIG. 28 is an explanatory diagram illustrating a second operation state in the removal of the cassette from the feeder body the eleventh embodiment.
Figure 29:
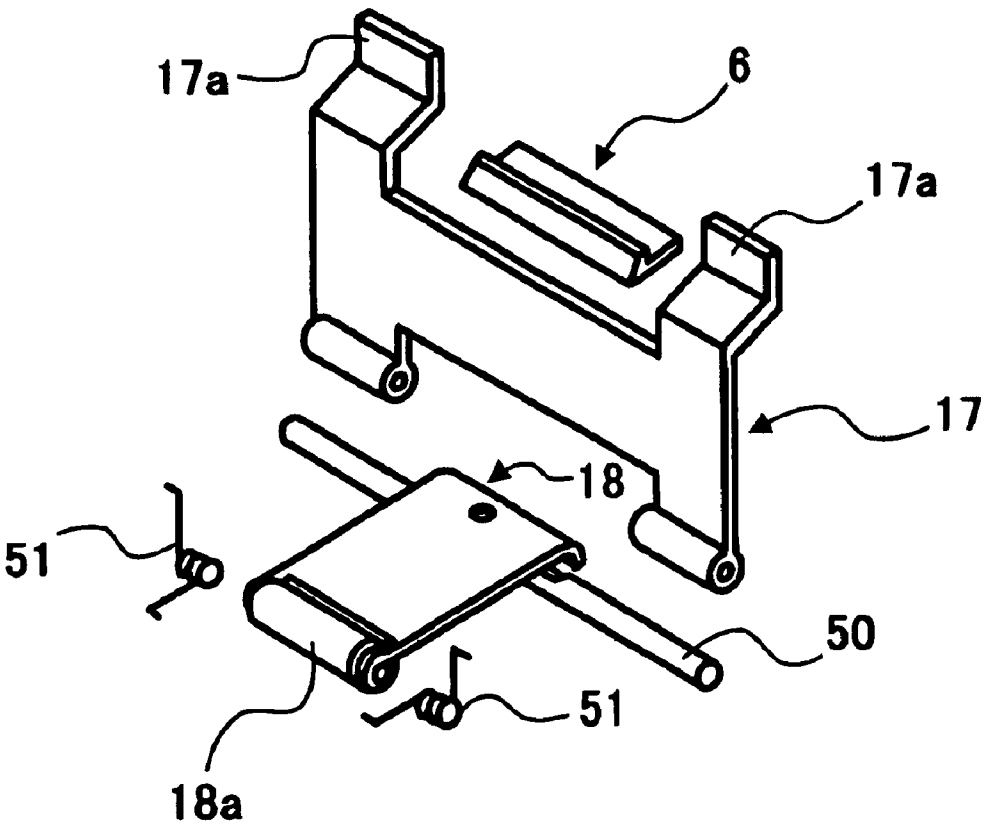
FIG. 29 is an exploded perspective view showing a relationship between a sensing lever and a pressure lever in the eleventh embodiment.
Figure 30:
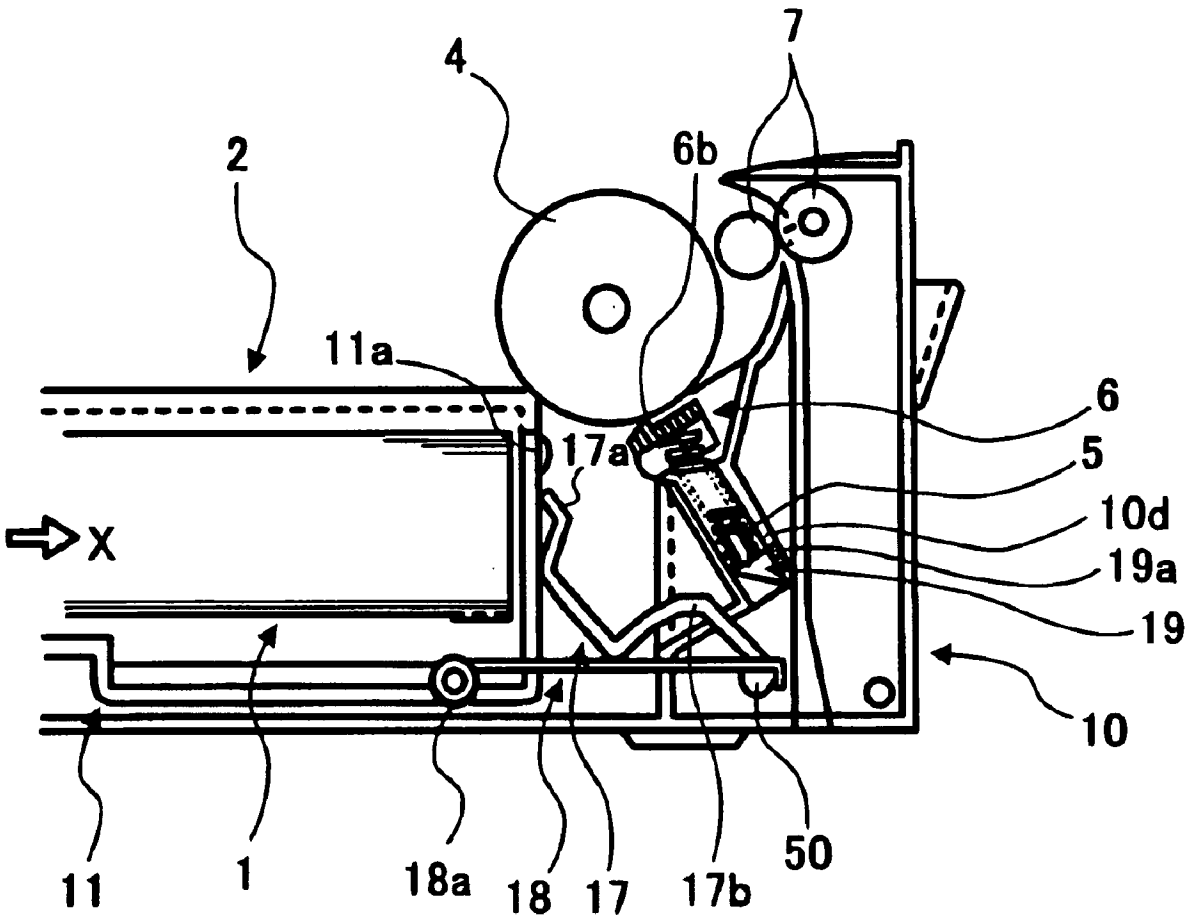
FIG. 30 is an explanatory diagram illustrating a first operation state when a cassette is inserted into the feeder body in a twelfth embodiment.
Figure 31:
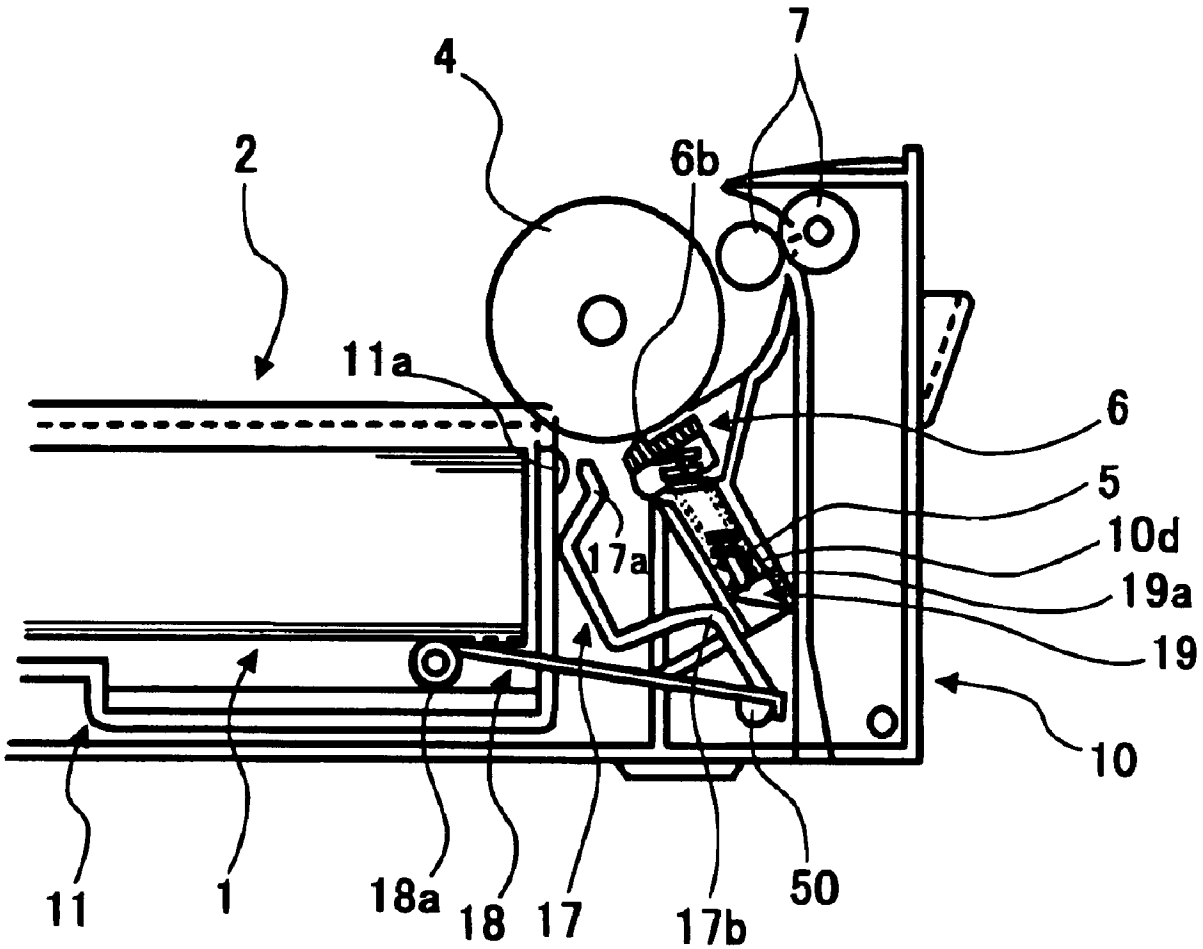
FIG. 31 is an explanatory diagram illustrating a second operation state in the insertion of the cassette into the feeder body in the twelfth embodiment.
Figure 32:
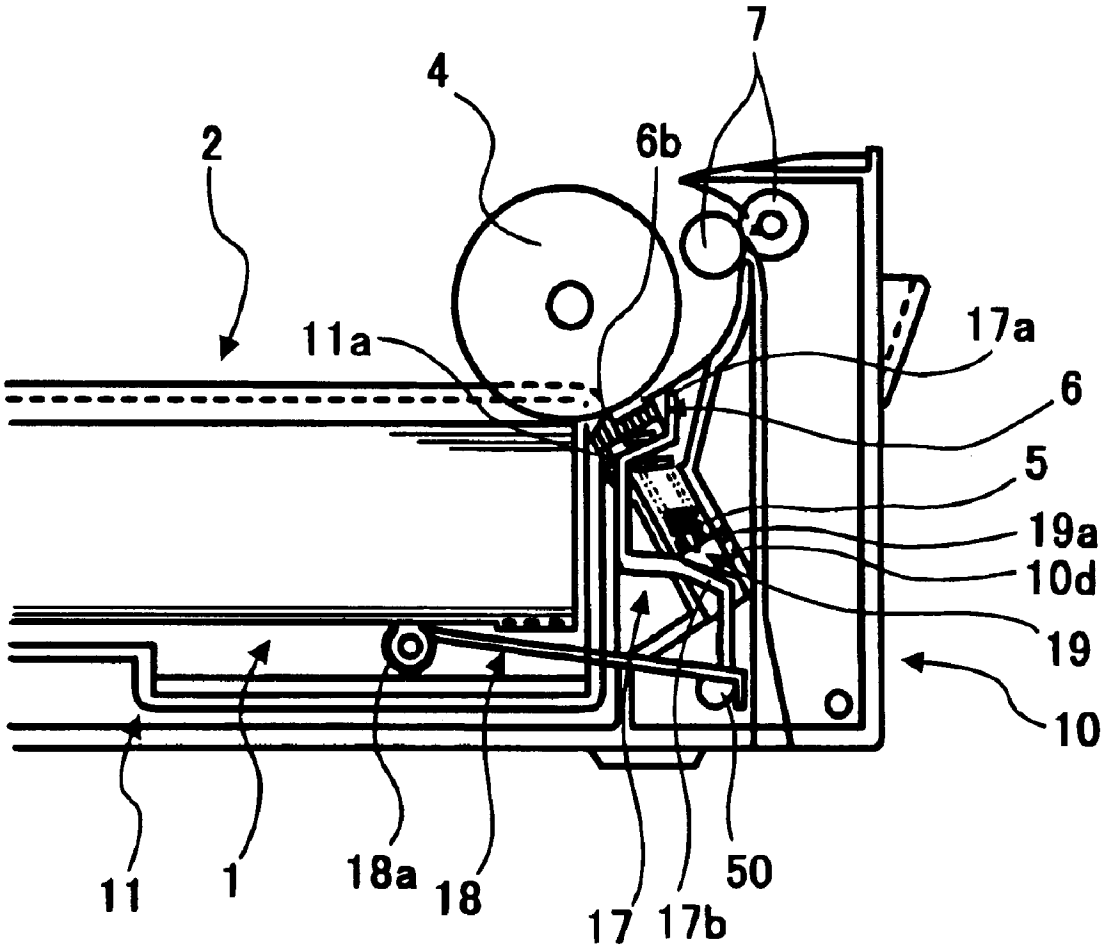
FIG. 32 is an explanatory diagram illustrating the cassette fully inserted in the feeder body in the twelfth embodiment.

FIGS. 24 through 28 are explanatory diagrams for showing the operation of the sheet feeder according to an eleventh embodiment which solves the above problem, and FIG. 29 is an exploded perspective view showing a relationship between a sensing lever for sensing insertion/removal of a cassette and a pressure lever for driving the bottom board upward.

In the eleventh embodiment, the cassette 11 is provided with a leading protrusion 11*a* at its front face, and the feeder body 10 is provided with a sensing lever 17, corresponding to the leading protrusion 11*a*, for sensing insertion/removal of the cassette 11. The base of the sensing lever 17 is attached for pivotal movements about a shaft 50. A pair of arms 17*a*, bent toward the tilt member 6, extend from both sides of a free end of the sensing lever 17. When the cassette 11 is fully inserted in the feeder body 10, the sensing lever 17 is pressed by the leading protrusion 11*a* of the cassette 11, as illustrated in FIG. 26, so that the arms 17*a* pass both sides of the contact face 6*b* of the tilt member 6 from the left to the right in FIG. 24.

A pressure lever 18 has its base secured to the longitudinal center of the shaft with a screw or the like, and a free end which supports a roller 18*a*. As the cassette 11 is inserted into the feeder body 10, the roller 18*a* is below the bottom board 1. A pair of torsion springs 51, or other elastic members, are arranged between the sensing lever 17 and the pressure lever 18 such that the torsion springs 51 apply an urging force to the pressure lever 18 when the sensing lever 17 is at a predetermined angle to the pressure lever 18 so that the roller 18*a* applies a sheet feeding pressure to the bottom board 1 in the upward direction. While the remaining structure is identical to that illustrated in FIGS. 1 and 2, the compression spring 3 illustrated in FIGS. 1 and 2 is omitted since the pressure lever 18 and torsion springs 51 for applying an upward urging force to the pressure lever 18 are included in the eleventh embodiment.

Figure 24:
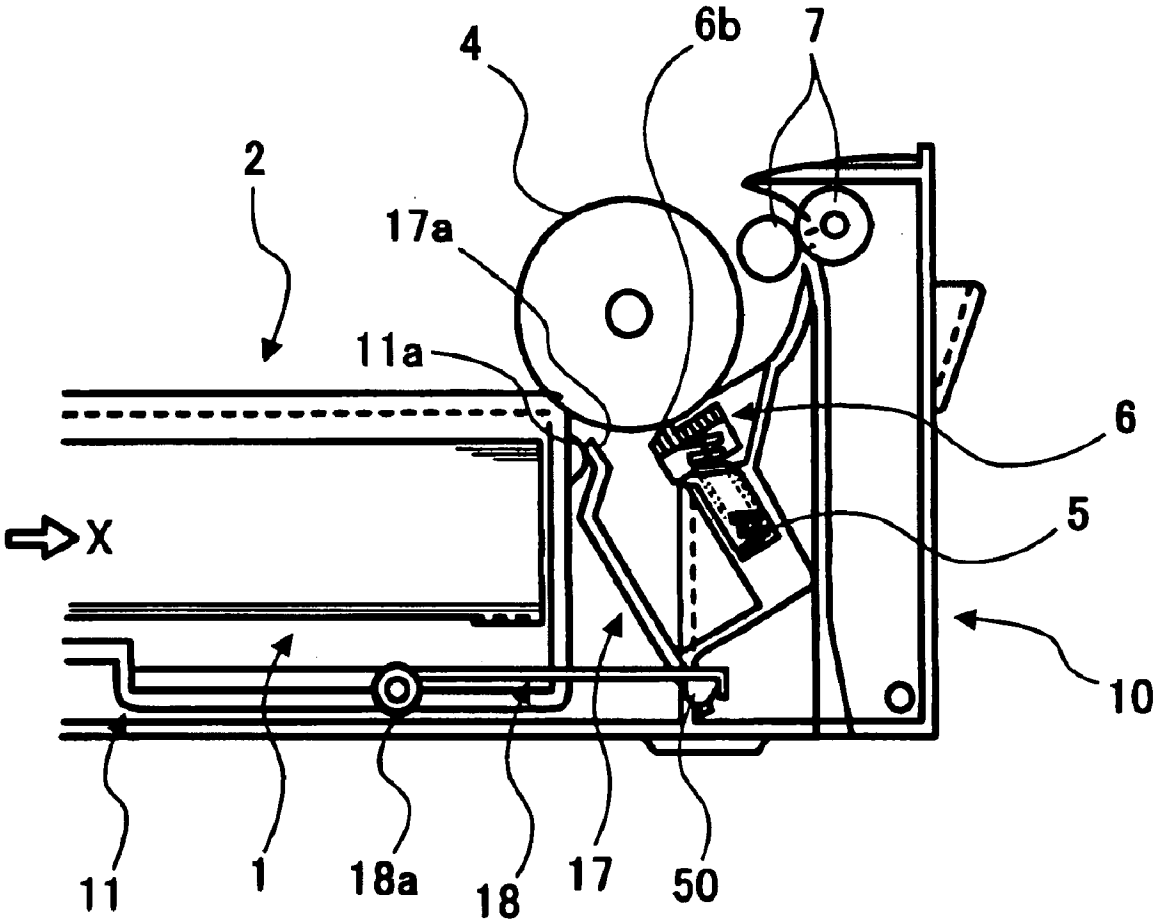
FIG. 24 is an explanatory diagram illustrating a first operation state when a cassette is inserted into a feeder body in an eleventh embodiment.
Figure 25:
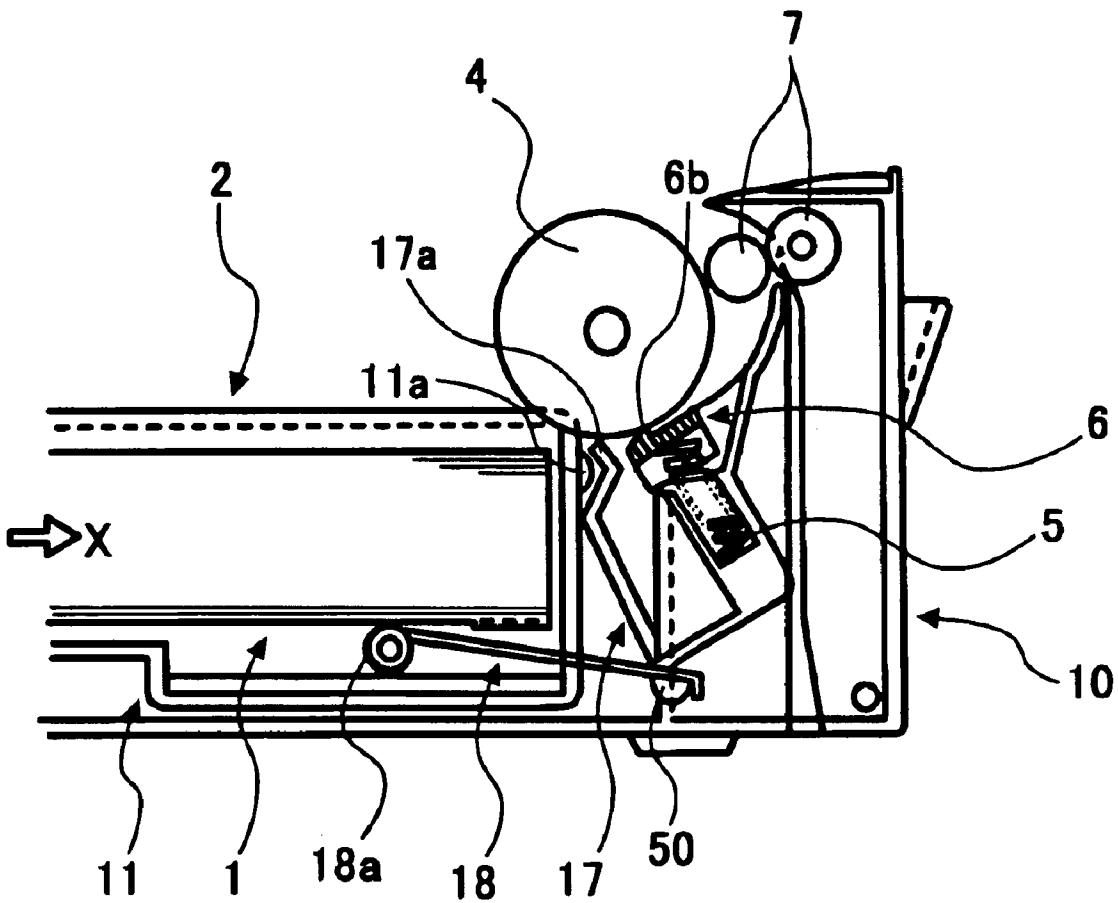
FIG. 25 is an explanatory diagram illustrating a second operation state in the insertion of the cassette into the feeder body in the eleventh embodiment.

With the foregoing structure, when a predetermined number of sheet materials 2 are loaded on the bottom board 1, the bottom board 1 is lowered by its own weight and the weight of the sheets 2 and remains in or near the horizontal state as illustrated in FIG. 24. As the cassette 11 in this state is inserted into the feeder body 10 in a direction indicated by an arrow X, the leading protrusion 11*a* of the cassette 11 presses the free end of the sensing lever 17 to cause a pivotal movement of the sensing lever 17 about the shaft 50 in the clockwise direction. As the sensing lever 17 pivotally moves to a position indicated in FIG. 25 and is positioned at a predetermined angle to the pressure lever 18, the torsion springs 51 begin applying urging forces to cause a pivotal movement of the pressure lever 18 in the clockwise direction to bring the roller 18*a* into contact with the bottom surface of the bottom board 1.

Figure 26:
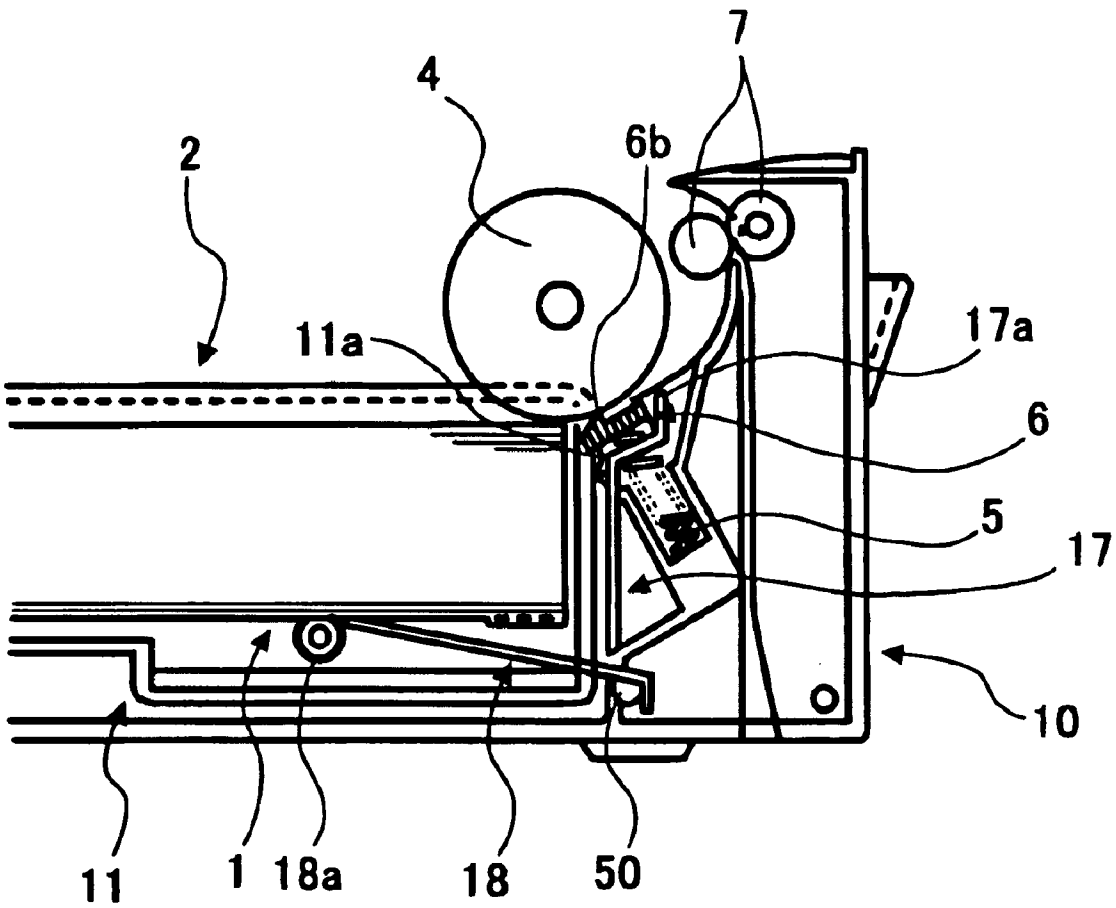
FIG. 26 is an explanatory diagram illustrating the cassette fully inserted in the feeder body in the eleventh embodiment.

As the cassette 11 has been fully inserted into the feeder body 10 as illustrated in FIG. 26, the urging forces of the torsion springs 51 increase to generate a required sheet feeding pressure. Simultaneously, a reference boss, not shown, of the cassette 11 is fitted into a reference groove on the feeder body 10 by a known cassette holding means which holds the cassette 11 at an inserting position indicated in FIG. 26.

In this state, as a sequence of image formation is advanced so that the number of sheet materials 2 on the bottom board 1 is reduced as illustrated in FIG. 27, the cassette stopping means is released to draw out the cassette 11 in a direction indicated by an arrow Y for supplementing sheet materials. Consequently, the sensing lever 17 is released from the leading protrusion 11*a,* and is inclined in the counter-clockwise direction by urging forces of the torsion springs 51. The urging forces acting on the pressure lever 18 by the torsion springs 51 are removed and pivotally moves by its weight in the counter-clockwise direction, and the bottom board 1 also falls by its weight as illustrated in FIG. 28.

In this event, a sheet material 2*n* left in front of the nip between the sheet feed roller 4 and the tilt member 6 is raked out by the arms 17*a* of the sensing lever 17, carried on the cassette 11, and removed from the feeder body 10 together with the cassette 11, so that the sheet material 2*n* will not remain in the feeder body 10.

Since the pressure body 18 itself is formed of a metal plate, electrical ground need not be provided separately, as would be required in the conventional cassette. A secure connection with the feeder body 10 for grounding is inherently provided in this structure.

In the eleventh embodiment, the leading edge of the next sheet material is nipped between the sheet feed roller 4 and the tilt member 6 when the cassette 11 is removed. When the sheet material is raked out by the arms 17*a* of the sensing lever 17 on both sides of the tilt member 6, the sheet material could be torn, depending on the material, and remain within the feeder body 10.

Figure 34:
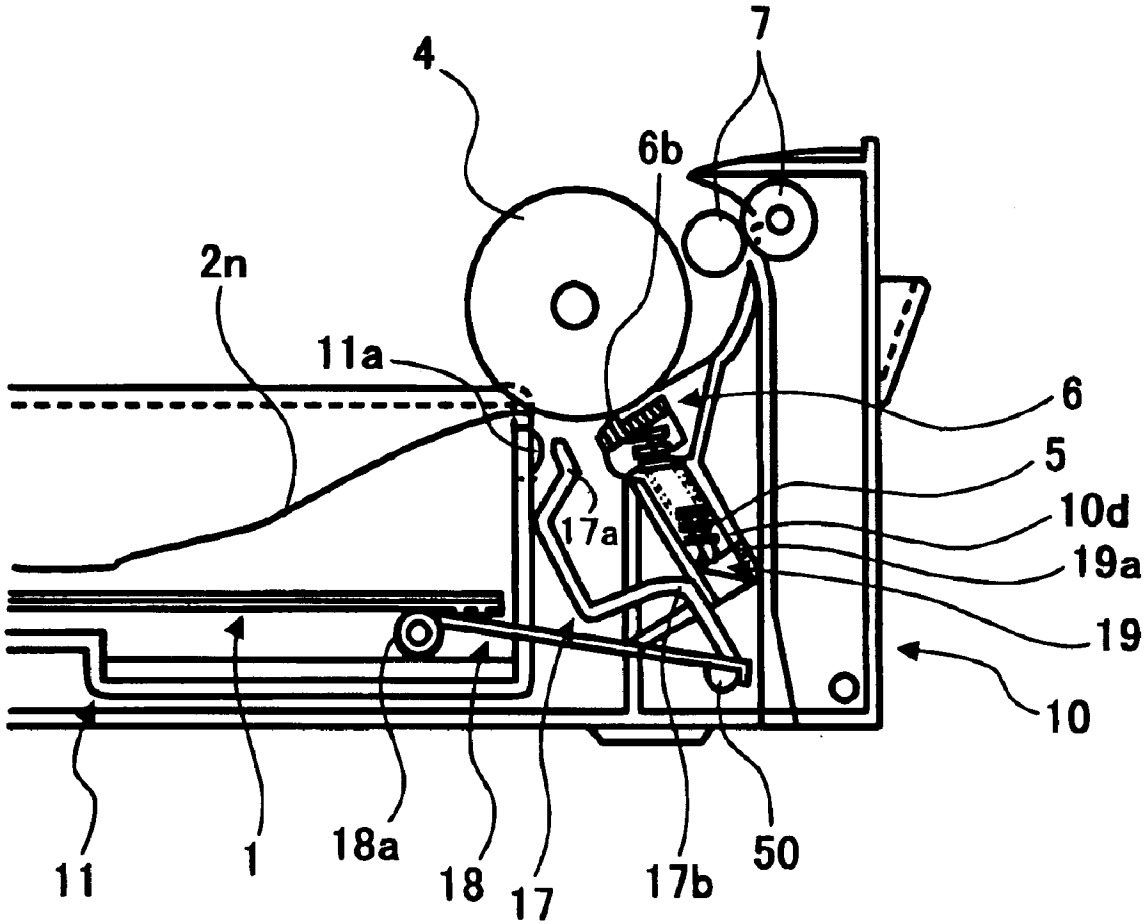
FIG. 34 is an explanatory diagram illustrating a second operation state in the removal of the cassette from the feeder body in the twelfth embodiment.
Figure 35:
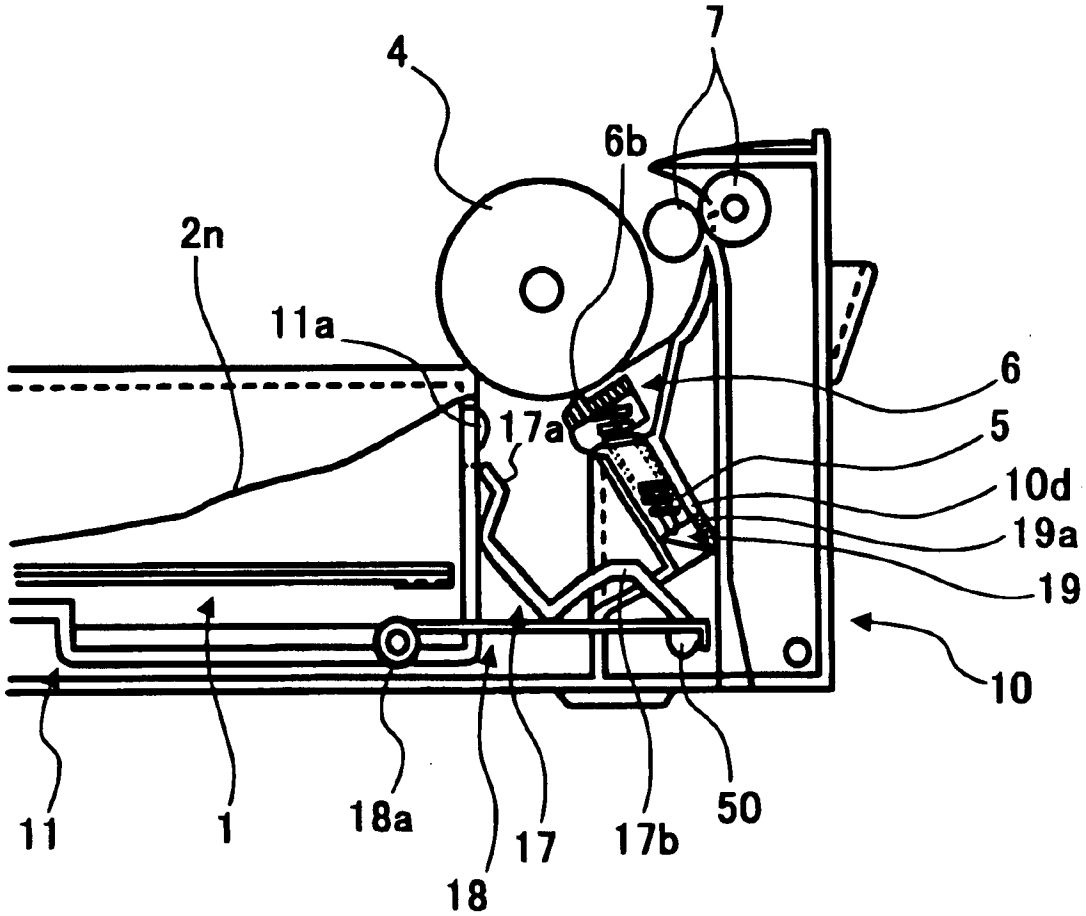
FIG. 35 is an explanatory diagram illustrating a third operation state in the removal of the cassette from the feeder body in the twelfth embodiment.
Figure 36:
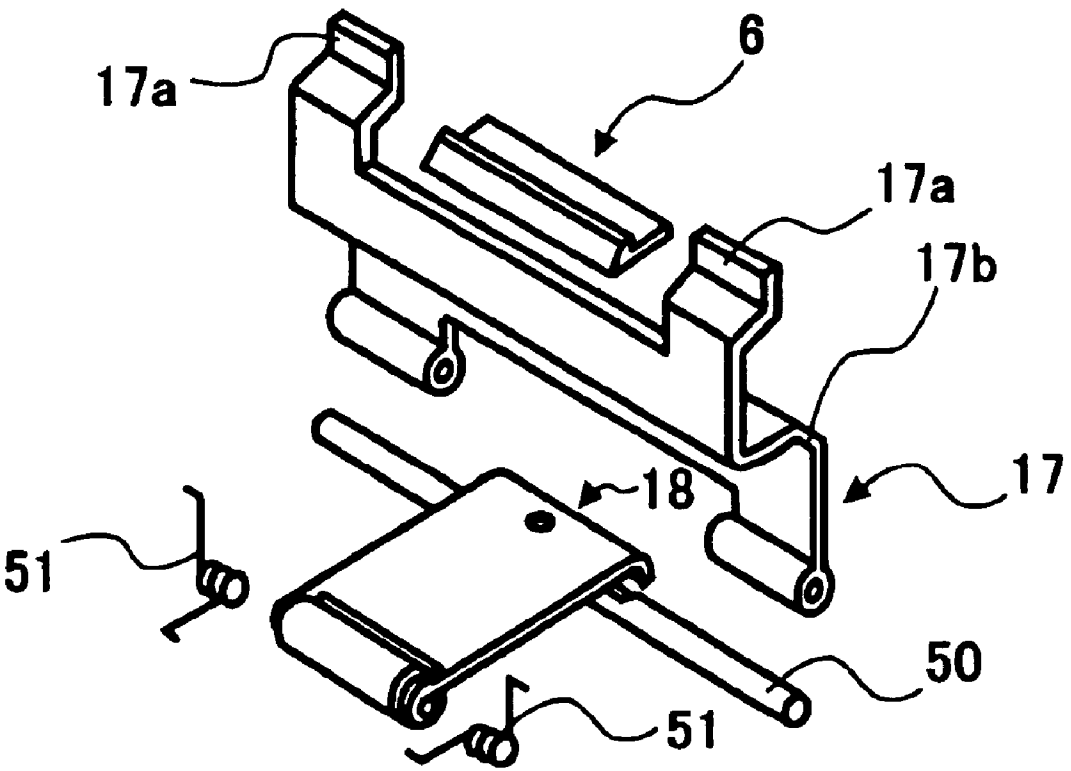
FIG. 36 is an exploded perspective view showing a relationship between a sensing lever and a pressure lever in the twelfth embodiment.

FIGS. 30 through 35 are cross-sectional views each illustrating the operation of a main portion of a sheet feeder according to a twelfth embodiment which solves the above problem, and FIG. 36 is an exploded perspective view showing a relationship between the sensing lever for sensing insertion/removal of the cassette and the pressure lever for driving the bottom board upward.

In the twelfth embodiment, a spring bearer 19 is mounted to a lower portion of a compression spring 5 slidably in the axial direction of the compression spring 5 by a guide pin 19*a* and a guide groove 10*d*. The compression spring 5 applies the tilt member 6 with a separating pressure. A shaft 50 common to the sensing lever 17 and the pressure lever 18 is moved to the right in the figure as compared with the eleventh embodiment. The sensing lever 17 includes a bent 17*b* near the shaft 50. The bent 17*b* can be brought into contact with and separated from a slope of the spring bearer 19, so that the bent 17*b* comprises a spring pressure changing means for the compression spring 5. The remaining structure is similar to the eleventh embodiment illustrated in FIGS. 24 through 29.

In the twelfth embodiment, as the cassette 11 having sheet materials 2 loaded on the bottom board 1 is being inserted into the feeder body 10 in a direction indicated by an arrow X (see FIG. 30), the bent 17*b* of the sensing lever 17 is spaced apart from the slope of the spring bearer 19, so that the spring bearer 19 does not maintain the compression spring 5 in a non-compressed state, and the contact face 6*b* of the tilt member 6 is slightly spaced apart from the sheet feed roller 4.

When the cassette 11 is further inserted into the feeder body (see FIG. 31), the sensing lever 17, pressed by the front face of the cassette 11, pivotally moves in the clockwise direction. The torsion springs 51 shown in FIG. 36 act to pivotally move the pressure lever 18, causing the roller 18*a* to come in contact with the bottom face of the bottom board 1. In this state, the bent 17*b* of the sensing lever 17 is still held spaced from the slope of the spring bearer 19.

When the cassette 11 has been fully inserted into the feeder body, the sensing lever 17 further pivotally moves in the clockwise direction, causing the bent 17 to slide on the slope of the spring bearer 19 to push the spring bearer 19 upward. As the urging force of the compression spring 5 increases, the contact face 6*b* of the tilt member 6 is brought into pressing contact with the sheet feed roller 4 to generate a separation pressure. In this state, similar to the eleventh embodiment, the arms 17*a* of the sensing lever 17 are held at positions after they have passed both sides of the contact face 6*b* of the tilt member 6.

Figure 33:
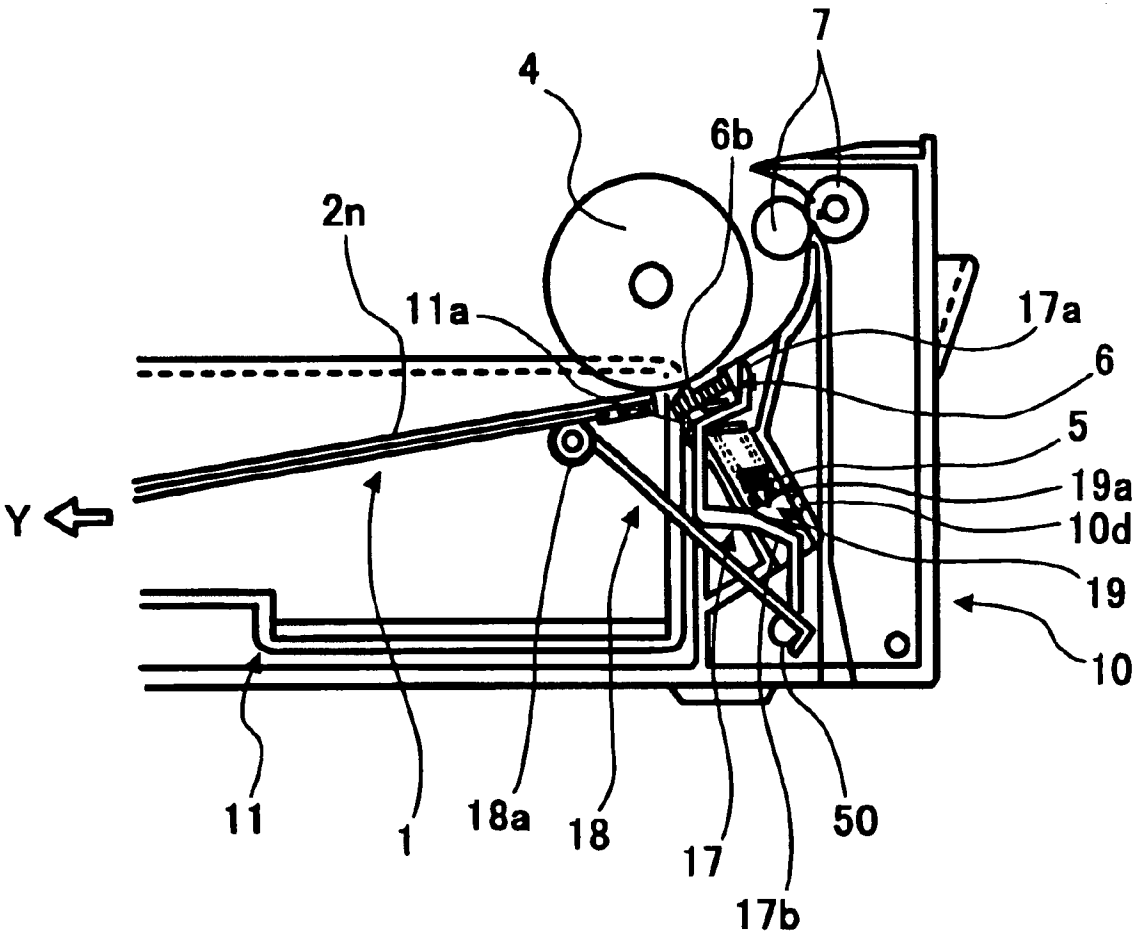
FIG. 33 is an explanatory diagram illustrating a first operation state when a cassette is removing from the feeder body in the twelfth embodiment.

As the sheet materials 2 on the bottom board 1 has decreased as illustrated in FIG. 33, the cassette 11 is drawn out in a direction indicated by an arrow Y for supplementing sheet materials, releasing the sensing lever 17 from the constraint by the cassette 11, with the urging forces of the torsion springs 51 acting on the sensing lever 17 which is inclined in the counter-clockwise direction. This causes the bent 17*b* to move away from the slope of the spring bearer 19 which falls by the action of the urging force of the compression spring 5. The compression spring 5 loses its urging force, and the tilt member 6 falls by its own weight and moves away from the sheet feed roller 4, releasing a sheet material 2*n* having its leading edge nipped between the sheet feed roller 4 and the tilt member 6. Simultaneously, a pivotal movement of the sensing lever 17 in the counter-clockwise direction causes the arms 17*a* to rake out the sheet material 2*n* on the cassette 11, as illustrated in FIG. 34. As the cassette 11 is further drawn out, the torsion springs 51 lose their urging forces to cause the pressure lever 18 to pivotally move in the counter-clockwise direction, and the bottom board 1 to fall by its own weight, as illustrated in FIG. 35.

According to the twelfth embodiment, the tilt member 6 can be released from a pressure applied thereto to remove the remaining sheet material 2*n,* thereby making it possible to more securely prevent a failure in feeding a sheet material without substantially increasing parts of the sheet feeder.

Figure 37:
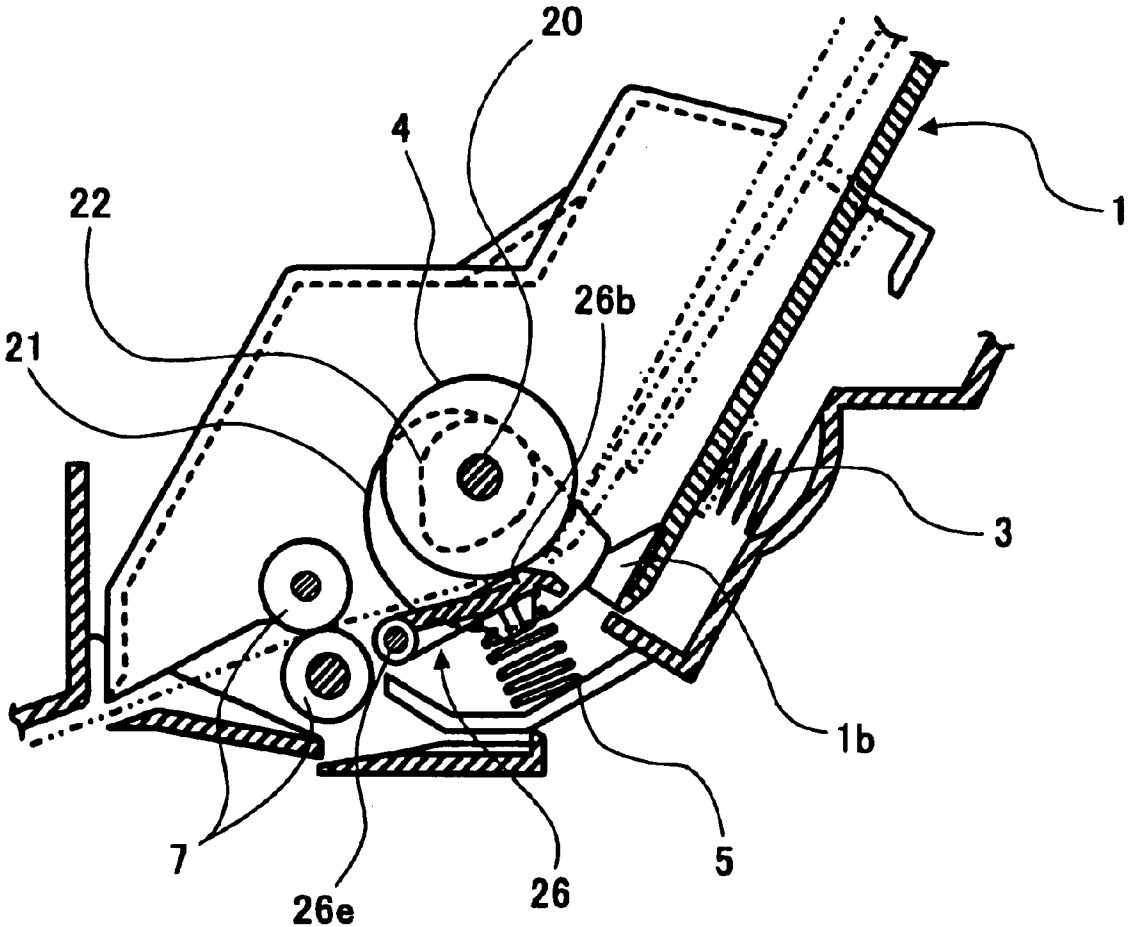
FIG. 37 is a vertical sectional view illustrating a main portion of a sheet feeder according to a thirteenth embodiment.
Figure 38:
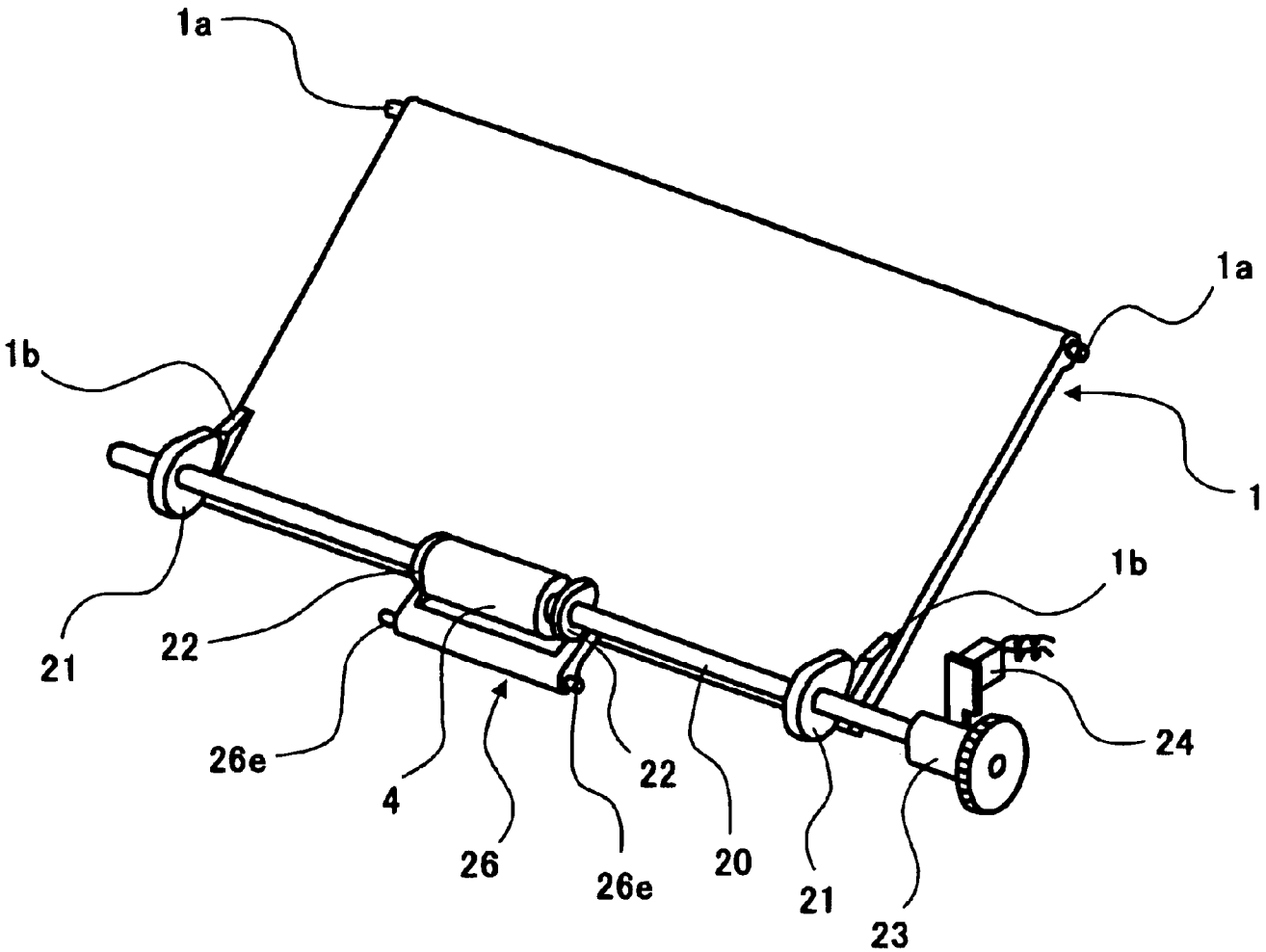
FIG. 38 is a perspective view of the portion illustrated in FIG. 37.
Figure 39:
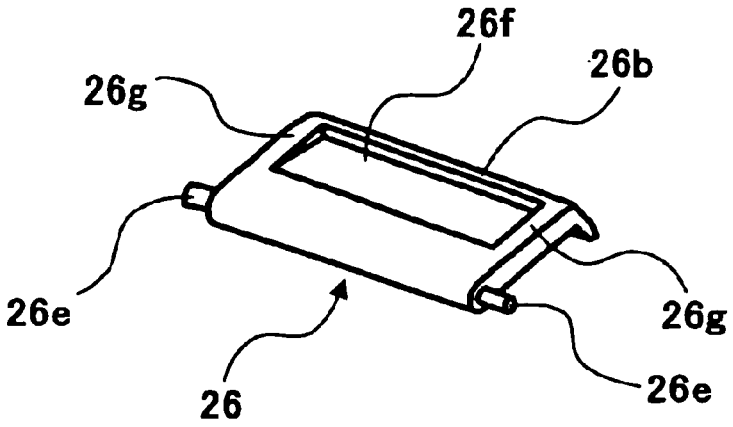
FIG. 39 is a perspective view illustrating a tilt member appearing in FIG. 38.

The foregoing first through twelfth embodiments have been described for a sheet feeding cassette in which a plurality of sheet materials 2 are horizontally stacked on the bottom board 1. Some sheet feeders, however, have a cassette which is set obliquely to the back face of an image forming apparatus. FIG. 37 is a cross-sectional view of a main portion of a sheet feeder according to a thirteenth embodiment for use with an obliquely set cassette, FIG. 38 is a perspective view of the portion illustrated in FIG. 37, and FIG. 39 is a perspective view illustrating a tilt member included in the sheet feeder.

In the thirteenth embodiment, pressor ribs 1*b* are integrally formed on both sides of a front face of the bottom board 1, and first cams 21 are secured to a rotating shaft 20 of a sheet feed roller 4 and second cams 22 are secured on the rotating shaft 20 on both sides of the sheet feed roller 4 corresponding to the pressor ribs 1*b*. A tilt member 26 pivotally supported by a shaft 26*e* has its contact face 26*b* at its leading end in contact with the sheet feed roller 4 by an urging force of a compression spring. The tilt member 26 is formed with recess 26*f* opposite to the sheet feed roller 4 at a location downstream of the contact face 26*b*. Formed on both sides of the recess 26*b* are ribs 26*g* which can come in contact with the second cams 22. A spring clutch 23 is disposed at one end of the rotating shaft 20 (right end in FIG. 38) for intermittently transmitting the rotation of a driving motor, not shown, and is controlled by a solenoid to drive the rotating shaft 20 on a one-rotation basis in the clockwise direction in FIG. 37.

Figure 40:
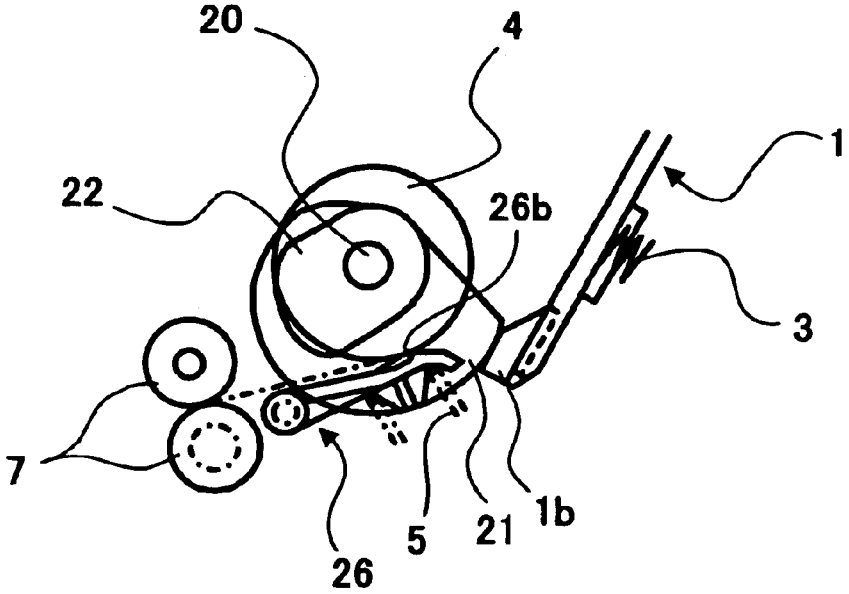
FIGS. 40 through 44 are explanatory diagrams illustrating a sequence of operation states in the thirteenth embodiment.
Figure 41:
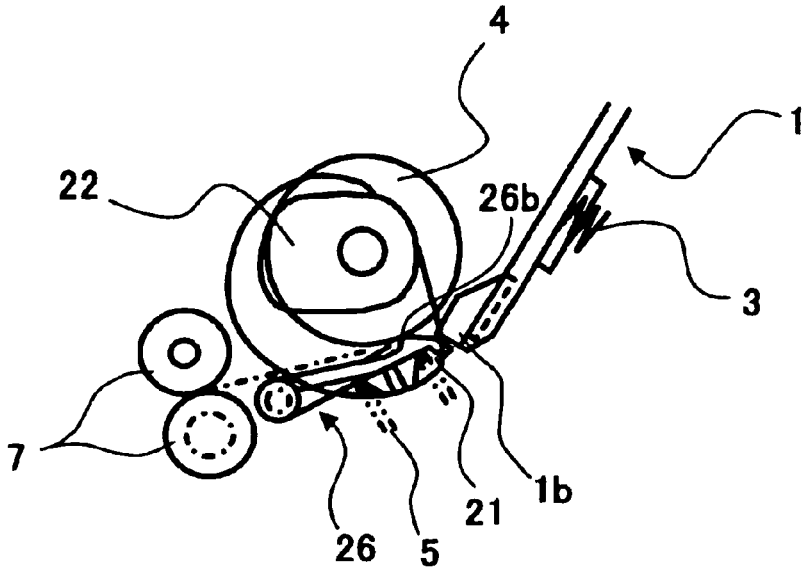
Figure 42:
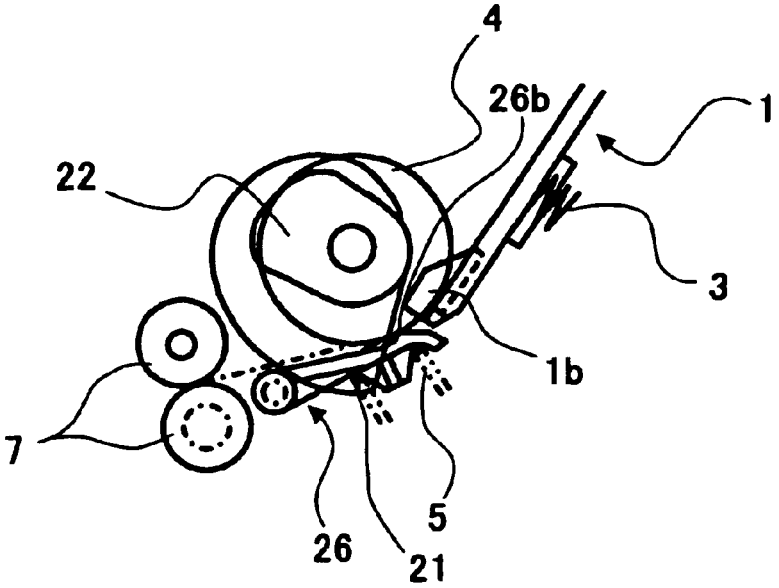
Figure 43:
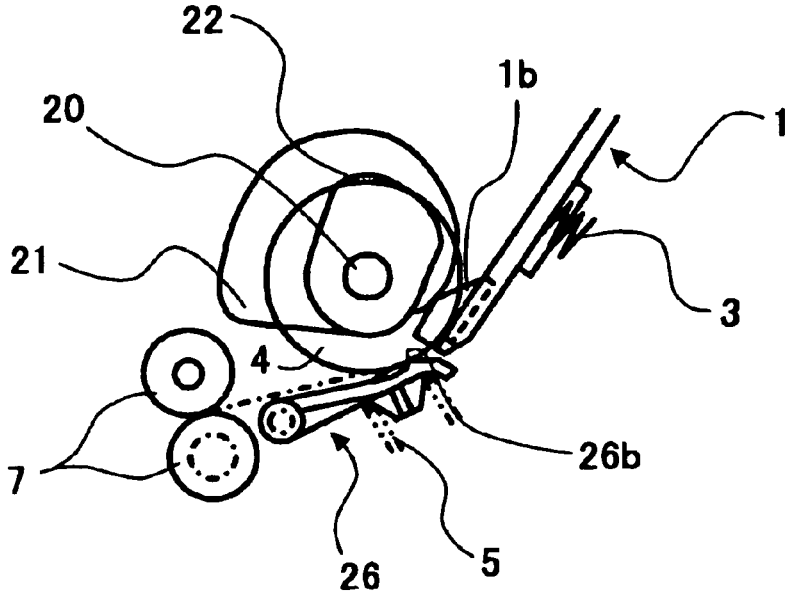

FIGS. 40 through 45 show the operation of the structure described above, and FIG. 45 specifically illustrates a sheet material waiting state. The bottom board 1 and the tilt member 26 are spaced apart from the sheet feed roller 4 against urging forces of the compression springs 3, 5, respectively by the first and second cams 21, 22. As a sheet material is fed to cause the sheet feed roller 4 to rotate in the clockwise direction, the first and second cams 21, 22 are rotated in synchronism with the rotation of the sheet feed roller 4. First, as illustrated in FIG. 40, the top dead center of each second cam 22 leaves the tilt member 26 which comes in contact with the sheet feed roller 4. Next, through the state illustrated in FIG. 41, the top dead center of each first cam 21 slides off the pressor rib 1*b* of the bottom board 1, as illustrated in FIG. 42, causing the bottom board 1 to pivotally move toward the sheet feed roller 4 to convey a sheet material (not shown) stacked on the bottom board 1 to the tilt member 26. The topmost sheet material is separated from a stack and conveyed to a pair of convey rollers 7.

Figure 44:
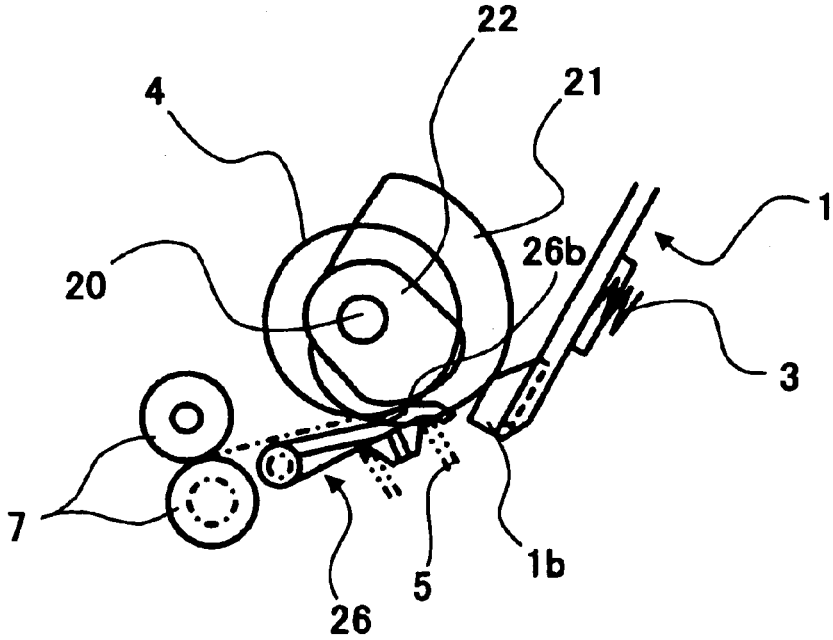
Figure 45:
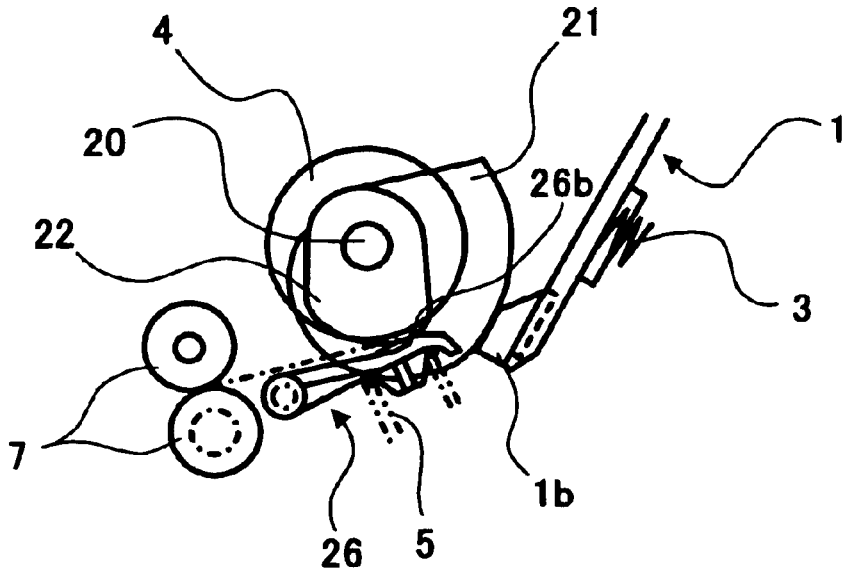
FIG. 45 is an explanatory diagram illustrating a sheet feed waiting state in the thirteenth embodiment.

Now, as illustrated in FIG. 43, the first cams 21 again come in contact with the pressor ribs 1*b* of the bottom board 1 to pivotally move the bottom board 1 in the counter-clockwise direction. Next, the second cams 22 come in contact with the tilt member 26 to pivotally move the bottom board 1 in the clockwise direction, as illustrated in FIG. 44, subsequently reaching the waiting state illustrated in FIG. 45.

As described above, the ribs 26*g* are disposed on both sides of the tilt member 26 with which the second cams 22 can be come in contact. With the tilt member 26 pushed down by the rotation of the sheet feed roller 4, when the sheet feed roller 4 is rotated in a waiting state (while the pair of convey roller pairs 7 are conveying a sheet material) after a sheet material has been separated, the sheet material is conveyed between the second cams 22 and the ribs 26*g* of the tile member 26, and thereby making it possible to prevent the contact face 26*b* of the tilt member 26 from rubbing with the sheet material to wear the contact face 26*b*.

The thirteenth embodiment might not work consistently if a large number of sheet materials, the leading edges of which are uneven, are set below the sheet feed roller 4.

Figure 46:
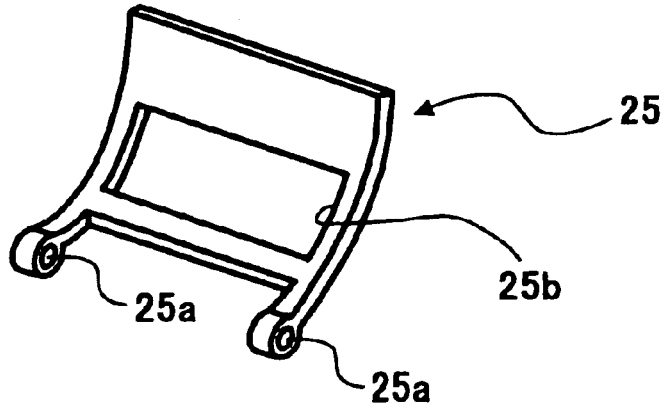
FIG. 46 is a perspective view illustrating a tilt member holder plate in a fourteenth embodiment.

FIG. 46 is a perspective view illustrating a tilt member holder plate 25 disposed between the second cams 22 and the tilt member 26 for solving the above problem. The tilt member holder plate 25 has a pair of left and right bearings 25*a* pivotally supported by a shaft 27 of an opposing roller 7*b* of a pair of convey rollers 7 illustrated in FIG. 47. The tilt member holder plate 25 is formed with an opening 25*b* in a longitudinal middle portion for avoiding a site at which the sheet feed roller 4 comes in contact with the tilt member 26. The remaining structure is similar to that of the thirteenth embodiment.

In the fourteenth embodiment configured as described above, FIG. 52 illustrates a sheet feed waiting state, where the first cams 21 press the pressor ribs 1*b* of the bottom board 1, the second cams 22 press the ribs 26*g* of the tilt member 26 through the tilt member holder plate 25, and the bottom board 1 and the tilt member 26 are spaced apart from the sheet feed roller 4. The free end of the tilt member holder plate 25 is positioned upstream of the sheet feed roller 4, with a spacing defined between the tilt member holder plate 25 and the bottom board 1 in a sheet material inserting direction. With this structure, even if a large number of sheet materials are not even at their leading edges, the sheet materials can be securely set below the feed sheet roller 4.

Figure 47:
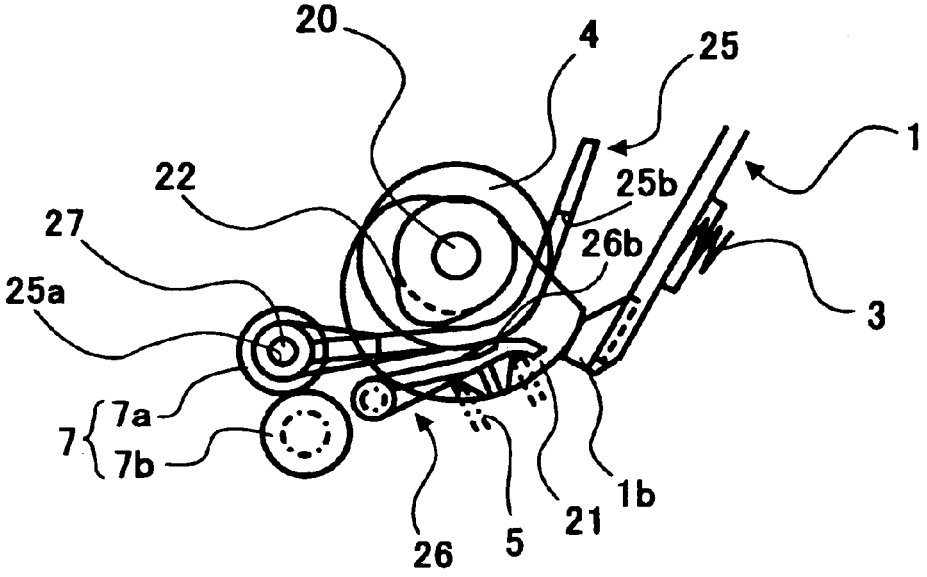
FIGS. 47 through 51 are explanatory diagrams illustrating a sequence of operation states in the fourteenth embodiment.
Figure 48:
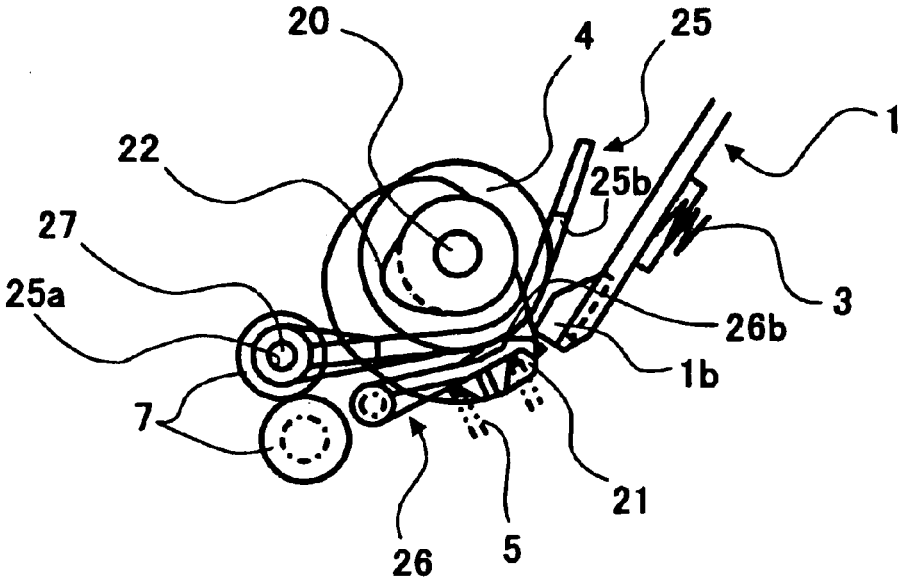
Figure 49:
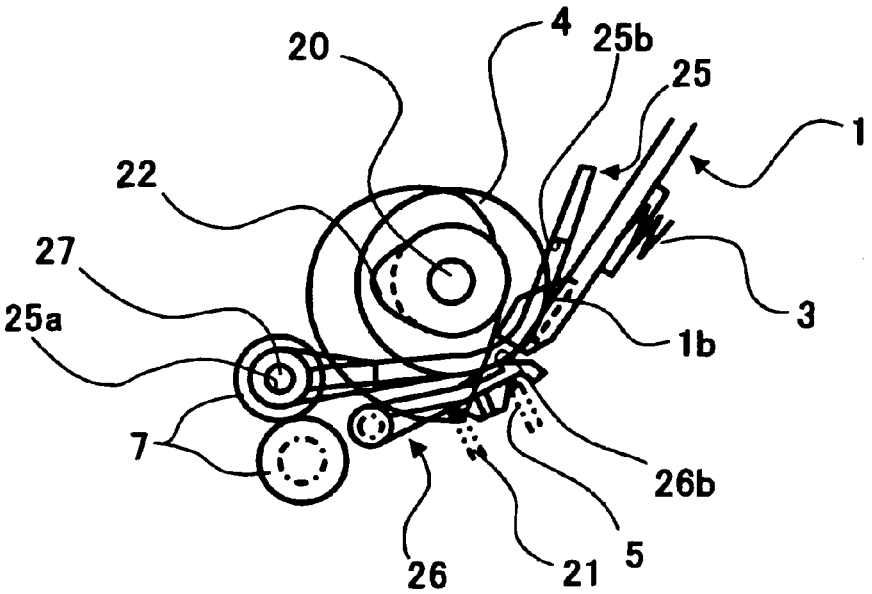
Figure 52:
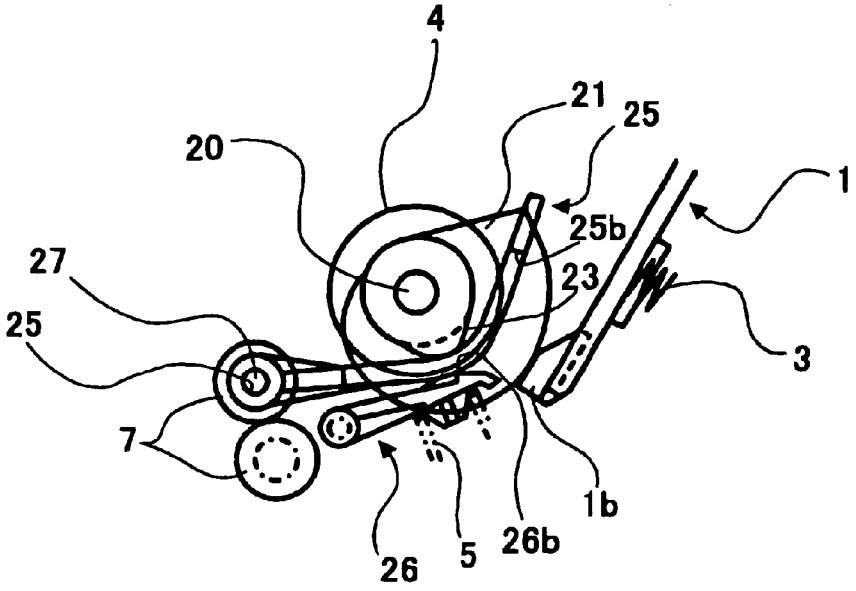
FIG. 52 is an explanatory diagram illustrating a sheet feed waiting state in the fourteenth embodiment.

As a sheet material is fed from the state illustrated in FIG. 52, causing the sheet feed roller 4 to rotate in the clockwise direction, the first and second cams 21, 22 are also rotated in synchronism with the rotation of the sheet feed roller 4. First, as illustrated in FIG. 47, the top dead center of each second cam 22 slides off the tilt member holder plate 25, and the tilt member 26 comes in contact with the sheet feed roller 4. Further, through the state illustrated in FIG. 48, the top dead center of each first cam 21 slides off the pressor rib 1*b* of the bottom board 1, as illustrated in FIG. 49, causing the bottom board 1 to pivotally move toward the sheet feed roller 4 to convey a sheet material stacked on the bottom board 1 to the tilt member 26. The topmost sheet material is separated and conveyed to a pair of convey rollers 7.

Figure 50:
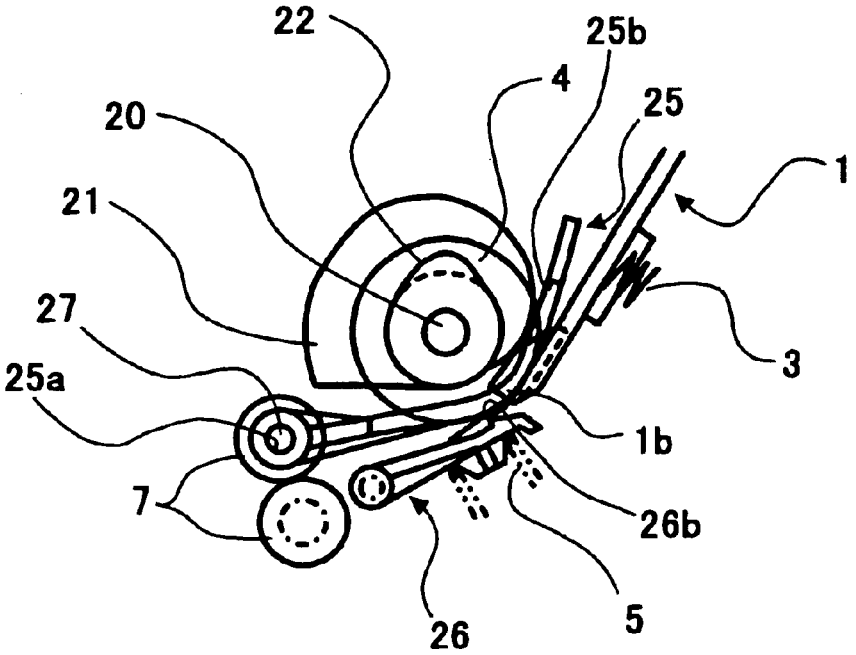
Figure 51:
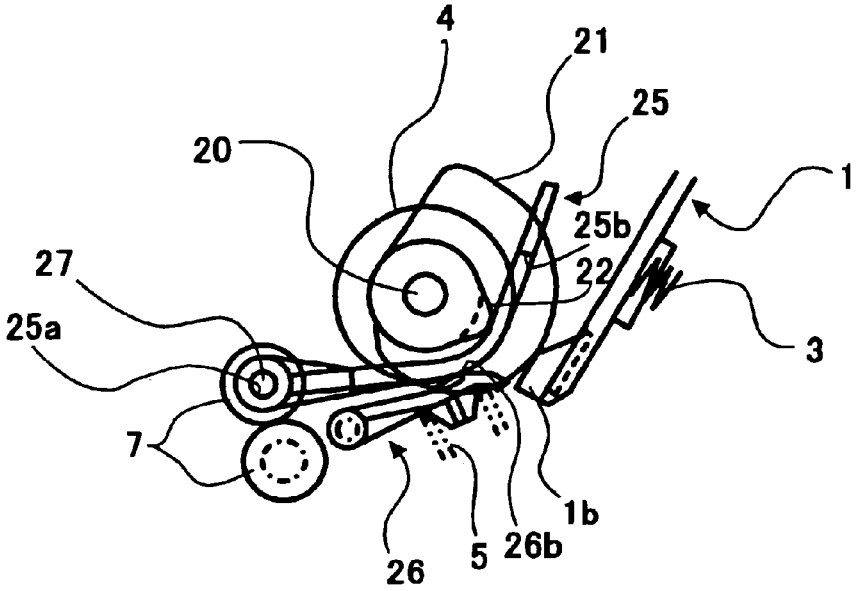

Now, as illustrated in FIG. 50, the first cams 21 again come in contact with the pressor ribs 1*b* of the bottom board 1 to pivotally move the bottom board 1 in the counter-clockwise direction. Next, the second cams 22 come in contact with the tilt member holder plate 25 to pivotally move the bottom board 1 in the clockwise direction, as illustrated in FIG. 50, subsequently reaching the waiting state illustrated in FIG. 52.

As described above, the tilt member holder plate 25 is disposed between the tilt member 26 and the second cams 22, with its leading end positioned upstream of the sheet feed roller 4, so that a large number of sheet materials with uneven leading edges, led by the tilt member holder plate 25, can be securely set below the sheet feed roller 4.

Figure 53:
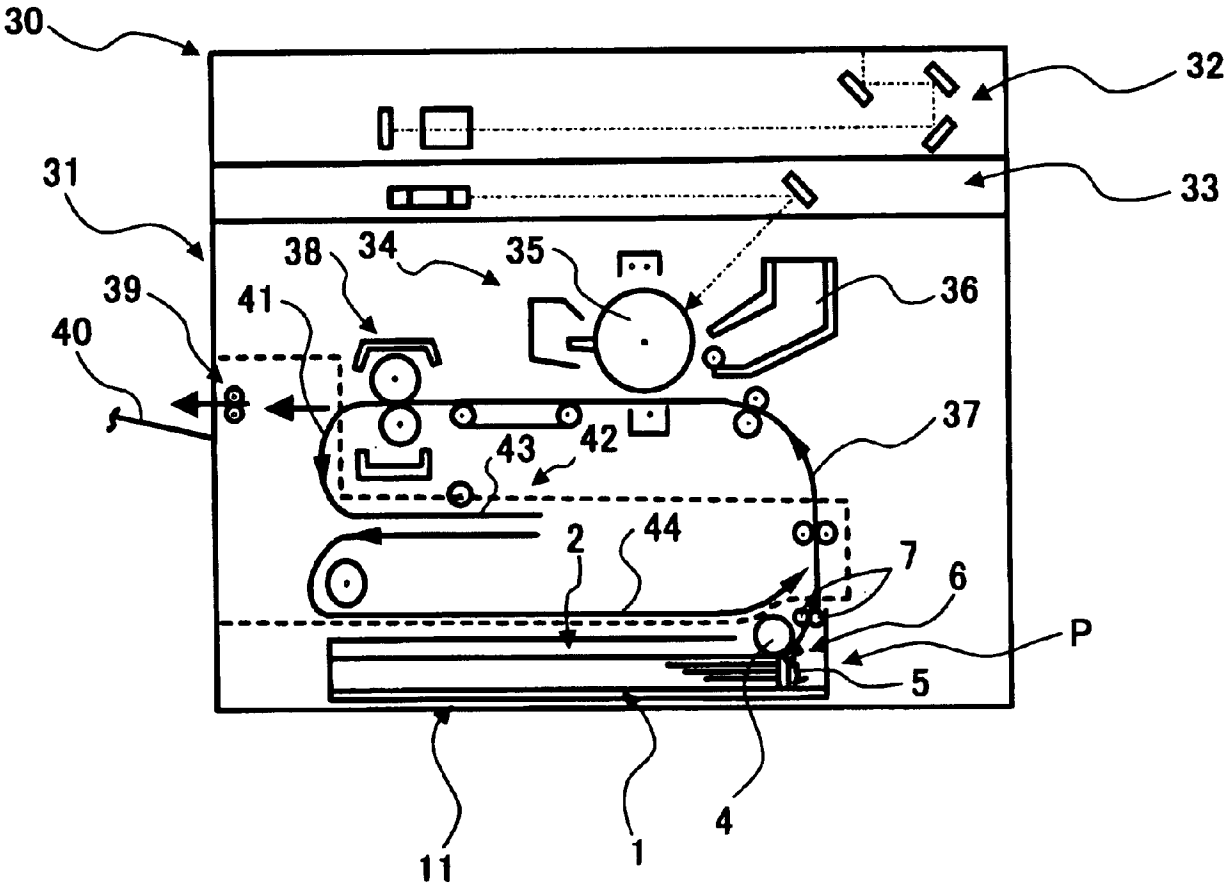
FIG. 53 is a lateral view illustrating a configuration of an exemplary image forming apparatus equipped with the sheet feeder.

Next, FIG. 53 illustrates the configuration of a copier which is an example of image forming apparatus equipped with the sheet feeder.

In the illustrated copier 30, an optical writing system 33 forms a latent image on a photosensitive drum 35 disposed in an image forming system 34 based on image data read by an optical reading system disposed in a copier body 31. A developing unit 36 in the image forming system 34 produces a visible image from the latent image with a toner.

The aforementioned sheet feeder P is disposed in a lower portion of the copier body 31. Sheet materials 2 stacked on a bottom board 1 are fed one by one from a cassette 11 by a sheet feed roller 4, and passed through a convey path 37 by a pair of convey rollers 7 to the image forming system 34. The visible image on the photosensitive drum 35 is transferred to the sheet material 2.

As the transfer is completed, the sheet material 2 is conveyed to a fixer 38 for fixing the visible image, and discharged to an external discharge tray 40 by a pair of sheet discharge rollers 39. For double-side image formation, the sheet material 2 is conveyed from a reverse convey path 41 to a double-side device 42 by a discharged sheet branch tab, not shown, and once stored in a double side tray 43. Then, the sheet material 2 is again fed into the image forming system 34 from the double side convey path 44 for forming an image on the back side thereof, and discharged on the sheet discharge tray 40 through the fixer 38.

It should be noted that while FIG. 53 shows only one sheet feeder P for simplifying the illustration, a copier may be equipped with a plurality of sheet feeders of different sizes as required. In addition, an image forming apparatus equipped with the sheet feeder is not limited to a copier, but can be used in facsimiles, printers and other image forming devices and in other devices.

Numerous additional modifications and variations are possible in light of the above teachings. It is therefore to be understood that within the scope of the appended claims, the present invention may be practiced otherwise than as specifically described herein.

This application claims priority to Japanese patent applications, No. JPAP2000-239871 filed on Aug. 8, 2000, No. 2001-079040 filed on Mar. 19, 2001, No. JPAP2000-405063 filed on Dec. 29, 2000, No. JPAP2000-299245 filed on Sep. 29, 2000, and No. JPAP2001-142313 filed on May 11, 2001 in the Japanese Patent Office, the entire contents of which are hereby incorporated by reference.

What is claimed is:

1. A sheet feeder for separating sheets stacked on a pivotable sheet material stacking member and feeding said sheets, one by one, from the topmost sheet, said sheet feeder comprising:

a sheet feed roller configured to come in pressing contact with the topmost sheet for feeding the sheet to a separator; and a tilt member configured to come in pressing contact with said sheet feed roller and including a tilt face, said sheet feed roller having a front end running against said tilt face, said tilt member having a contact face in contact with said sheet feed roller, wherein said contact face is in the shape of a narrow raised edge extending along an axial direction of said sheet feed roller, said narrow raised edge forms substantially the entirety of said contact face and is adjacent to an end of said tilt face, and said substantially the entirety of said contact face is in contact with said sheet feed roller.

2. A sheet feeder according to claim 1, wherein said tilt member is in pressing contact with said sheet feed roller for pivotal movement with respect to said sheet feed roller.

3. A sheet feeder according to claim 1, wherein said tilt member includes translating means for advancing and retracting said tilt member with said edge remaining parallel to an axis of said sheet feed roller.

4. A sheet feeder according to claim 3, wherein said translating means includes a rib formed on one of said tilt member and a feeder body, and a guide rail formed on the other.

5. A sheet feeder according to claim 1, wherein said tilt members contact face has a length which is less than an axial length of said sheet feed roller.

6. A sheet feeder according to claim 1, wherein said tilt member is formed of a synthetic resin, and includes a metal plate for covering at least the contact face with said sheet feed roller.

7. A sheet feeder according to claim 6, wherein said metal plate is elastic.

8. A sheet feeder according to claim 7, wherein said elastic metal plate is mounted at the tilt face so as to surround said tilt member on both upper and lower sides.

9. A sheet feeder according to claim 1, wherein said sheet feed roller feeds said sheets in a feed convey direction, and the distance in said sheet material convey direction between a location of said sheet feed roller at which said tilt member is in pressing contact with said sheet feed roller and a location of said sheet feed roller at which a sheet stacked on said sheet stacking member comes in contact with said sheet feed roller is in a range of 2 mm to 6 mm, and the angle of the tilt face of said tilt member to the sheet material convey direction is in a range of 50° to 70°.

10. A sheet feeder according to claim 1, further comprising a thin elastic member disposed at a location downstream of a contact area of said sheet feed roller in contact with said tilt member such that said thin elastic member crosses a tangential direction of said contact area.

11. A sheet feeder according to claim 10, wherein said thin elastic member comprises two members spaced from each other along an axis of said sheet feed roller.

12. A sheet feeder according to claim 10, wherein said sheet feed roller has an axial length, and said thin elastic member is disposed substantially at a center of said axial length of said sheet feed roller.

13. A sheet feeder according to claim 1, further comprising a thin elastic member crossing a tangential direction of the contact area of said tilt member and said sheet feed roller at a location downstream of the contact area of said sheet feed roller with said tilt member, said thin elastic member including a bend in the shape of hook bent toward said sheet feed roller at a rear end thereof.

14. A sheet feeder according to claim 13, wherein said thin elastic member comprises two members spaced along an axis of said sheet feed roller.

15. A sheet feeder according to claim 13, wherein said thin elastic member is disposed substantially at the center of an axial length said sheet feed roller.

16. A sheet feeder according to claim 13, wherein said thin elastic member crosses the tangential direction at an angle ranging from 20° to 60°.

17. A sheet feeder according to claim 1, further comprising a friction member crossing a tangential direction to a contact area of said sheet feed roller in contact with said tilt member at a location downstream of the contact area.

18. A sheet feeder according to claim 17, wherein said friction member comprises two members spaced along an axial length of said sheet feed roller.

19. A sheet feeder according to claim 17, wherein said friction member is disposed substantially at a center of an axial length of said sheet feed roller.

20. A sheet feeder according to claim 1, further comprising:

a pressure lever having a free end configured to come in contact with and move away from said sheet stacking member;

a sensing lever mounted coaxially with said pressure lever for pivotal movement associated with insertion/removal of a cassette having said sheet stacking member; and an elastic member disposed between said sensing lever and said pressure lever.

21. A sheet feeder according to claim 20, wherein said pressure lever is pivotally moved in association with said sensing lever when an angle of said pressure lever to said sensing lever is greater than a predetermined angle.

22. A sheet feeder according to claim 20, wherein said sensing lever includes a pair of arms at a free end thereof, said arms extending from both sides of said tilt member, wherein said sensing lever pivotally moves to cause said arms to pass both sides of the contact area of said tilt member.

23. A sheet feeder according to claim 20, wherein said sensing lever includes spring pressure changing means for adjusting an urging force of a compression spring for pressing said tilt member onto said sheet feed roller.

24. A sheet feeder according to claim 23, further comprising a spring bearer disposed slidably in an axial direction of said compression spring on an opposite side of said compression spring with respect to said tilt member, wherein said spring pressure changing means engages with and disengages from said spring bearer associated with pivotal movement of said sensing lever, and said spring pressure changing means drives said spring bearer toward said tilt member when said spring pressure changing means engages with said spring bearer.

25. A sheet feeder according to claim 1, further comprising first cams disposed coaxially with said sheet feed roller for separating said sheet material stacking member from said sheet feed roller when said first cams come in contact with both side ends of a front face of said sheet material stacking member.

26. A sheet feeder according to claim 25, wherein said sheet stacking member includes pressor ribs at both side ends at a front face thereof, such that said first cams come in contact with said pressor ribs.

27. A sheet feeder according to claim 25, further comprising second cams disposed coaxial with said sheet feed roller for separating said tilt member from said sheet feed roller when said second cams come in contact with both side ends of said tilt member.

28. A sheet feeder according to claim 27, wherein said tilt member includes ribs at both side ends such that said second cams come in contact with said ribs.

29. A sheet feeder according to claim 27, further comprising a tilt member holder plate between said second cams and said tilt member, said tilt member holder plate being formed with an opening for avoiding a site at which said sheet feed roller comes in contact with said tilt member, said tilt member holder plate having a leading end spaced apart from said sheet stacking member.

30. A sheet feeder for separating sheets stacked on a pivotable sheet stacking member and for feeding said sheets, one by one, from the topmost sheet, said sheet feeder comprising:

sheet feed roller means for coming in pressing contact with the topmost sheet for feeding the sheet to a separator; and tilt member means for coming in pressing contact with said sheet feed roller means and including a tilt face, said sheet feed roller means having a front end running against said tilt face, said tilt member means having a contact face in contact with said sheet feed roller means, wherein said contact face is in the shape of a narrow raised edge extending along an axial direction of said sheet feed roller means, said narrow raised edge forms substantially the entirety of said contact face and is adjacent to an end of said tilt face, and said substantially the entirety of said contact face is in contact with said sheet feed roller.

31. A sheet feeder according to claim 30, wherein said tilt member means is in pressing contact with said sheet feed roller means for pivotal movement with respect to said sheet feed roller means.

32. A sheet feeder according to claim 30, wherein said tilt member means includes translating means for advancing and retracting said tilt member means with said edge thereof remaining parallel to an axis of said sheet feed roller means.

33. A sheet feeder according to claim 32, wherein said translating means includes a rib formed on one of said tilt member means and a feeder body, and a guide rail formed on the other.

34. A sheet feeder according to claim 30, wherein said contact face of said tilt member has a length that is less than an axial length of said sheet feed roller means.

35. A sheet feeder according to claim 30, wherein said tilt member means is formed of a synthetic resin, and includes a metal plate for covering at least the contact face with said sheet feed roller means.

36. A sheet feeder according to claim 35, wherein said metal plate is elastic.

37. A sheet feeder according to claim 36, wherein said elastic metal plate is mounted at the tilt face so as to surround said tilt member means on both upper and lower sides.

38. A sheet feeder according to claim 30, wherein said sheet feed roller feeds said sheets in a sheet convey direction, and the distance in said sheet convey direction between a location of said sheet feed roller means at which said tilt member means is in pressing contact with said sheet feed roller means and a location of said sheet feed roller means at which a sheet stacked on said sheet stacking member comes in contact with said sheet feed roller means is in a range of 2 mm to 6 mm, and the angle of the tilt face of said tilt member means to the sheet material convey direction is in a range of 50° to 70°.

39. A sheet feeder according to claim 30, further comprising thin elastic member means disposed at a location downstream of a contact area of said sheet feed roller means in contact with said tilt member means such that said thin elastic member crosses a tangential direction of said contact area.

40. A sheet feeder according to claim 39, wherein said thin elastic member means comprises two members spaced axially along a length of said sheet feed roller means.

41. A sheet feeder according to claim 39, wherein said thin elastic member means is disposed substantially at a center of an axial length of said sheet feed roller means.

42. A sheet feeder according to claim 30, further comprising thin elastic member means crossing a tangential direction of the contact area at a location downstream of the contact area of said sheet feed roller means with said tilt member means, said thin elastic member means including a bend in the shape of hook bent toward said sheet feed roller means at a rear end thereof.

43. A sheet feeder according to claim 42, wherein said thin elastic member means comprises two members spaced along an axial length of said sheet feed roller means.

44. A sheet feeder according to claim 42, wherein said thin elastic member means is disposed substantially at the center of an axial length of said sheet feed roller means.

45. A sheet feeder according to claim 42, wherein said thin elastic member means crosses the tangential direction at an angle ranging from 20° to 60°.

46. A sheet feeder according to claim 30, further comprising friction member means crossing a tangential direction to a contact area of said sheet feed roller means in contact with said tilt member means at a location downstream of the contact area.

47. A sheet feeder according to claim 46, wherein said friction member means comprises two members spaced along an axial length of said sheet feed roller means.

48. A sheet feeder according to claim 46, wherein said friction member means is disposed substantially at a center of an axial length of said sheet feed roller means.

49. A sheet feeder according to claim 30, further comprising:

pressure lever means having a free end configured to come in contact with and move away from said sheet stacking member;

sensing lever means mounted coaxially with said pressure lever means for pivotal movement associated with insertion/removal of a cassette having said sheet stacking member; and elastic member means disposed between said sensing lever means and said pressure lever means.

50. A sheet feeder according to claim 49, wherein said pressure lever means is pivotally moved in association with said sensing lever means when an angle of said pressure lever means to said sensing lever means is greater than a predetermined angle.

51. A sheet feeder according to claim 49, wherein said sensing lever means includes a pair of arms at a free end thereof, said arms extending from sides of said tilt member means spaced along an axial length of said sheet feed roller means, wherein said sensing lever means pivotally moves to cause said arms to pass both sides of the contact area of said tilt member means.

52. A sheet feeder according to claim 49, wherein said sensing lever means includes spring pressure changing means for adjusting an urging force of a compression spring for pressing said tilt member means onto said sheet feed roller means.

53. A sheet feeder according to claim 52, further comprising spring bearing means disposed slidably in an axial direction of said compression spring on an opposite side of said compression spring with respect to said tilt member means, wherein said spring pressure changing means engages with and disengages from said spring bearing means associated with pivotal movement of said sensing lever means, and said spring pressure changing means drives said spring bearing means toward said tilt member means when said spring pressure changing means engages with said spring bearing means.

54. A sheet feeder according to claim 30, further comprising first cam means disposed coaxially with said sheet feed roller means for separating said sheet stacking member from said sheet feed roller means when said first cam means come in contact with side ends of a front face of said sheet stacking member.

55. A sheet feeder according to claim 54, wherein said sheet stacking member includes pressor rib means on side ends at a front face thereof, such that said first cam means come in contact with said pressor rib means.

56. A sheet feeder according to claim 54, further comprising second cam means disposed coaxial with said sheet feed roller means for separating said tilt member means from said sheet feed roller means when said second cam means come in contact with both side ends of said tilt member means.

57. A sheet feeder according to claim 56, wherein said tilt member means includes rib means at side ends such that said second cam means come in contact with said rib means.

58. A sheet feeder according to claim 56, further comprising tilt member holder plate means between said second cam means and said tilt member means, said tilt member holder plate means being formed with an opening for avoiding a site at which said sheet feed roller means comes in contact with said tilt member means, said tilt member holder plate means having a leading end spaced apart from said sheet stacking member.

59. An image forming apparatus comprising:

a sheet feeder that separates sheets stacked on a pivotable sheet material stacking member and for feeding the sheets, one by one, from the topmost sheet, said sheet feeder comprising:

a sheet feed roller configured to come in pressing contact with a topmost sheet for feeding the sheet to a separator; and a tilt member configured to come in pressing contact with said sheet feed roller and including a tilt face, said sheet feed roller having a front end running against said tilt face, said tilt member having a contact face in contact with said sheet feed roller, an image forming mechanism configured to form an image on the sheet material fed out from said sheet feeder, wherein said contact face is in the shape of a narrow raised edge extending along an axial direction of said sheet feed roller, said narrow raised edge forms substantially the entirety of said contact face and is adjacent to an end of said tilt face, and said substantially the entirety of said contact face is in contact with said sheet feed roller.

60. An image forming apparatus comprising:

sheet feed means for separating sheets stacked on a pivotable sheet stacking member and for feeding the sheets, one by one, from the topmost sheet, said sheet feeder comprising:

sheet feed roller means for coming in pressing contact with a topmost sheet for feeding the sheet to separating means; and tilt member means for coming in pressing contact with said sheet feed roller means and including a tilt face, said sheet feed roller means having a front end running against said tilt face, said tilt member means having a contact face in contact with said sheet feed roller means, and image forming means for forming an image on the sheet fed out from said sheet feeding means, wherein said contact face is in the shape of a narrow raised edge extending along an axial direction of said sheet feed roller means, said narrow raised edge forms substantially the entirety of said contact face and is adjacent to an end of said tilt face, and said substantially the entirety of said contact face is in contact with said sheet feed roller.

61. A method of image forming, comprising the steps of:

causing a sheet feed roller to come in pressing contact with a topmost sheet of a plurality of sheets stacked on a pivotable sheet stacking member so as to feed the sheet to a separator; and making a tilt member come in pressing contact with said sheet feed roller, said tilt member including a tilt face, said sheet feed roller having a front end running against said tilt face, said tilt member having a contact face in contact with said sheet feed roller, wherein said contact face is in the shape of a narrow raised edge extending along an axial direction of said sheet feed roller, said narrow raised edge forms substantially the entirety of said contact face and is adjacent to an end of said tilt face, and said substantially the entirety of said contact face is in contact with said sheet feed roller.

62. A method of image forming, comprising the steps of:

causing a sheet feed roller to come in pressing contact with a topmost sheet or a stack of sheets stacked on a pivotable sheet stacking member so as to feed the sheet to a separator;

making a tilt member come in pressing contact with said sheet feed roller, said tilt member including a tilt face, said sheet feed roller having a front end running against said tilt face, said tilt member having a contact face in contact with said sheet feed roller; and forming an image on the sheet fed out from said sheet feeder, wherein said contact face is in the shape of a narrow raised edge extending along an axial direction of said sheet feed roller, said narrow raised edge forms substantially the entirety of said contact face and is adjacent to an end of said tilt face, and said substantially the entirety of said contact face is in contact with said sheet feed roller.

63. A sheet feeder comprising:

a support for a stack of sheets including a topmost sheet;

a rotationally mounted feed roller in pressing contact with the topmost sheet in the stack and rotating about an axis for frictionally feeding said topmost sheet in a feeding direction;

a sheet separating member having at least one tilt face at least a part of which is downstream from the support in said feed direction and further having at least one contact face urged in pressing contact with said feed roller;

said contact face being shaped as a narrow raised edge and extending along a line parallel to the feed roller axis, and being downstream from said support in said feeding direction;

said topmost sheet being fed in the feeding direction by said feed roller and being directed toward said edge-shaped contact face by said tilt face, and said edge-shaped contact face being operative to pass the topmost sheet between said at least one contact face and said feed roller but prevent passage therethrough of a sheet from the stack frictionally engaged with the topmost sheet and moving therewith in the feeding direction, said narrow raised edge forming substantially the entirety of said contact face and being adjacent to an end of said tilt face, and said substantially the entirety of said contact face being in contact with said feed roller.

64. A sheet feeding method comprising:

providing a stack of sheets including a topmost sheet;

feeding the topmost sheet in a feeding direction using a rotating feed roller in frictional contact therewith;

using a pressing contact between the feed roller and at least one contact face of a separating member to pass the topmost sheet therethrough but keep from passage a sheet from the stack that is in frictional contact with the topmost sheet and is moving therewith in the feeding direction;

said using step comprising using a pressing contact that is shaped as a narrow raised edge and extends along a line parallel to a rotational axis of the feed roller, said narrow raised edge forming substantially the entirety of said contact face and being adjacent to an end of said tilt face, and said substantially the entirety of said contact face being in contact with said feed roller.

* * * * *